US010972851B2

(12) United States Patent
Song et al.

(10) Patent No.: US 10,972,851 B2
(45) Date of Patent: Apr. 6, 2021

(54) SPATIAL RELATION CODING OF HIGHER ORDER AMBISONIC COEFFICIENTS

(71) Applicant: QUALCOMM Incorporated, San Diego, CA (US)

(72) Inventors: Jeongook Song, San Diego, CA (US); Dipanjan Sen, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 127 days.

(21) Appl. No.: 16/152,153

(22) Filed: Oct. 4, 2018

(65) Prior Publication Data

US 2019/0110148 A1 Apr. 11, 2019

Related U.S. Application Data

(60) Provisional application No. 62/568,699, filed on Oct. 5, 2017, provisional application No. 62/568,692, filed on Oct. 5, 2017.

(51) Int. Cl.

| | |
|---|---|
| ***H04S 5/00*** | (2006.01) |
| ***H04S 3/00*** | (2006.01) |
| ***G10L 19/008*** | (2013.01) |

(52) U.S. Cl.

CPC ..... *H04S 5/00* (2013.01); *G10L 19/008* (2013.01); *H04S 3/008* (2013.01);

(Continued)

(58) Field of Classification Search

CPC . H04S 5/00; H04S 3/004; H04S 3/008; H04S 2400/01; H04S 2400/15;

(Continued)

(56) References Cited

U.S. PATENT DOCUMENTS

2003/0063574 A1 4/2003 Virolainen et al.
2014/0355769 A1* 12/2014 Peters ..... G10L 19/06 381/23

(Continued)

OTHER PUBLICATIONS

International Search Report and Written Opinion of International Application No. PCT/US2018/054644, dated Dec. 10, 2018, 17 pp.

(Continued)

*Primary Examiner* — Davetta W Goins
*Assistant Examiner* — Daniel R Sellers
(74) *Attorney, Agent, or Firm* — Espartaco Diaz Hidalgo

(57) ABSTRACT

In general, techniques are described by which to perform spatial relation coding of higher order ambisonic coefficients using expanded parameters. A device comprising a memory and a processor may perform the techniques. The memory may be configured to store at least a portion of a bitstream, the bitstream including a first indication representative of an HOA coefficient associated with the spherical basis function having an order of zero, and a second indication representative of one or more parameters. The processor may be configured to perform parameter expansion with respect to the one or more parameters to obtain one or more expanded parameters, and synthesize, based on the one or more expanded parameters and the HOA coefficient associated with the spherical basis function having the order of zero, one or more HOA coefficients associated with one or more spherical basis functions having an order greater than zero.

30 Claims, 24 Drawing Sheets

(52) U.S. Cl.
CPC .... *H04R 2201/401* (2013.01); *H04R 2499/11* (2013.01); *H04S 3/004* (2013.01); *H04S 2400/01* (2013.01); *H04S 2400/15* (2013.01); *H04S 2420/11* (2013.01)

(58) Field of Classification Search
CPC ..... H04S 2420/11; H04R 2201/401; H04R 2499/11; G10L 19/008
See application file for complete search history.

(56) References Cited

U.S. PATENT DOCUMENTS

| | | | | |
|---|---|---|---|---|
| 2015/0332682 | A1 | 11/2015 | Kim et al. | |
| 2019/0110147 | A1 | 4/2019 | Song et al. | |
| 2019/0110148 | A1 | 4/2019 | Song et al. | |
| 2019/0335287 | A1* | 10/2019 | Jung | G06F 3/165 |

OTHER PUBLICATIONS

Wabnitz A., et al., "A frequency-domain algorithm to upscale ambisonic sound scenes", 2012 IEEE International Conference on Acoustics, Speech and Signal Processing (ICASSP 2012) : Kyoto, Japan, Mar. 25-30, 2012; [Proceedings], IEEE, Piscataway, NJ, Mar. 25, 2012 (Mar. 25, 2012), pp. 385-388, XP032227141, DOI: 10.1109/ICASSP.2012.6287897, ISBN: 978-1-4673-0045-2, Section 2 "Frequency domain HOA Upscaling algorithm"; p. 385-p. 387; figure 1.

"Wideband coding of speech at around 16 kbitls using Adaptive Multi-Rate Wideband (AMR-WB)," Series G: Transmission Systems and Media, Digital Systems and Networks, Digital terminal equipments—Coding of analogue signals by methods other than PCM, G.722.2, International Telecommunication Union, Jul. 2003, 72 pp.

Hart, "Understanding Surround Sound Production—p. 3," Audioholics, Dec. 5, 2004, 5 pp.

Dietz et al., "Overview of the EVS Codec Architecture," 2015 IEEE International Conference on Acoustics, Speech and Signal Processing (ICASSP), Apr. 19-24, 2015, 5 pp.

Bruhn et al., "System Aspects of the 3GPP Evolution Towards Enhanced Voice Services," 2015 IEEE Global Conference on Signal and Information Processing (GlobalSIP), Dec. 14-16, 2015, 5 pp.

"Information Technology—High efficiency coding and media delivery in heterogeneous environments—Part 3: 3D Audio," ISO/IEC DIS 23008-3, Jul. 25, 2014, 433 pp.

"Information technology—High efficiency coding and media delivery in heterogeneous environments—Part 3: 3D Audio," ISO/IEC JTC 1/SC 29, ISO/IEC 23008-3:201x(E), Oct. 12, 2016, 797 pp.

Poletti, "Three-Dimensional Surround Sound Systems Based on Spherical Harmonics," Journal of Audio Eng. Soc., vol. 53, No. 11, Nov. 2005, pp. 1004-1025.

Universal Mobile Telecommunications System (UMTS); LTE; EVS Codec Detailed Algorithmic Description (3GPP TS 26.445 version 12.0.0 Release 12) Nov. 2014, 627 pp.

U.S. Appl. No. 16/152,130, filed Oct. 4, 2018, by Song et al.

* cited by examiner

Back of Mobile Device

Front of Mobile Device

SPATIAL RELATION CODING OF HIGHER ORDER AMBISONIC COEFFICIENTS

This application claims the benefit of the following U.S. Provisional Applications:

U.S. Provisional Application No. 62/568,699, filed Oct. 5, 2017, entitled "SPATIAL RELATION CODING USING VIRTUAL HIGHER ORDER AMBISONIC COEFFICIENTS;" and U.S. Provisional Application No. 62/568,692, filed Oct. 5, 2017, entitled "SPATIAL RELATION CODING OF HIGHER ORDER AMBISONIC COEFFICIENTS USING EXPANDED PARAMETERS,"

each of the foregoing listed U.S. Provisional Applications is incorporated by reference as if set forth in their respective entirety herein.

TECHNICAL FIELD

This disclosure relates to audio data and, more specifically, coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a stereo channel format, a 5.1 audio channel format, or a 7.1 audio channel format. The SHC representation may therefore enable a better representation of a soundfield that also accommodates backward compatibility.

SUMMARY

In general, techniques are described for coding of higher-order ambisonics audio data. Higher-order ambisonics audio data may comprise at least one higher-order ambisonic (HOA) coefficient corresponding to a spherical harmonic basis function having an order greater than one. In some aspects, the techniques include increasing a compression rate of quantized spherical harmonic coefficients (SHC) signals by encoding directional components of the signals according to a spatial relation (e.g., Theta/Phi) with the zero-order SHC channel, where Theta or θ indicates an angle of azimuth and Phi or Φ/φ indicates an angle of elevation. In some aspects, the techniques include employing a sign-based signaling synthesis model to reduce artifacts introduced due to frame boundaries that may cause such sign changes.

In one aspect, the techniques are directed to a device for encoding audio data, the device comprising a memory configured to store the audio data, the audio data representative of a higher order ambisonic (HOA) coefficient associated with a spherical basis function having an order of zero, and one or more HOA coefficients associated with one or more spherical basis functions having an order greater than zero, and one or more processors coupled to the memory. The one or more processors configured to obtain, based on the one or more HOA coefficients associated with the one or more spherical basis functions having the order greater than zero, a virtual HOA coefficient associated with the spherical basis function having the order of zero, obtain, based on the virtual HOA coefficient, one or more parameters from which to synthesize the one or more HOA coefficients associated with the one or more spherical basis functions having the order greater than zero, and generate a bitstream that includes a first indication representative of the HOA coefficients associated with the spherical basis function having the order of zero, and a second indication representative of the one or more parameters.

In another aspect, the techniques are directed to a method of encoding audio data, the method comprising obtaining, based on one or more HOA coefficients associated with one or more spherical basis functions having the order greater than zero, a virtual HOA coefficient associated with a spherical basis function having an order of zero, obtaining, based on the virtual HOA coefficient, one or more parameters from which to synthesize one or more HOA coefficients associated with one or more spherical basis functions having an order greater than zero, and generating a bitstream that includes a first indication representative of an HOA coefficients associated with the spherical basis function having the order of zero, and a second indication representative of the one or more parameters.

In another aspect, the techniques are directed to a device configured to encode audio data, the method comprising means for obtaining, based on one or more HOA coefficients associated with one or more spherical basis functions having the order greater than zero, a virtual HOA coefficient associated with a spherical basis function having an order of zero, means for obtaining, based on the virtual HOA coefficient, one or more parameters from which to synthesize one or more HOA coefficients associated with one or more spherical basis functions having an order greater than zero, and means for generating a bitstream that includes a first indication representative of an HOA coefficients associated with the spherical basis function having the order of zero, and a second indication representative of the one or more parameters.

In another aspect, the techniques are directed to a non-transitory computer-readable storage medium having stored thereon instructions that, when executed, cause one or more processors to obtain, based on one or more HOA coefficients associated with one or more spherical basis functions having the order greater than zero, a virtual HOA coefficient associated with a spherical basis function having an order of zero, obtain, based on the virtual HOA coefficient, one or more parameters from which to synthesize one or more HOA coefficients associated with one or more spherical basis functions having an order greater than zero, and generate a bitstream that includes a first indication representative of an HOA coefficients associated with the spherical basis function having the order of zero, and a second indication representative of the one or more parameters.

In another aspect, the techniques are directed to a device configured to encode audio data, the device comprising a memory configured to store the audio data, the audio data representative of a higher order ambisonic (HOA) coefficient associated with a spherical basis function having an order of zero, and one or more HOA coefficients associated with one or more spherical basis functions having an order greater than zero; and one or more processors coupled to the memory. The one or more processors configured to obtain a plurality of parameters from which to synthesize the one or more HOA coefficients associated with the one or more spherical basis functions having the order greater than zero, obtain, based on the plurality of parameters, a statistical mode value indicative of a value of the plurality of parameters that appears more frequently than other values of the plurality of parameters, and generate a bitstream to include first indication representative of an HOA coefficient associated with the spherical basis function having an order of zero, and a second indication representative of the statistical mode value.

In another aspect, the techniques are directed to a method of encoding audio data, the method comprising obtaining a plurality of parameters from which to synthesize one or more HOA coefficients associated with one or more spherical basis functions having an order greater than zero, obtaining, based on the plurality of parameters, a statistical mode value indicative of a value of the plurality of parameters that appears more frequently than other values of the plurality of parameters, and generating a bitstream to include a first indication representative of an HOA coefficient associated with the spherical basis function having an order of zero, and a second indication representative of the statistical mode value.

In another aspect, the techniques are directed to a device configured to encode audio data, the device comprising means for obtaining a plurality of parameters from which to synthesize one or more HOA coefficients associated with one or more spherical basis functions having an order greater than zero, means for obtaining, based on the plurality of parameters, a statistical mode value indicative of a value of the plurality of parameters that appears more frequently than other values of the plurality of parameters, and means for generating a bitstream to include a first indication representative of an HOA coefficient associated with the spherical basis function having an order of zero, and a second indication representative of the statistical mode value.

In another aspect, the techniques are directed to a non-transitory computer-readable storage medium having stored thereon instructions that, when executed, cause one or more processors to obtain a plurality of parameters from which to synthesize one or more HOA coefficients associated with one or more spherical basis functions having an order greater than zero, obtain, based on the plurality of parameters, a statistical mode value indicative of a value of the plurality of parameters that appears more frequently than other values of the plurality of parameters, and generate a bitstream to include a first indication representative of an HOA coefficient associated with the spherical basis function having an order of zero, and a second indication representative of the statistical mode value.

In another aspect, the techniques are directed to a device configured to decode audio data, the device comprising a memory configured to store at least a portion of a bitstream, the bitstream including a first indication representative of an HOA coefficient associated with the spherical basis function having an order of zero, and a second indication representative of one or more parameters, and one or more processors coupled to the memory. The one or more processors configured to perform parameter expansion with respect to the one or more parameters to obtain one or more expanded parameters, and synthesize, based on the one or more expanded parameters and the HOA coefficient associated with the spherical basis function having the order of zero, one or more HOA coefficients associated with one or more spherical basis functions having an order greater than zero.

In another aspect, the techniques are directed to a method of decoding audio data, the method comprising performing parameter expansion with respect to one or more parameters to obtain one or more expanded parameters, and synthesizing, based on the one or more expanded parameters and an HOA coefficient associated with a spherical basis function having an order of zero, one or more HOA coefficients associated with one or more spherical basis functions having an order greater than zero.

In another aspect, the techniques are directed to a device configured to decode audio data, the device comprising means for performing parameter expansion with respect to one or more parameters to obtain one or more expanded parameters, and means for synthesizing, based on the one or more expanded parameters and an HOA coefficient associated with a spherical basis function having an order of zero, one or more HOA coefficients associated with one or more spherical basis functions having an order greater than zero.

In another aspect, the techniques are directed to A device configured to decode audio data, the device comprising means for performing parameter expansion with respect to one or more parameters to obtain one or more expanded parameters, and means for synthesizing, based on the one or more expanded parameters and an HOA coefficient associated with a spherical basis function having an order of zero, one or more HOA coefficients associated with one or more spherical basis functions having an order greater than zero.

The details of one or more aspects of the techniques are set forth in the accompanying drawings and the description below. Other features, objects, and advantages of the techniques will be apparent from the description and drawings, and from the claims.

BRIEF DESCRIPTION OF DRAWINGS

Like reference characters denote like elements throughout the figures and text.

DETAILED DESCRIPTION

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. A Moving Pictures Expert Group (MPEG) has released a standard allowing for soundfields to be represented using a hierarchical set of elements (e.g., Higher-Order Ambisonic—HOA—coefficients) that can be rendered to speaker feeds for most speaker configurations, including 5.1 and 22.2 configuration whether in location defined by various standards or in non-uniform locations.

MPEG released the standard as MPEG-H 3D Audio standard, formally entitled "Information technology—High efficiency coding and media delivery in heterogeneous environments—Part 3: 3D audio," set forth by ISO/IEC JTC 1/SC 29, with document identifier ISO/IEC DIS 23008-3, and dated Jul. 25, 2014. MPEG also released a second edition of the 3D Audio standard, entitled "Information technology—High efficiency coding and media delivery in heterogeneous environments—Part 3: 3D audio, set forth by ISO/IEC JTC 1/SC 29, with document identifier ISO/IEC 23008-3:201x(E), and dated Oct. 12, 2016. Reference to the "3D Audio standard" in this disclosure may refer to one or both of the above standards.

As noted above, one example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions (which may also be referred to as a spherical basis function) of order n and suborder m. It can be recognized that the term in square brackets is a frequency-domain representation of the signal (i.e., $S(w, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

Figure 1:
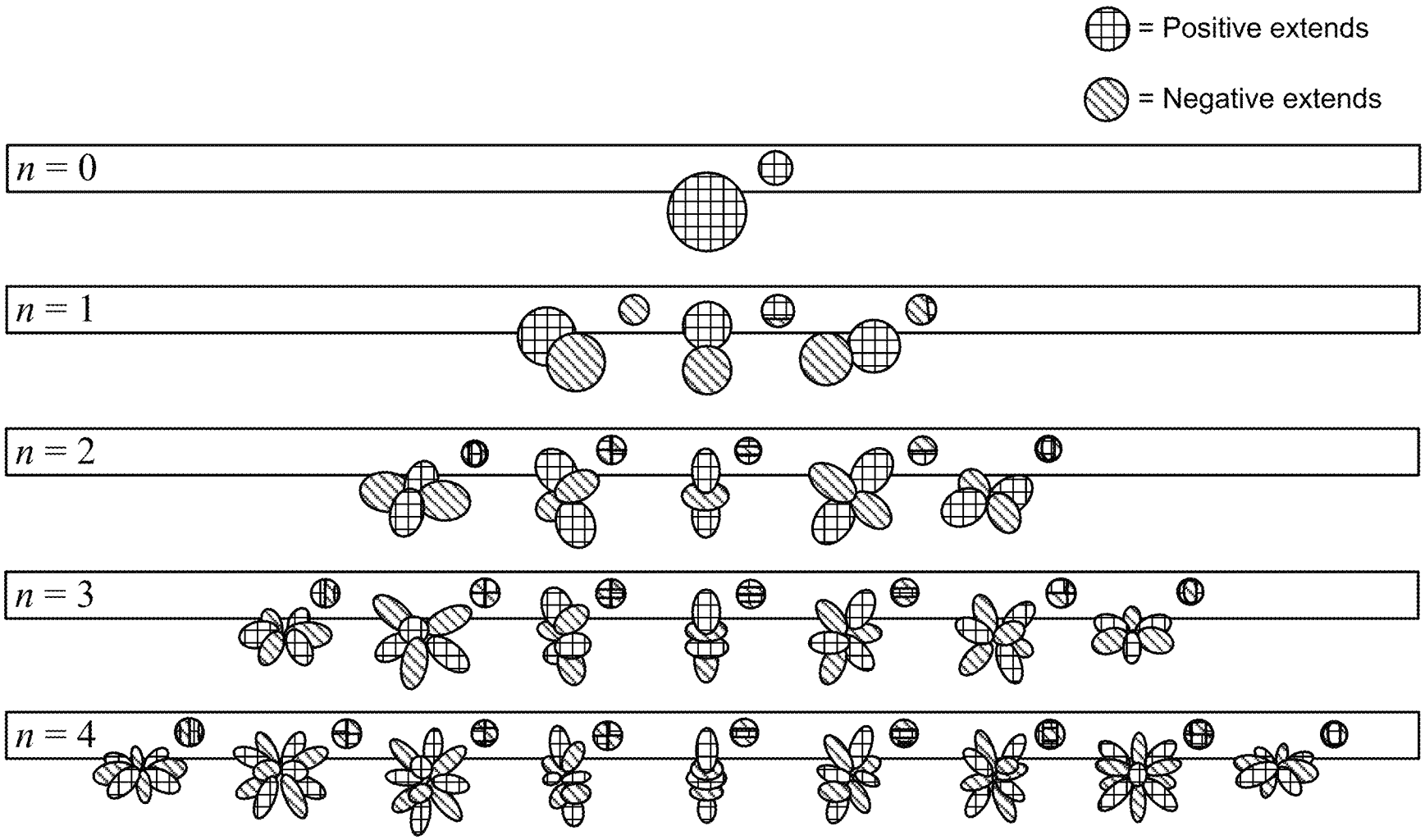
FIG. 1 is a diagram illustrating spherical harmonic basis functions of various orders and sub-orders.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC (which also may be referred to as higher order ambisonic—HOA—coefficients) represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a number of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of SHC-based audio coding.

Figure 2:
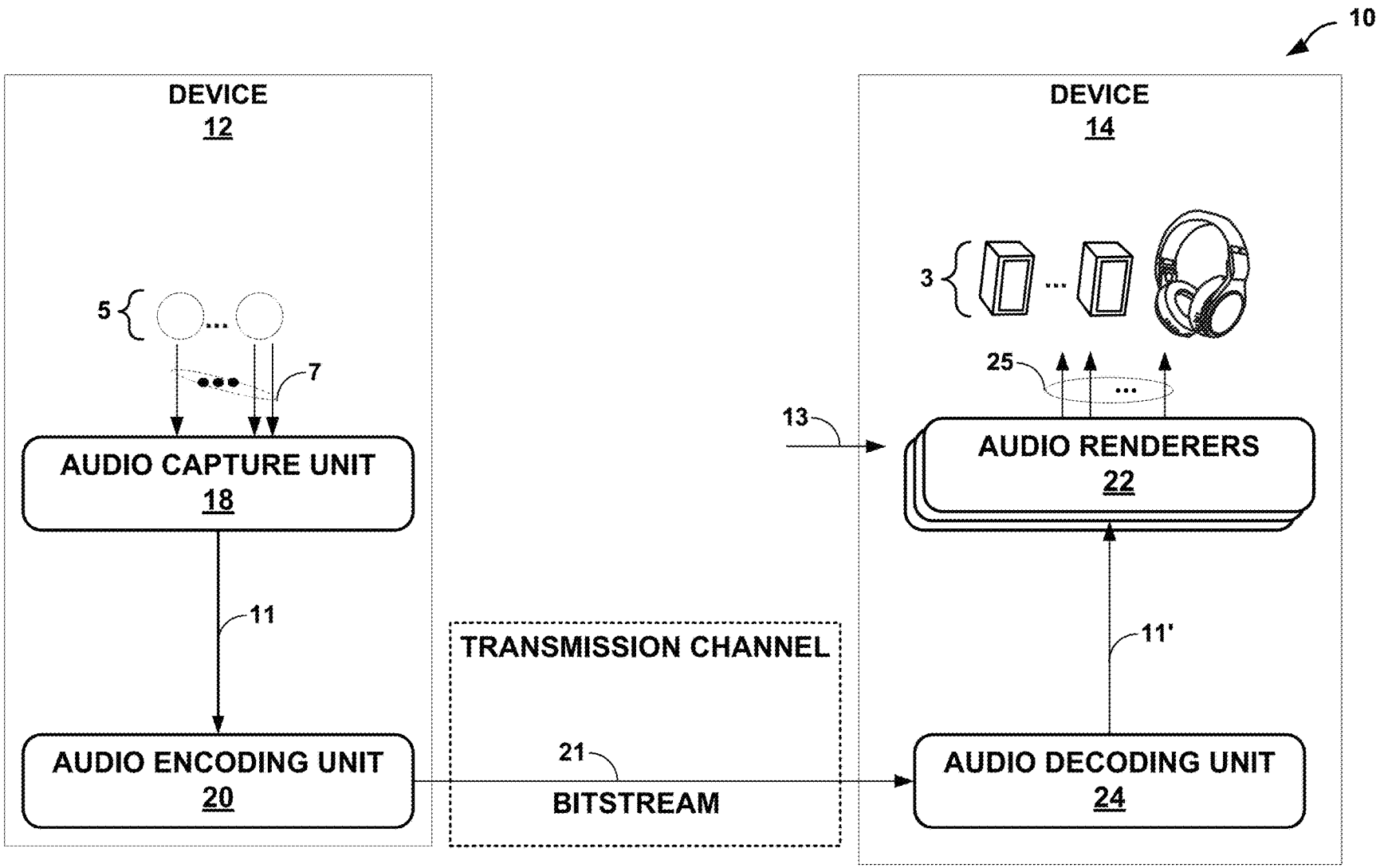
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes devices 12 and 14. While described in the context of the devices 12 and 14, the techniques may be implemented in any context in which SHCs (which may also be referred to as HOA coefficients) or any other hierarchical representation of a soundfield are encoded to form a bitstream representative of the audio data. Moreover, the device 12 may represent any form of computing device capable of implementing the techniques described in this disclosure, including a handset (or cellular phone), a tablet computer, a smart phone, or a desktop computer to provide a few examples. Likewise, the device 14 may represent any form of computing device capable of implementing the techniques described in this disclosure, including a handset (or cellular phone), a tablet computer, a smart phone, a set-top box, or a desktop computer to provide a few examples.

For purposes of the discussion of the techniques set forth in this disclosure, the device 12 may represent a cellular phone referred to as a smart phone. Similarly, the device 14 may also represent a smart phone. The devices 12 and 14 are assumed for purposes of illustration to be communicatively coupled via a network, such as a cellular network, a wireless network, a public network (such as the Internet), or a combination of cellular, wireless, and/or public networks.

In the example of FIG. 2, the device 12 is described as encoding and transmitting a bitstream 21 representative of a compressed version of audio data, while the device 14 is described as receiving and reciprocally decoding the bitstream 21 to obtain the audio data. However, all aspects discussed in this disclosure with respect to device 12 may also be performed by device 14, including all aspects of the techniques described herein. Likewise, all aspects discussed in this disclosure with respect to device 12 may also be performed by device 14, including all aspects of the techniques described herein. In other words, the device 14 may capture and encode audio data to generate the bitstream 21 and transmit the bitstream 21 to the device 12, while the device 12 may receive and decode the bitstream 21 to obtain the audio data, and render the audio data to speaker feeds, outputting the speaker feeds to one or more speakers as described in more detail below.

The device 12 includes one or more microphones 5, and an audio capture unit 18. While shown as integrated within the device 12, the microphones 5 may be external or otherwise separate from the device 12. The microphones 5 may represent any type of transducer capable of converting pressure waves into one or more electric signals 7 representative of the pressure waves. The microphones 5 may output the electrical signals 7 in accordance with a pulse code modulated (PCM) format. The microphones 5 may output the electrical signals 7 to the audio capture unit 18.

The audio capture unit 18 may represent a unit configured to capture the electrical signals 7 and transform the electrical signals 7 from the spatial domain into the spherical harmonic domain, e.g., using the above equation for deriving HOA coefficients ($A_n^m(k)$) from a spatial domain signal. That is, the microphones 5 are located in a particular location (in the spatial domain), whereupon the electrical signals 7 are generated. The audio capture unit 18 may perform a number of different processes, which are described in more detail below, to transform the electrical signals 7 from the spatial domain into the spherical harmonic domain, thereby generating HOA coefficients 11. In this respect, the electrical signals 7 may also be referred to as audio data representative of the HOA coefficients 11.

As noted above, the HOA coefficients 11 may correspond to the spherical basis functions shown in the example of FIG. 1. The HOA coefficients 11 may represent first order ambisonics (FOA), which may also be referred to as the "B-format." The FOA format includes the HOA coefficient 11 corresponding to a spherical basis function having an order of zero (and a sub-order of zero). The FOA format includes the HOA coefficients 11 corresponding to a spherical basis function having an order greater than zero, which are denoted by the variables X, Y, and Z. The X HOA coefficients 11 correspond to the spherical basis function having an order of one and a sub-order of one. The Y HOA coefficients 11 correspond to the spherical basis function having an order of one and a sub-order of negative one. The Z HOA coefficients 11 correspond to the spherical basis function having an order of one and a sub-order of zero.

The HOA coefficients 11 may also represent second order ambisonics (SOA). The SOA format includes all of the HOA coefficients from the FOA format, and an additional five HOA coefficients associated with spherical harmonic coefficients having an order of two and sub-orders of two, one, zero, negative one, and negative two. Although not described for ease of illustration purposes, the techniques may be performed with respect to even the HOA coefficients 11 corresponding to spherical basis functions having an order greater than two.

The device 12 may generate a bitstream 21 based on the HOA coefficients 11. That is, the device 12 includes an audio encoding unit 20 that represents a device configured to encode or otherwise compress HOA coefficients 11 in accordance with various aspects of the techniques described in this disclosure to generate the bitstream 21. The audio encoding unit 20 may generate the bitstream 21 for transmission, as one example, across a transmission channel, which may be a wired or wireless channel, a data storage device, or the like. The bitstream 21 may represent an encoded version of the HOA coefficients 11 and may include various indications of the different HOA coefficients 11.

The transmission channel may conform to any wireless or wired standard, including cellular communication standards promulgated by the 3rd generation partnership project (3GPP). For example, the transmission channel may conform to the enhanced voice services (EVS) of the long term evolution (LTE) advanced standard set forth in the Universal Mobile Telecommunication Systems (UMTS); LTE; EVS Codec Detailed Algorithmic Description (3GPP TS 26.445 version 12.0.0 Release 12) dated November, 2014 and promulgated by 3GPP. Various transmitters and receivers of the devices 12 and 14 (which may also, when implemented as a combined unit, be referred to as a transceiver) may conform to the EVS portions of the LTE advanced standard (which may be referred to as the "EVS standard").

While shown in FIG. 2 as being directly transmitted to the content consumer device 14, the device 12 may output the bitstream 21 to an intermediate device positioned between the devices 12 and 14. The intermediate device may store the bitstream 21 for later delivery to the device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media.

In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the device 14 includes an audio decoding unit 24, and a number of different renderers 22. The audio decoding unit 24 may represent a device configured to decode HOA coefficients 11' from the bitstream 21 in accordance with various aspects of the techniques described in this disclosure, where the HOA coefficients 11' may be similar to the HOA coefficients 11 but differ due to lossy operations (e.g., quantization) and/or transmission via the transmission channel. After decoding the bitstream 21 to obtain the HOA coefficients 11', the device 14 may render the HOA coefficients 11' to speaker feeds 25. The speaker feeds 25 may drive one or more speakers 5. The speakers 3 may include one or both of loudspeakers or headphone speakers.

To select the appropriate renderer or, in some instances, generate an appropriate renderer, the device 14 may obtain speaker information 13 indicative of a number of speakers and/or a spatial geometry of the speakers. In some instances, the device 14 may obtain the speaker information 13 using a reference microphone and driving the speakers in such a manner as to dynamically determine the speaker information 13. In other instances or in conjunction with the dynamic determination of the speaker information 13, the device 14 may prompt a user to interface with the device 14 and input the speaker information 13.

The device 14 may then select one of the audio renderers 22 based on the speaker information 13. In some instances, the device 14 may, when none of the audio renderers 22 are within some threshold similarity measure (in terms of the speaker geometry) to the speaker geometry specified in the speaker information 13, generate the one of audio renderers 22 based on the speaker information 13. The device 14 may, in some instances, generate one of the audio renderers 22 based on the speaker information 13 without first attempting to select an existing one of the audio renderers 22. One or more speakers 3 may then playback the rendered speaker feeds 25.

When the speakers 3 driven by the speaker feeds 25 are headphone speakers, the device 14 may select a binaural renderer from the renderers 22. The binaural renderer may refer to a render that implements a head-related transfer function (HRTF) that attempts to adapt the HOA coefficients 11' to resemble how the human auditory system experiences pressure waves. Application of the binaural renderer may result in two speaker feeds 25 for the left and right ear, which the device 14 may output to the headphone speakers (which may include speakers of so-called "earbuds" or any other type of headphone).

Figure 3A:
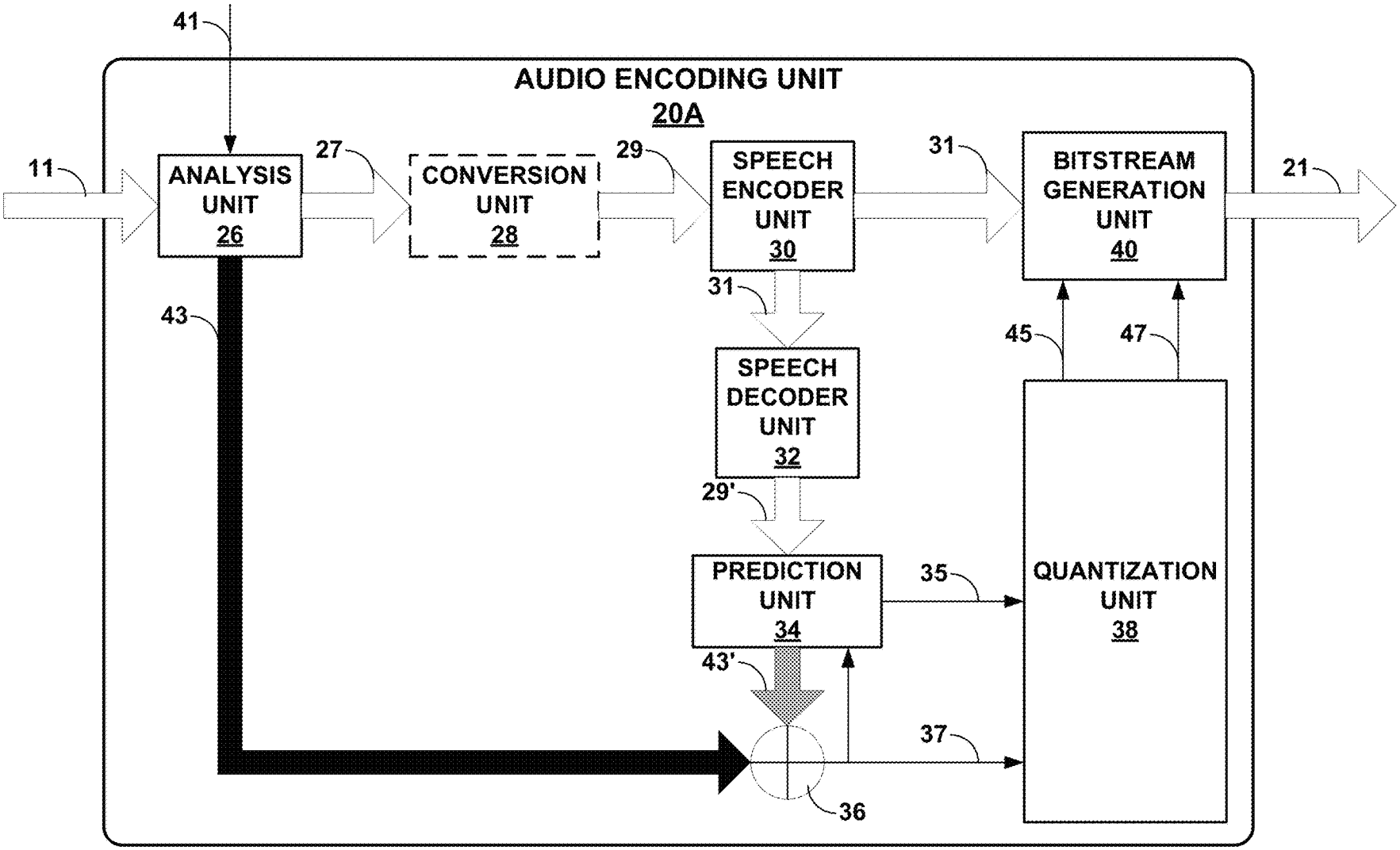
FIGS. 3A-3D are block diagrams each illustrating, in more detail, one example of the audio encoding device shown in the example of FIG. 2 that may perform various aspects of the techniques described in this disclosure.

FIG. 3A is a block diagram illustrating, in more detail, one example of the audio encoding unit 20 shown in the example of FIG. 2 that may perform various aspects of the techniques described in this disclosure. The audio encoding unit 20A shown in FIG. 3A represents one example of the audio encoding unit 20 shown in the example of FIG. 2. The audio encoding unit 20A includes an analysis unit 26, a conversion unit 28, a speech encoder unit 30, a speech decoder unit 32, a prediction unit 34, a summation unit 36, and a quantization unit 38, and a bitstream generation unit 40.

The analysis unit 26 represents a unit configured analyze the HOA coefficients 11 to select a non-zero subset (denoted by the variable "M") of the HOA coefficients 11 to be core encoded, while the remaining channels (which may be denoted as the total number of channels—N−minus M, or N−M) are to be predicted using a predictive model and represented using parameters (which may also be referred to as "prediction parameters"). The analysis unit 26 may receive the HOA coefficients 11 and a target bitrate 41, where the target bitrate 41 may represent the bitrate to achieve for the bitstream 21. The analysis unit 26 may select, based on the target bitrate 41, the non-zero subset of the HOA coefficients 11 to be core encoded.

In some examples, the analysis unit 26 may select the non-zero subset of the HOA coefficients 11 such that the subset includes an HOA coefficient 11 associated with a spherical basis function having an order of zero. The analysis unit 26 may also select additional HOA coefficients 11, e.g., when the HOA coefficients 11 correspond to the SOA format, associated with a spherical basis functions having an order greater than zero for the subset of the HOA coefficients 11. The subset of the HOA coefficients 11 is denoted as an HOA coefficient 27. The analysis unit 26 may output the remaining HOA coefficients 11 to the summation unit 36 as HOA coefficients 43. The remaining HOA coefficients 11 may include one or more HOA coefficients associated with the one or more spherical basis functions having the order greater than zero.

To illustrate, assume in this example the HOA coefficients 11 conform to the FOA format. The analysis unit 25 may analyze the HOA coefficients 11 and select the W coefficients corresponding to the spherical basis function having the order of zero as the subset of the HOA coefficients shown in the example of FIG. 3A as the HOA coefficients 27. The analysis unit 25 may send the remaining X, Y, and Z coefficients corresponding to the spherical basis functions having the order greater than zero (i.e., one in this example) to the summation unit 36 as the HOA coefficients 43.

As another illustration, assume that the HOA coefficients 11 conform to the SOA format. Depending on the target bitrate 41, the analysis unit 25 may select the W coefficients or the W coefficients and one or more of the X, Y, and Z coefficients as the HOA coefficients 27 to be output to the conversion unit. The analysis unit 25 may then output the remaining ones of the HOA coefficients 11 as the HOA coefficients 43 corresponding to the spherical basis function having the order greater than zero (i.e., which would be either one or two in this example) to the summation unit 36.

The conversion unit 28 may represent a unit configured to convert the HOA coefficients 27 from the spherical harmonic domain to a different domain, such as the spatial domain, the frequency domain, etc. The conversion unit 28 is shown as a box with a dashed line to indicate that the domain conversion may be performed optionally, and is not necessarily applied with respect to the HOA coefficients 27 prior to encoding as performed by the speech encoder unit 30. The conversion unit 28 may perform the conversion as a preprocessing step to condition the HOA coefficients 27 for speech encoding. The conversion unit 28 may output the converted HOA coefficients as converted HOA coefficients 29 to the speech encoder unit 30.

The speech encoder unit 30 may represent a unit configured to perform speech encoding with respect to the converted HOA coefficients 29 (when conversion is enabled or otherwise applied to the HOA coefficients 27) or the HOA coefficients 27 (when conversion is disabled). When disabled the converted HOA coefficients 29 may be substantially similar to, if not the same as, the HOA coefficients 27, as the conversion unit 28 may, when present, pass through the HOA coefficients 27 as the converted HOA coefficients 29. As such, reference to the converted HOA coefficients 29 may refer to either the HOA coefficients 27 in the spherical harmonic domain or the HOA coefficients 29 in the different domain.

The speech encoder unit 30 may, as one example, perform enhanced voice services (EVS) speech encoding with respect to the converted HOA coefficients 29. More information regarding EVS speech coding can be found in the above noted standard, i.e., enhanced voice services (EVS) of the long term evolution (LTE) advanced standard set forth in the Universal Mobile Telecommunication Systems (UMTS); LTE; EVS Codec Detailed Algorithmic Description (3GPP TS 26.445 version 12.0.0 Release 12). Additional information, including an overview of EVS speech coding, can also be found in a paper by M. Dietz et al., entitled "Overview of the EVS Codec Architecture," 2015 IEEE International Conference on Acoustics, Speech and Signal Processing (ICASSP), South Brisbane, QLD, April 2015, pp. 5698-5702, and a paper by S. Bruhn et al., entitled "System Aspects of the 3GPP Evolution Towards Enhanced Voice Services," 2015 IEEE Global Conference on Signal and Information Processing (GlobalSIP), Orlando, Fla., December 2015, pp. 483-487.

The speech encoder unit 30 may, as another example, perform adaptive multi-rate wideband (AMR-WB) speech encoding with respect to the converted HOA coefficients 29. More information regarding AMR-WB speech encoding can be found in the G.722.2 standard, entitled "Wideband coding of speech at around 16 kbits/s using Adaptive Multi-Rate Wideband (AMR-WB)," promulgated by the telecommunication standardization sector of the International Telecommunication Union (ITU-T), July, 2003. The speech encoder unit 30 output, to the speech decoding unit 32 and the bitstream generation unit 40, the result of encoding the converted HOA coefficients 29 as encoded HOA coefficients 31.

The speech decoder unit 30 may perform speech decoding with respect to the encoded HOA coefficients 31 to obtain converted HOA coefficients 29', which may be similar to the converted HOA coefficients 29 except that some information may be lost due to lossy operation performed during speech encoding by the speech encoder unit 30. The HOA coefficients 29' may be referred to as "speech coded HOA coefficients 29'," where the "speech coded" refers to the speech encoding performed by the speech encoder unit 30, the speech decoding performed by the speech decoding unit 32, or both the speech encoding performed by the speech encoder unit 30 and the speech decoding performed by the speech decoding unit 32.

Generally, the speech decoding unit 32 may operate in a manner reciprocal to the speech encoding unit 30 in order to obtain the speech coded HOA coefficients 29' from the encoded HOA coefficients 31. As such, the speech decoding unit 32 may perform, as one example, EVS speech decoding with respect to the encoded HOA coefficients 31 to obtain the speech coded HOA coefficients 29'. As another example, the speech decoding unit 32 may perform AMR-WB speech decoding with respect to the encoded HOA coefficients 31 to obtain the speech coded HOA coefficients 29'. More information regarding both EVS speech decoding and AMR-WB speech decoding can be found in the standards and papers referenced above with respect to the speech encoding unit 30. The speech decoding unit 32 may output the speech coded HOA coefficients 29' to the prediction unit 34.

The prediction unit 34 may represent a unit configured to predict the HOA coefficients 43 from the speech coded HOA coefficients 29'. The prediction unit 34 may, as one example, predict the HOA coefficients 43 from the speech coded HOA coefficients 29' in the manner set forth in U.S. patent application Ser. No. 14/712,733, entitled "SPATIAL RELATIONCODING FOR HIGHER ORDER AMBISONIC COEFFICIENTS," filed May 14, 2015, with first named inventor Moo Young Kim. However, rather than perform spatial encoding and decoding as set forth in U.S. patent application Ser. No. 14/712,733, the techniques may be adapted to accommodate speech encoding and decoding.

In another example, the prediction unit 34 may predict the HOA coefficients 43 from the speech coded coefficients 29' using a virtual HOA coefficient associated with the spherical basis function having the order of zero. The virtual HOA coefficient may also be referred to as synthetic HOA coefficient or a synthesized HOA coefficient.

Prior to performing prediction, the prediction unit 34 may perform a reciprocal conversion of the speech coded HOA coefficients 29' to transform the speech coded coefficients 29' back into the spherical harmonic domain from the different domain, but only when the conversion was enabled or otherwise performed by the conversion unit 28. For purposes of illustration, the description below assumes that conversion was disabled and that the speech coded HOA coefficients 29' are in the spherical harmonic domain.

The prediction unit 34 may obtain the virtual HOA coefficient in accordance with the following equation:

$$W^{+}=\text{sign}(W')\sqrt{X^2+Y^2+Z^2},$$

where $W^+$ denotes the virtual HOA coefficient, sign(*) denotes a function that outputs a sign (positive or negative) of an input, W' denotes the speech coded HOA coefficient 29' associated with the spherical basis function having the order of zero, X denotes the HOA coefficient 43 associated with a spherical basis function having an order of one and a sub-order of one, Y denotes the HOA coefficient 43 associated with a spherical basis function having an order of one and a sub-order of negative one, and Z denotes the HOA coefficient 43 associated with a spherical basis function having an order of one and a sub-order of zero.

The prediction unit 34 may obtain, based on the virtual HOA coefficient, one or more parameters from which to synthesize the one or more HOA coefficients associated with the spherical basis functions having the order greater than zero. The prediction unit 34 may implement a prediction model by which to predict the HOA coefficients 43 from the speech coded HOA coefficients 29'.

The parameters may include an angle, a vector, a point, a line, and/or a spatial component defining a width, direction, and shape (such as the so-called "V-vector" in the MPEG-H 3D Audio Coding Standard, formally entitled "Information technology—High efficiency coding and media delivery in heterogeneous environments—Part 3: 3D audio," set forth by ISO/IEC JTC 1/SC 29, with document identifier ISO/IEC DIS 23008-3, and dated Jul. 25, 2014). Generally, the techniques may be performed with respect to any type of parameters capable of indicating an energy position.

When the parameter is an angle, the parameter may specify an azimuth angle, an elevation angle, or both an azimuth angle and an elevation angle. In the example of the virtual HOA coefficient, the one or more parameters may include an azimuth angle denoted by theta (θ) and an elevation angle denoted by phi (ϕ), and the azimuth angle and the elevation angle may indicate an energy position on a surface of a sphere having a radius equal to $\sqrt{W^+}$. The parameters are shown in FIG. 3A as parameters 35. Based on parameters 35, the prediction unit 34 may generate synthesized HOA coefficients 43', which may correspond to the same spherical basis functions having the order greater than zero to which the HOA coefficients 43 correspond.

In some examples, the prediction unit 34 may obtain a plurality of parameters 35 from which to synthesize the HOA coefficients 43' associated with the one or more spherical basis functions having the order greater than zero. The plurality of parameters 35 may include, as one example, any of the foregoing noted types of parameters, but the prediction unit 34, in this example, may compute the parameters on a sub-frame basis.

Figure 5:
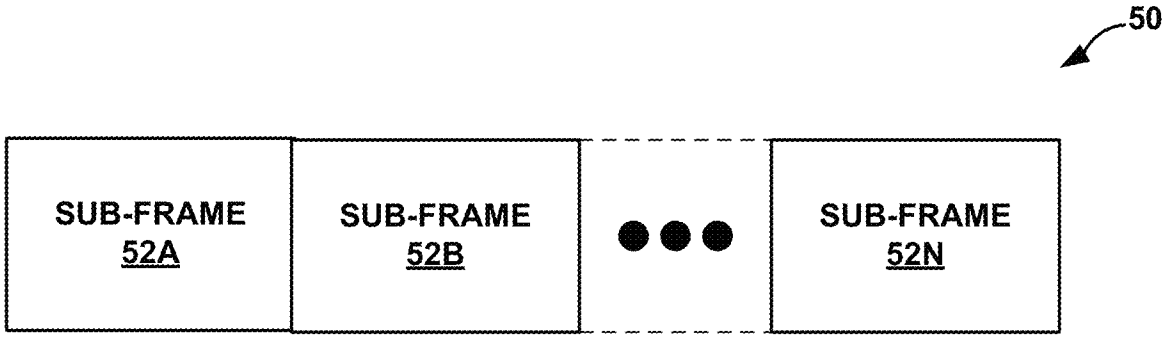
FIG. 5 is a diagram illustrating a frame that includes sub-frames.

FIG. 5 is a diagram illustrating a frame 50 that includes sub-frames 52A-52N ("sub-frames 52"). The sub-frames 52 may each be the same size (or, in other words, include the same number of samples) or different sizes. The frame 50 may include two or more sub-frames 52. The frame 50 may represent a set number of samples (e.g., 960 samples representative of 20 milliseconds of audio data) of the speech coded HOA coefficient 29' associated with the spherical basis function having the order of zero. In one example, the prediction unit 34 may divide the frame 50 into four sub-frames 52 of equal length (e.g., 240 samples representative of 5 milliseconds of audio data when the frame is 960 samples in length). The sub-frames 52 may represent one example of a portion of the frame 50.

Referring back to FIG. 3A, the prediction unit 34 may determine one of the plurality of parameters 35 for each of the sub-frames 52. When computing the parameters 35 on a frame basis, the parameters 35 may indicate an energy position within the frame 50 of the speech coded HOA coefficient 29' associated with the spherical basis function having the order of zero. When computing parameters 35 on a sub-frame basis, the parameters 35 may indicate the energy position within each of the sub-frames 52 (wherein in some examples there may be four sub-frames 52 as noted above) of the frame 50 of the speech coded HOA coefficient 29' associated with the spherical basis function having the order of zero. The prediction unit 34 may output the plurality of parameters 35 to the quantization unit 38.

The prediction unit 34 may output the synthesized HOA coefficients 43' to the summation unit 36. The summation unit 36 may compute a difference between the HOA coefficients 43 and the synthesized HOA coefficients 43', outputting the difference as prediction error 37 to the prediction unit 34 and the quantization unit 38. The prediction unit 34 may iteratively update the parameters 35 to minimize the resulting prediction error 37.

The foregoing process of iteratively obtaining the parameters 35, synthesizing the HOA coefficients 43', obtaining, based on the synthesized HOA coefficients 43' and the HOA coefficients 43, the prediction error 37 in an attempt to minimize the prediction error 37 may be referred to as a closed loop process. The prediction unit 34 shown in the example of FIG. 3A may in this respect obtain the parameters 34 using the closed loop process in which determination of the prediction error 37 is performed.

In other words, the prediction unit 34 may obtain the parameters 35 using the closed loop process, which may involve the following steps. First, the prediction unit 34 may synthesize, based on the parameters 35, the one or more HOA coefficients 43' associated with the one or more spherical basis functions having the order greater than zero. Next, the prediction unit 34 may obtain, based on the synthesized HOA coefficients 43' and the HOA coefficients 43, the prediction error 37. The prediction unit 34 may obtain, based on the prediction error 37, one or more updated parameters 35 from which to synthesize the one or more HOA coefficients 43' associated with the one or more spherical basis functions having the order greater than zero. The prediction unit 34 may iterate in this manner in an attempt to minimize or otherwise identify a local minimum of the prediction error 37. After minimizing the prediction error 37, the prediction unit 34 may indicate that the parameters 35 to the prediction error 37 are to be quantized by the quantization unit 38.

The quantization unit 38 may represent a unit configured to perform any form of quantization to compress the parameters 35 and the residual error 37 to generate coded parameters 45 and coded residual error 47. For example, the quantization unit 38 may perform vector quantization, scalar quantization without Huffman coding, scalar quantization with Huffman coding, or combinations of the foregoing to provide a few examples. The quantization unit 52 may also perform predicted versions of any of the foregoing types of quantization modes, where a difference is determined between the parameters 35 and/or the residual error 37 of previous frame and the parameters 35 and/or the residual error 37 of a current frame is determined. The quantization unit 52 may then quantize the difference. The process of determining the difference and quantizing the difference may be referred to as "delta coding."

When the quantization unit 38 receives the plurality of parameters 35 computed for sub-frames 52, the quantization unit 38 may obtain, based on the plurality of parameters 35, a statistical mode value indicative of a value of the plurality of parameters 35 that appears most often. That is, the quantization unit 34 may find the statistical mode value, in one example, from the four candidate parameters 35 determined for each of the four sub-frames 52. In statistics, the mode of a set of data values (i.e., the plurality of parameters 35 computed from the sub-frames 52 in this example) is the value that appears most often. The mode is the value x at which its probability mass function takes its maximum value. In other words, the mode is the value that is most likely to be sampled. The quantization unit 38 may perform delta-coding with respect to the statistical mode values for, as one example, the azimuth angle and the elevation angle to generate the coded parameters 45. The quantization unit 38 may output the coded parameters 45 and the coded prediction error 47 to the bitstream generation unit 40.

The bitstream generation unit 40 may represent a unit configured to generate the bitstream 21 based on the speech encoded HOA coefficients 31, the coded parameters 45, and the coded residual error 47. The bitstream generation unit 40 may generate the bitstream 21 to include a first indication representative of the speech encoded HOA coefficients 31 associated with the spherical basis function having the order of zero, and a second indication representative of the coded parameters 45. The bitstream generation unit 40 may further generate the bitstream 21 to include a third indication representative of the coded prediction error 47.

As such, the bitstream generation unit 40 may generate the bitstream 21 such that the bitstream 21 does not include the HOA coefficients 43 associated with the one or more spherical basis functions having the order greater than zero. In other words, the bitstream generation unit 40 may generate the bitstream 21 to include the one or more parameters in place of the one or more HOA coefficients 43 associated with the one or more spherical basis functions having the order greater than zero. That is, the bitstream generation unit 40 may generate the bitstream 21 to include the one or more parameters in place of the one or more HOA coefficients 43 associated with the one or more spherical basis functions having the order greater than zero, and such that the one or more parameters 45 are used to synthesize the one or more HOA coefficients 43 associated with the one or more spherical basis functions having the order greater than zero.

In this respect, the techniques may allow multi-channel speech audio data to be synthesized as the decoder, thereby improving the audio quality and overall experience in conducting telephone calls or other voice communications (such as Voice over Internet Protocol—VoIP—calls, video conferencing calls, conference calls, etc.). EVS for LTE only currently supports monoaural audio (or, in other words, single channel audio), but through use of the techniques set forth in this disclosure, EVS may be updated to add support for multi-channel audio data. The techniques moreover may update EVS to add support for multi-channel audio data without injecting much if any processing delay, while also transmitting exact spatial information (i.e., the coded parameters 45 in this example). The audio coding unit 20A may allow for scene-based audio data, such as the HOA coefficients 11, to be efficiently represented in the bitstream 21 in a manner that does not inject any delay, while also allowing for synthesis of multi-channel audio data at the audio decoding unit 24.

Figure 3B:
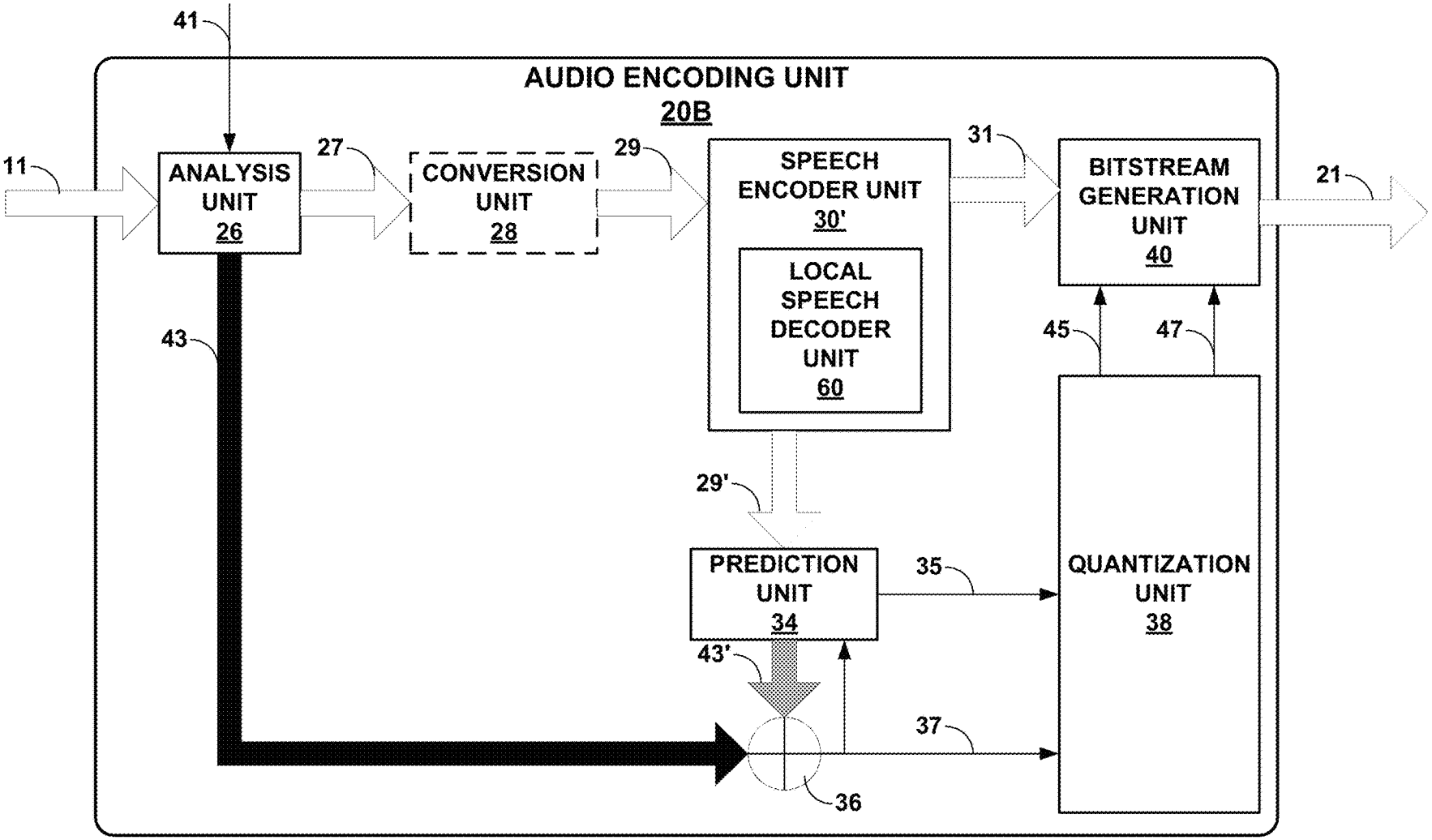

FIG. 3B is a block diagram illustrating, in more detail, another example of the audio encoding unit 20 shown in the example of FIG. 2 that may perform various aspects of the techniques described in this disclosure. The audio encoding unit 20B of FIG. 3B may represent another example of the audio encoding unit 20 shown in the example of FIG. 2. Further, the audio encoding unit 20B may be similar to the audio encoding unit 20A in that the audio encoding unit 20B includes many components similar to that of audio encoding unit 20A of FIG. 3A.

However, the audio encoding unit 20B differs from the audio encoding unit 20A in that the audio encoding unit 20B includes a speech encoder unit 30' that includes a local speech decoder unit 60 in place of the speech decoder unit 32 of the audio encoding unit 20A. The speech encoder unit 30' may include the local decoder unit 60 as certain operations of speech encoding (such as prediction operations) may require speech encoding and then speech decoding of the converted HOA coefficients 29. The speech encoder unit 30' may perform speech encoding similar to that described above with respect to the speech encoder unit 30 of the audio encoding unit 20A to generate the speech encoded HOA coefficients 31.

The local speech decoder unit 60 may then perform speech decoding similar to that described above with respect to the speech decoder unit 32. The local speech decoder unit 60 may perform the speech decoding with respect to the speech encoded HOA coefficients 31 to obtain the speech coded HOA coefficients 29'. The speech encoder unit 30' may output the speech coded HOA coefficients 29' to the prediction unit 34, where the process may proceed in a similar, if not substantially similar, manner to that described above with respect to the audio encoding unit 20A.

Figure 3C:
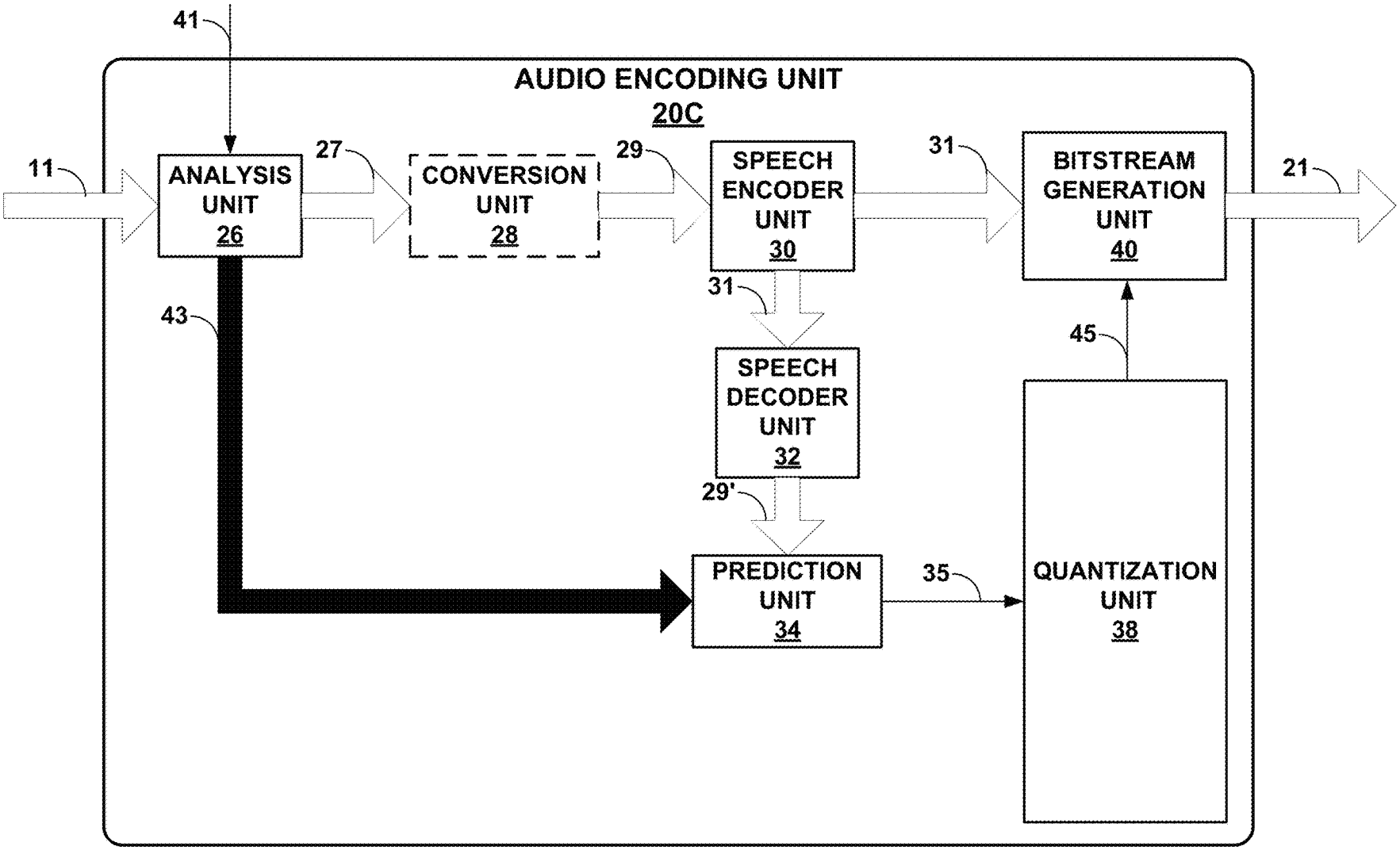

FIG. 3C is a block diagram illustrating, in more detail, another example of the audio encoding unit 20 shown in the example of FIG. 2 that may perform various aspects of the techniques described in this disclosure. The audio encoding unit 20C of FIG. 3C may represent another example of the audio encoding unit 20 shown in the example of FIG. 2. Further, the audio encoding unit 20B may be similar to the audio encoding unit 20A in that the audio encoding unit 20B includes many components similar to that of audio encoding unit 20A of FIG. 3A.

However, the audio encoding unit 20B differs from the audio encoding unit 20A in that the audio encoding unit 20B includes a prediction unit 34 that does not perform the closed loop process. Instead, the prediction unit 34 performs an open loop process to directly obtain, based on the parameters 35, the synthesized HOA coefficients 43' (where the term "directly" may refer to the aspect of the open loop process in which the parameters are obtained without iterating to minimize the prediction error 37). The open loop process differs from the closed loop process in that the open loop process does not include a determination of the prediction error 37. As such, the audio encoding unit 20C may not include a summation unit 36 by which to determine the prediction error 37 (or the audio encoding unit 20C may disable the summation unit 36).

The quantization unit 38 only receives the parameters 35, and outputs the coded parameters 45 to the bitstream generation unit 40. The bitstream generation unit 40 may generate the bitstream 21 to include the first indication representative of the speech encoded HOA coefficients 31, and the second indication representative of the coded parameters 45. The bitstream generation unit 40 may generate the bitstream 21 so as not to include any indications representative of the prediction error 37.

Figure 3D:
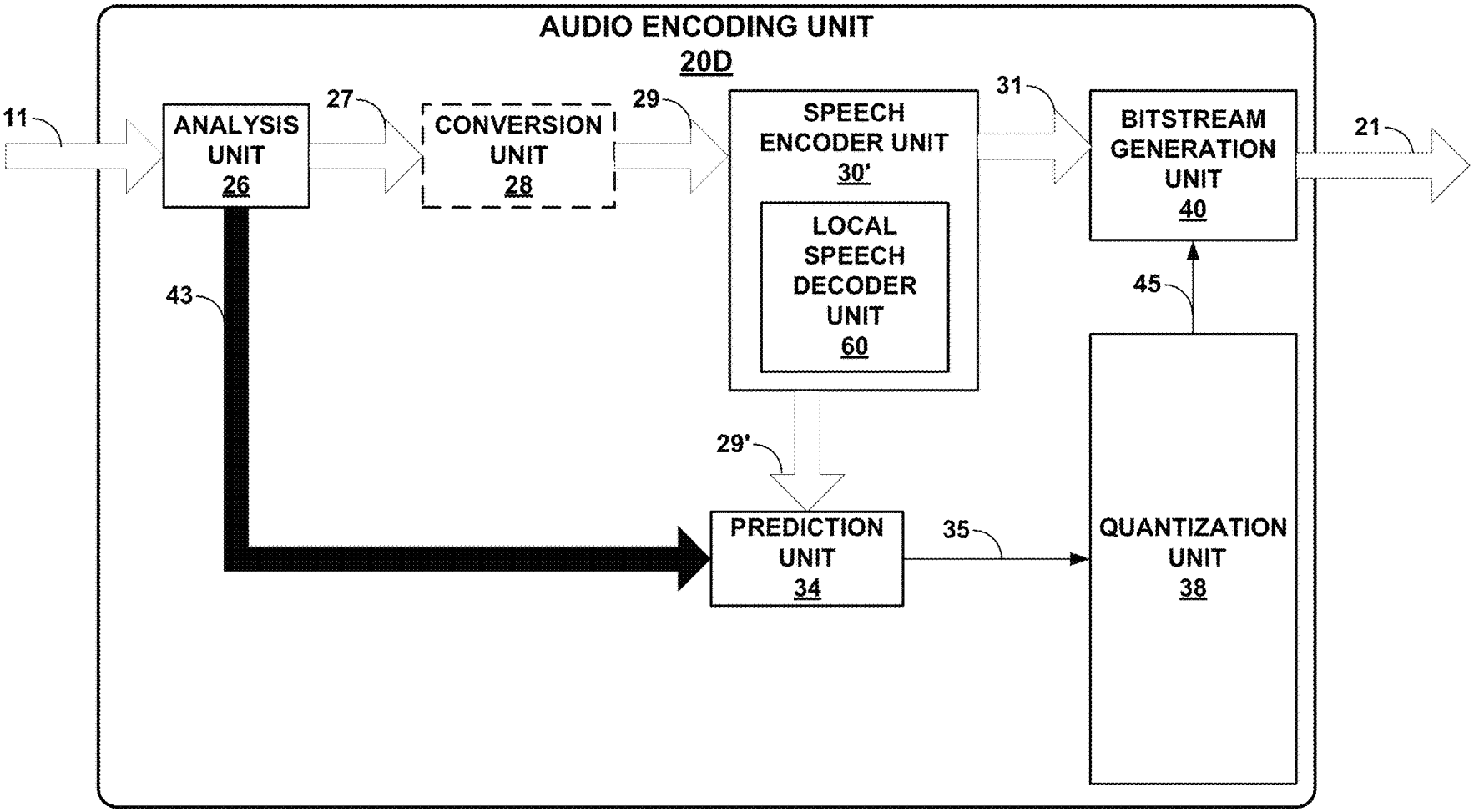

FIG. 3D is a block diagram illustrating, in more detail, another example of the audio encoding unit 20 shown in the example of FIG. 2 that may perform various aspects of the techniques described in this disclosure. The audio encoding unit 20D of FIG. 3D may represent another example of the audio encoding unit 20 shown in the example of FIG. 2. Further, the audio encoding unit 20D may be similar to the audio encoding unit 20C in that the audio encoding unit 20D includes many components similar to that of audio encoding unit 20C of FIG. 3C.

However, the audio encoding unit 20D differs from the audio encoding unit 20C in that the audio encoding unit 20D includes a speech encoder unit 30' that includes a local speech decoder unit 60 in place of the speech decoder unit 32 of the audio encoding unit 20C. The speech encoder unit 30' may include the local decoder unit 60 as certain operations of speech encoding (such as prediction operations) may require speech encoding and then speech decoding of the converted HOA coefficients 29. The speech encoder unit 30' may perform speech encoding similar to that described above with respect to the speech encoder unit 30 of the audio encoding unit 20A to generate the speech encoded HOA coefficients 31.

The local speech decoder unit 60 may then perform speech decoding similar to that described above with respect to the speech decoder unit 32. The local speech decoder unit 60 may perform the speech decoding with respect to the speech encoded HOA coefficients 31 to obtain the speech coded HOA coefficients 29'. The speech encoder unit 30' may output the speech coded HOA coefficients 29' to the prediction unit 34, where the process may proceed in a similar, if not substantially similar, manner to that described above with respect to the audio encoding unit 20C, including the open loop prediction process by which to obtain the parameters 35.

Figure 14:
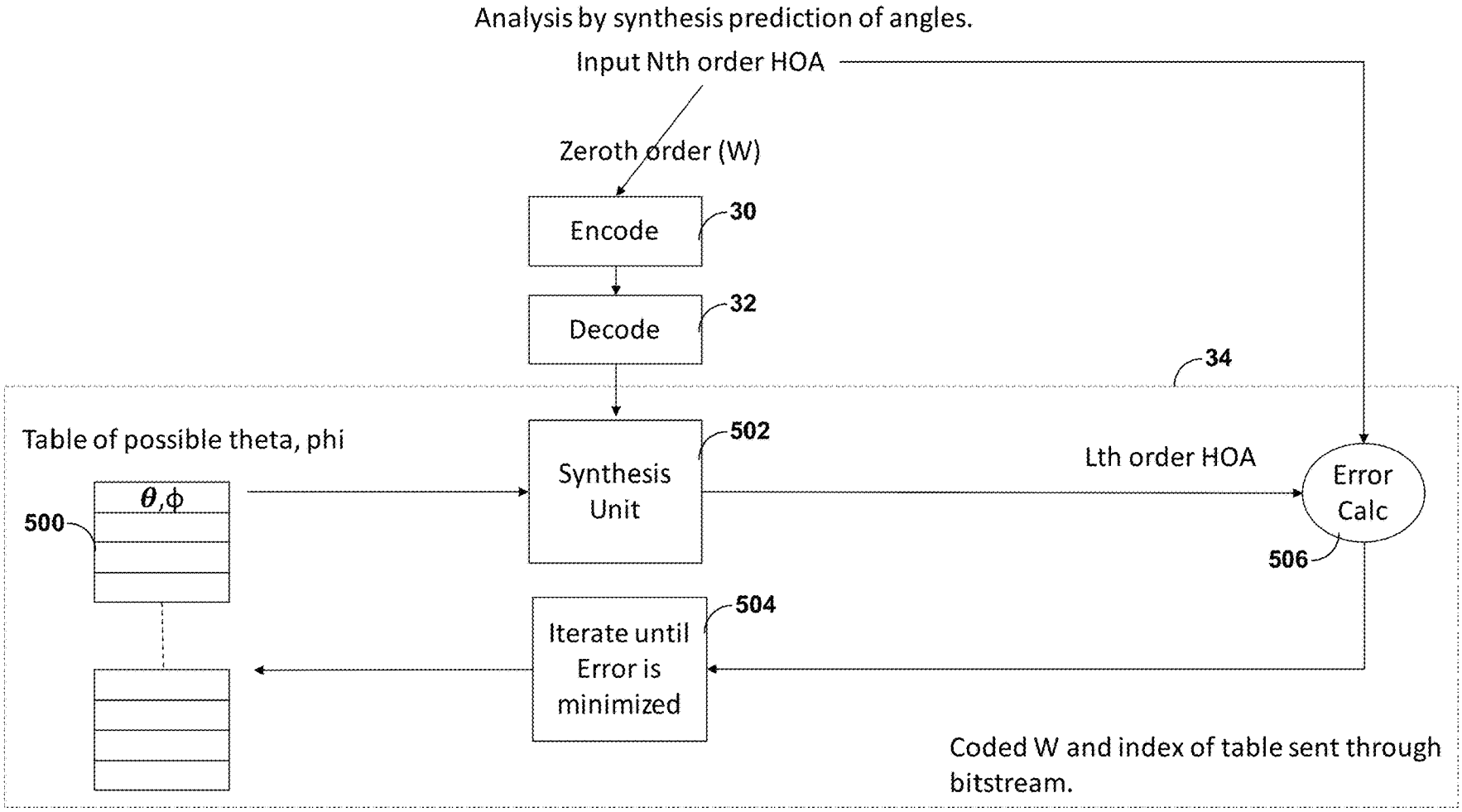
FIG. 14 is a block diagram illustrating one example of the prediction unit of FIGS. 3A-3D in more detail.

FIG. 14 is a block diagram illustrating one example of the prediction unit of FIGS. 3A-3D in more detail. In the example of FIG. 14, the prediction unit 34 includes an angle table 500, a synthesis unit 502, an iteration unit 504 (shown as "iterate until error is minimized"), and an error calculation unit 406 (shown as "error calc"). The angle table 500 represents a data structure (including a table, but may include other types of data structures, such as linked lists, graphs, trees, etc.) configured to store a list of azimuth angles and elevation angles.

The synthesis unit 502 may represent a unit configured to parameterize higher order ambisonic coefficients associated with the spherical basis function having an order greater than zero based on the higher order ambisonic coefficients associated with the spherical basis function having an order of zero. The synthesis unit 502 may reconstruct the higher order ambisonic coefficients associated with the spherical basis function having the order greater than zero based on each set of azimuth and elevation angles to the error calculation unit 506.

The iteration unit 504 may represent a unit configured to interface with the angle table 500 to select or otherwise iterate through entries of the table based on an error output by the error calculation unit 506. In some examples, the iteration unit 504 may iterate through each and every entry to the angle table 500. In other examples, the iteration unit 504 may select entries of the angle table 500 that are statistically more likely to result in a lower error. In other words, the iteration unit 504 may sample different entries from the angle table 500, where the entries in the angle table 500 are sorted in some fashion such that the iteration unit 504 may determine another entry of the angle table 500 that is statistically more likely to result in a reduced error. The iteration unit 504 may perform the second example involving the statistically more likely selection to reduce processing cycles (and memory as well as bandwidth—both memory and bus bandwidth) expended per parameterization of the higher order ambisonic coefficients associated with the spherical basis function having the order greater than zero.

The iteration unit 504 may, in both examples, interface with the angle table 500 to pass the selected entry to the synthesis unit 502, which may repeat the above described operations to reconstruct the higher order ambisonic coefficients associated with the spherical basis function having the order greater than zero to the error calculation unit 506. The error calculation unit 506 may compare the original higher order ambisonic coefficients associated with the spherical basis function having the order greater than zero to the reconstructed higher order ambisonic coefficients associated with spherical basis functions having the order greater than zero to obtain the above noted error per selected set of angles from the angle table 500. In this respect, the prediction unit 304 may perform analysis-by-synthesis to parameterize the higher order ambisonic coefficients associated with the spherical basis functions having the order greater than zero based on the higher order ambisonic coefficients associated with the spherical basis function having the order of zero.

Figure 15A:
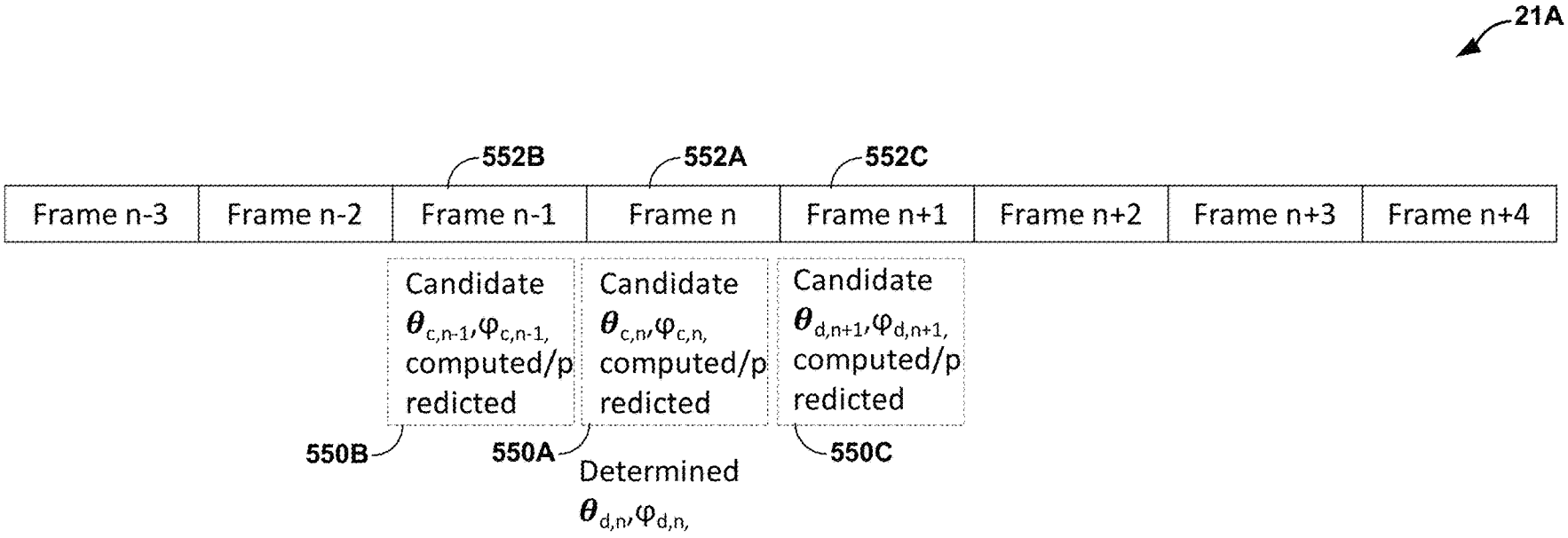
FIGS. 15A and 15B are block diagrams illustrating other examples of the bitstream that includes frames including parameters synthesized by the prediction unit of FIGS. 3A-3D.
Figure 15B:
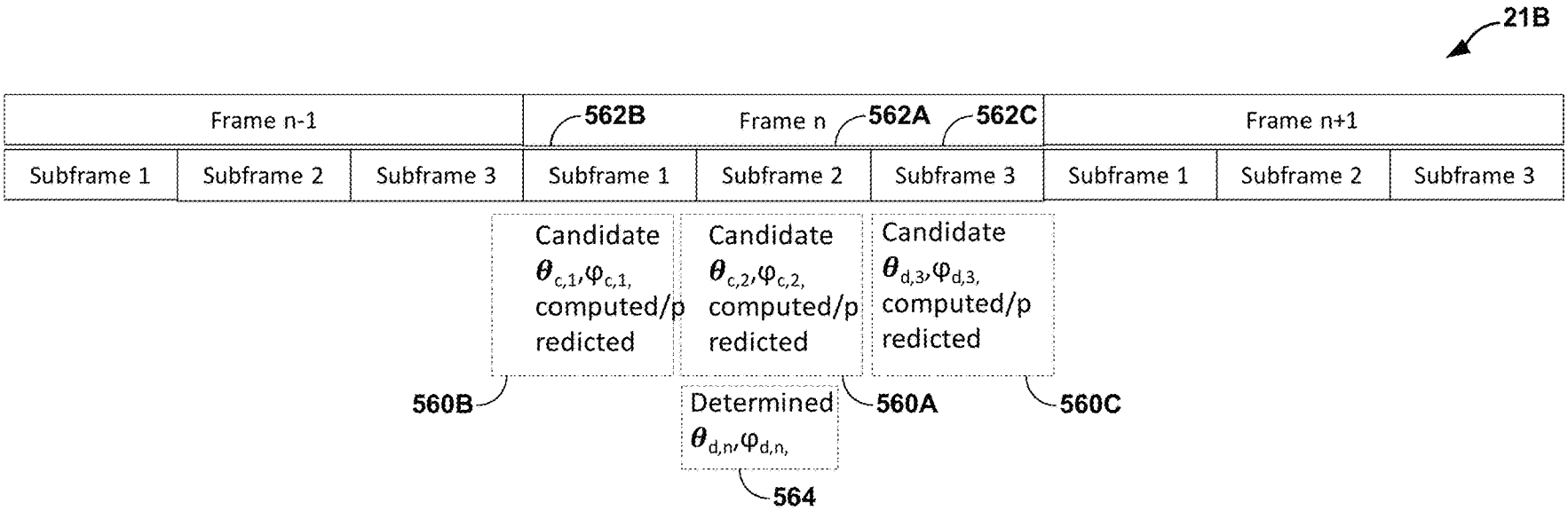

FIGS. 15A and 15B is a block diagram illustrating another example of the bitstream that includes frames including parameters synthesized by the prediction unit of FIGS. 3A-3D. Referring first to the example of FIG. 15A, the prediction unit 34 may obtain parameters 554 for the frame 552A in the manner described above, e.g., by a statistical analysis of candidate parameters 550A-550C in the neighboring frames 552B and 552C and the current frame 562A. The prediction unit 34 may perform any type of statistical analysis, such as computing a mean of the parameters 550A-550C, a statistical mode value of the parameters 550A-550C, and/or a median of the parameters 550A-550C, to obtain the parameters 554.

The prediction unit 34 may provide the parameters 554 to the quantization unit 38, which provided the quantized parameters to the bitstream generation unit 40. The bitstream generation unit 40 may then specify the quantized parameters in the bitstream 21A (which is one example of the bitstream 21) with the associated frame (e.g., the frame 552A in the example of FIG. 15A).

Referring next to the example of FIG. 15B, the bitstream 21B (which is another example of the bitstream 21) is similar to the bitstream 21A, except that the prediction unit 34 performs the statistical analysis to identify candidate parameters 560A-560C for subframes 562A-562C rather than for whole frames to obtain parameters 564 for subframe 562A. The prediction unit 34 may provide the parameters 564 to the quantization unit 38, which provided the quantized parameters to the bitstream generation unit 40. The bitstream generation unit 40 may then specify the quantized parameters in the bitstream 21B with the associated subframe (e.g., the frame 562A in the example of FIG. 15A).

Figure 4A:
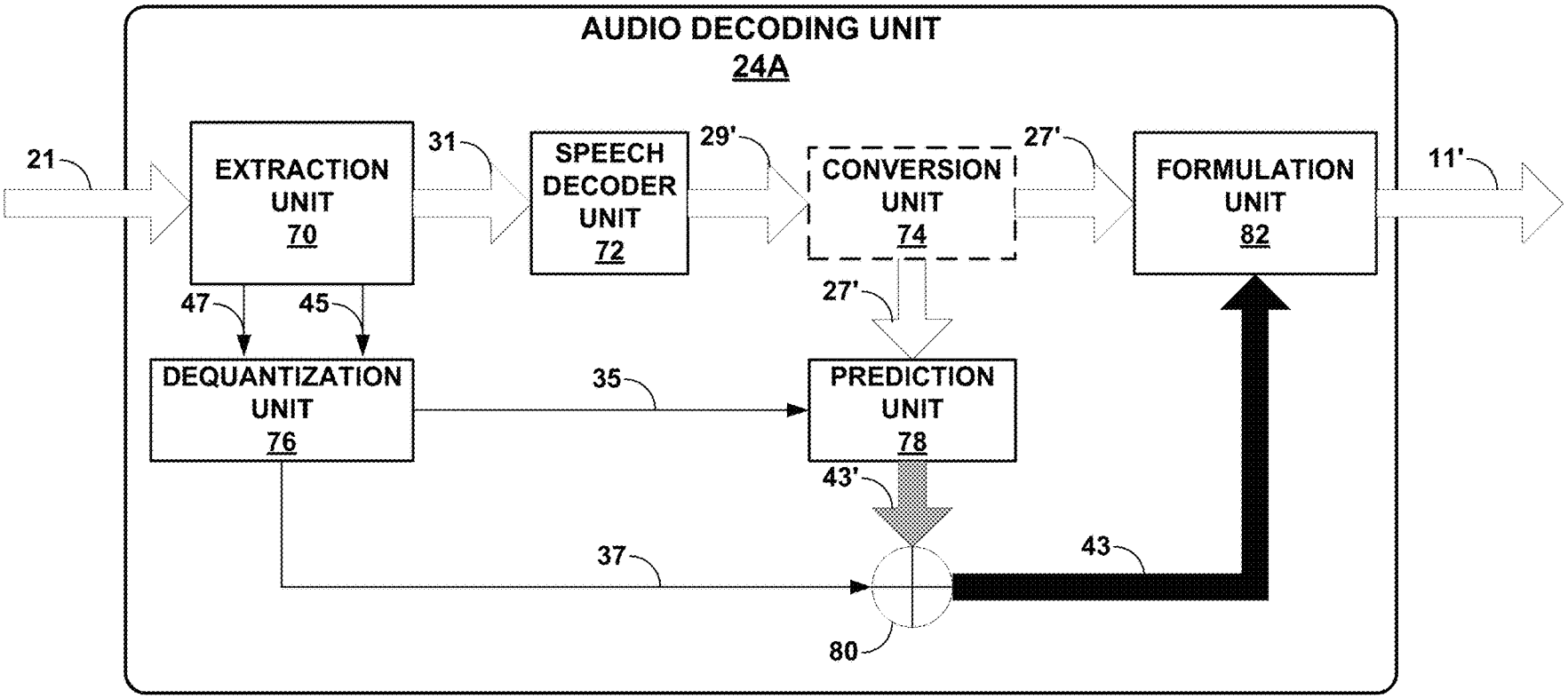
FIGS. 4A-4D are block diagrams each illustrating an example of the audio decoding device of FIG. 2 in more detail.

FIGS. 4A-4D are block diagrams each illustrating an example of the audio decoding unit 24 of FIG. 2 in more detail. Referring first the example shown in FIG. 4A, the audio decoding unit 24A may represent a first example of the audio decoding unit 24 of FIG. 2. As shown in the example of FIG. 4A, the audio decoding unit 24 may include an extraction unit 70, a speech decoder unit 70, a conversion unit 74, a dequantization unit 76, a prediction unit 78, a summation unit 80, and a formulation unit 82.

The extraction unit 70 may represent a unit configured to receive the bitstream 21 and extract the first indication representative of the speech encoded HOA coefficients 31, the second indication representative of the coded parameters 45, and the third indication representative of the coded prediction error 47. The extraction unit 70 may output the speech encoded HOA coefficients 31 to the speech decoder unit 72, and the coded parameters 45 and the coded prediction error 47 to the dequantization unit 76.

The speech decoder unit 72 may operate in substantially the same manner as the speech decoder unit 32 or the local speech decoder unit 60 described above with respect to FIGS. 3A-3D. The speech decoder unit 72 may perform the speech decoding with respect to the speech encoded HOA coefficients 31 to obtain the speech coded HOA coefficients 29'. The speech decoder unit 72 may output the speech coded HOA coefficients 29' to the conversion unit 74.

The conversion unit 74 may represent a unit configured to perform a reciprocal conversion to that performed by the conversion unit 28. The conversion unit 74, like the conversion unit 28, may be configured to perform the conversion or disabled (or possibly removed from the audio decoding unit 24A) such that no conversion is performed. The conversion unit 74, when enabled, may perform the conversion with respect to the speech coded HOA coefficients 29' to obtain the HOA coefficients 27'. The conversion unit 74, when disabled, may output the speech coded HOA coefficients 29' as the HOA coefficients 27' without performing any processing or other operations (with the exception of passive operations that impact the values of the speech coded HOA coefficients, such as buffering, signal strengthening, etc.). The conversion unit 74 may output the HOA coefficients 27' to the formulation unit 82 and to the prediction unit 78.

The dequantization unit 76 may represent a unit configured to perform dequantization in a manner reciprocal to the quantization performed by the quantization unit 38 described above with respect to the examples of FIGS. 3A-3D. The dequantization unit 76 may perform inverse scalar quantization, inverse vector quantization, or combinations of the foregoing, including inverse predictive versions thereof (which may also be referred to as "inverse delta coding"). The dequantization unit 76 may perform the dequantization with respect to the coded parameters 45 to obtain the parameters 35, outputting the parameters 35 to the prediction unit 78. The dequantization unit 76 may also perform the dequantization with respect to the coded prediction error 47 to obtain the prediction error 37, outputting the prediction error 37 to the summation unit 80.

The prediction unit 78 may represent unit configured to synthesize the HOA coefficients 43' in a manner substantially similar to the prediction unit 34 described above with respect to the examples of FIGS. 3A-3D. The prediction unit 78 may synthesize, based on the parameters 35 and the HOA coefficients 27', the HOA coefficients 43'. The prediction unit 78 may output the synthesized HOA coefficients 43' to the summation unit 80.

The summation unit 80 may represent a unit configured to obtain, based on the prediction error 37 and the synthesized HOA coefficients 43', the HOA coefficients 43. In this example, the summation unit 80 may obtain the HOA coefficients 43 by, at least in part, adding the prediction error 37 to the synthesized HOA coefficients 43'. The summation unit 80 may output the HOA coefficients 43 to the formulation unit 82.

The formulation unit 82 may represent a unit configured to formulate, based on the speech coded HOA coefficients 27' and the HOA coefficients 43, the HOA coefficients 11'. The formulation unit 82 may format the speech coded HOA coefficients 27' and the HOA coefficients 43 in one of the many ambisonic formats that specify an ordering of coefficients according to orders and sub-orders (where example formats are discussed at length in the above noted MPEG 3D Audio coding standard). The formulation unit 82 may output the reconstructed HOA coefficients 11' for rendering, storage, and/or other operations.

Figure 4B:
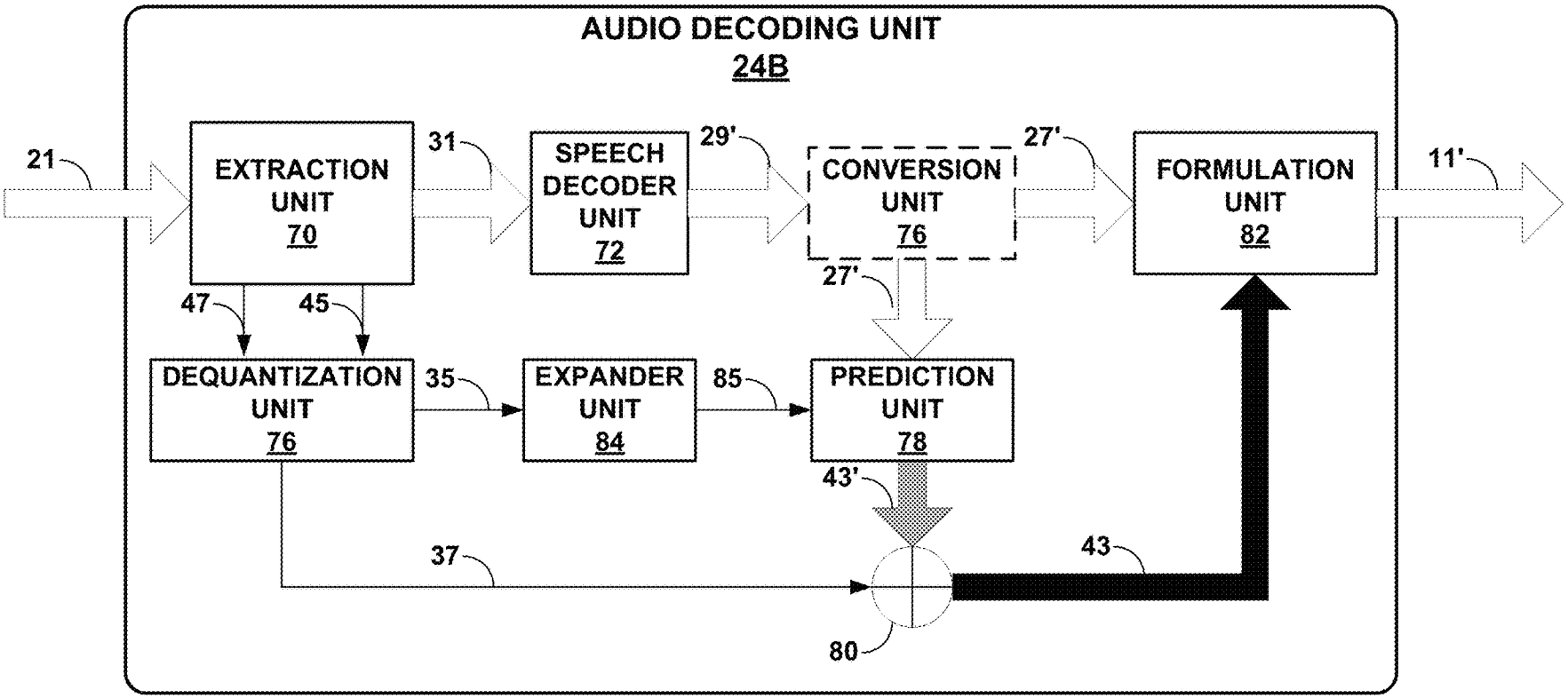

FIG. 4B is a block diagram illustrating, in more detail, another example of the audio decoding unit 24 shown in the example of FIG. 2 that may perform various aspects of the techniques described in this disclosure. The audio decoding unit 24B of FIG. 4B may represent another example of the audio decoding unit 24 shown in the example of FIG. 2. Further, the audio encoding unit 24B may be similar to the audio decoding unit 24A in that the audio decoding unit 24B includes many components similar to that of audio decoding unit 24A of FIG. 4A.

However, the audio decoding unit 24B may include an addition unit shown as an expander unit 84. The expander unit 84 may represent a unit configured to perform parameter expansion with respect to the parameters 35 to obtain one or more expanded parameters 85. The expanded parameters 85 may include more parameters than the parameters 35, hence the term "expanded parameters." The term "expanded parameters" refers to a numerical expansion in the number of parameters, and not expansion in the term of increasing or expanding the actual values of the parameters themselves.

To increase the number of parameters 35 and thereby obtain the expanded parameters 85, the expander unit 84 may perform an interpolation with respect the parameters 35. The interpolation may, in some examples, include a linear interpolation. In other examples, the interpolation may include non-linear interpolations.

In some examples, the bitstream 21 may specify an indication of a first coded parameter 45 in a first frame and an indication of a second parameter 45 in a second frame, which through the processes described above with respect to FIG. 4B may result in a first parameter 35 from the first frame and a second parameter 35 from the second frame. The expander unit 84 may perform a linear interpolation with respect to the first parameter 35 and the second parameter 35 to obtain the one or more expanded parameters 85. In some instances, the first frame may occur temporally directly before the second frame. The expander unit 84 may perform the linear interpolation to obtain an expanded parameter of the expanded parameters 85 for each sample in the second frame. As such, the expanded parameters 85 are the same type as that of the parameters 35 discussed above.

Such linear interpolation between temporally adjacent frames may allow the audio decoding unit 24B to smooth audio playback and avoid artifacts introduced by the arbitrary frame length and encoding of the audio data to frames. The linear interpolation may smooth each sample by adapting the parameters 35 to overcome large changes between each of the parameters 35, resulting in smoother (in terms of the change of values from one parameter to the next) expanded parameters 85. Using the expanded parameters 85, the prediction unit 78 may lessen the impact of the possibly large value difference between adjacent parameters 35 (referring to parameters 35 from different temporally adjacent frames), resulting a possibly less noticeable audio artifacts during playback, while also accommodating prediction of the HOA coefficients 43' using a single set of parameters 35.

The foregoing interpolation may be applied when the statistical mode values are sent for each frame instead of the plurality of parameters 35 determined for each of the subframes of each frame. The statistical mode value may be indicative, as discussed above, of a value of the one or more parameters that appears more frequently than other values of the one or more parameters. The expander unit 84 may perform the interpolation to smooth the value changes between statistical mode values sent for temporally adjacent frames.

Figure 4C:
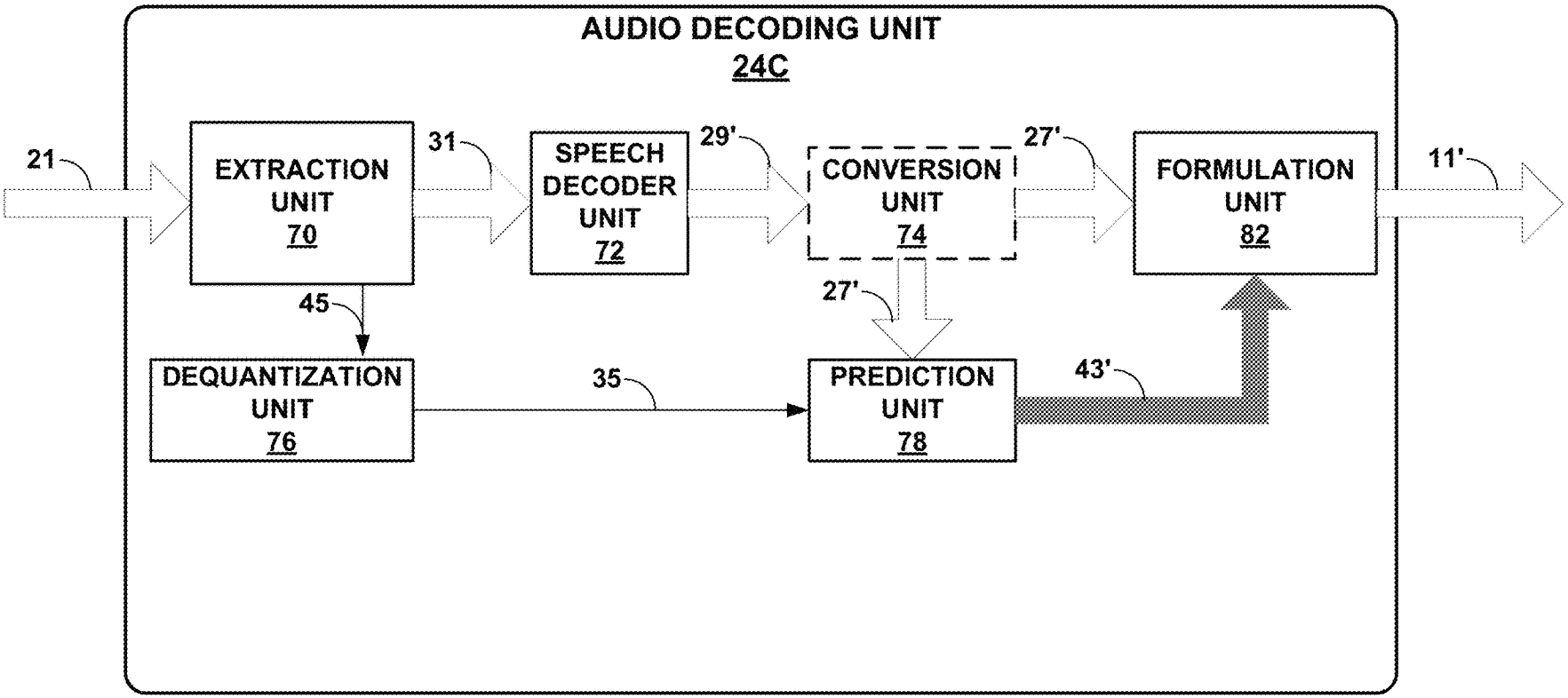

FIG. 4C is a block diagram illustrating, in more detail, another example of the audio decoding unit 24 shown in the example of FIG. 2 that may perform various aspects of the techniques described in this disclosure. The audio decoding unit 24C of FIG. 4C may represent another example of the audio decoding unit 24 shown in the example of FIG. 2. Further, the audio decoding unit 24C may be similar to the audio decoding unit 24A in that the audio decoding unit 24C includes many components similar to that of audio decoding unit 24A of FIG. 4A.

The audio decoding unit 24A performed the closed-loop decoding of the bitstream 21 to obtain the HOA coefficients 11', which involves addition of the prediction error 37 to the synthesized HOA coefficients 43' to obtain the HOA coefficients 43. However, the audio decoding unit 24C may represent an example of an audio decoding unit 24C configured to perform the open loop process in which the audio decoding unit 24C directly obtains, based on the parameters 35 and the converted HOA coefficients 27', the synthesized HOA coefficients 43' and proceeds with the synthesized HOA coefficients 43' in place of the HOA coefficients 43 without any reference to the prediction error 37.

Figure 4D:
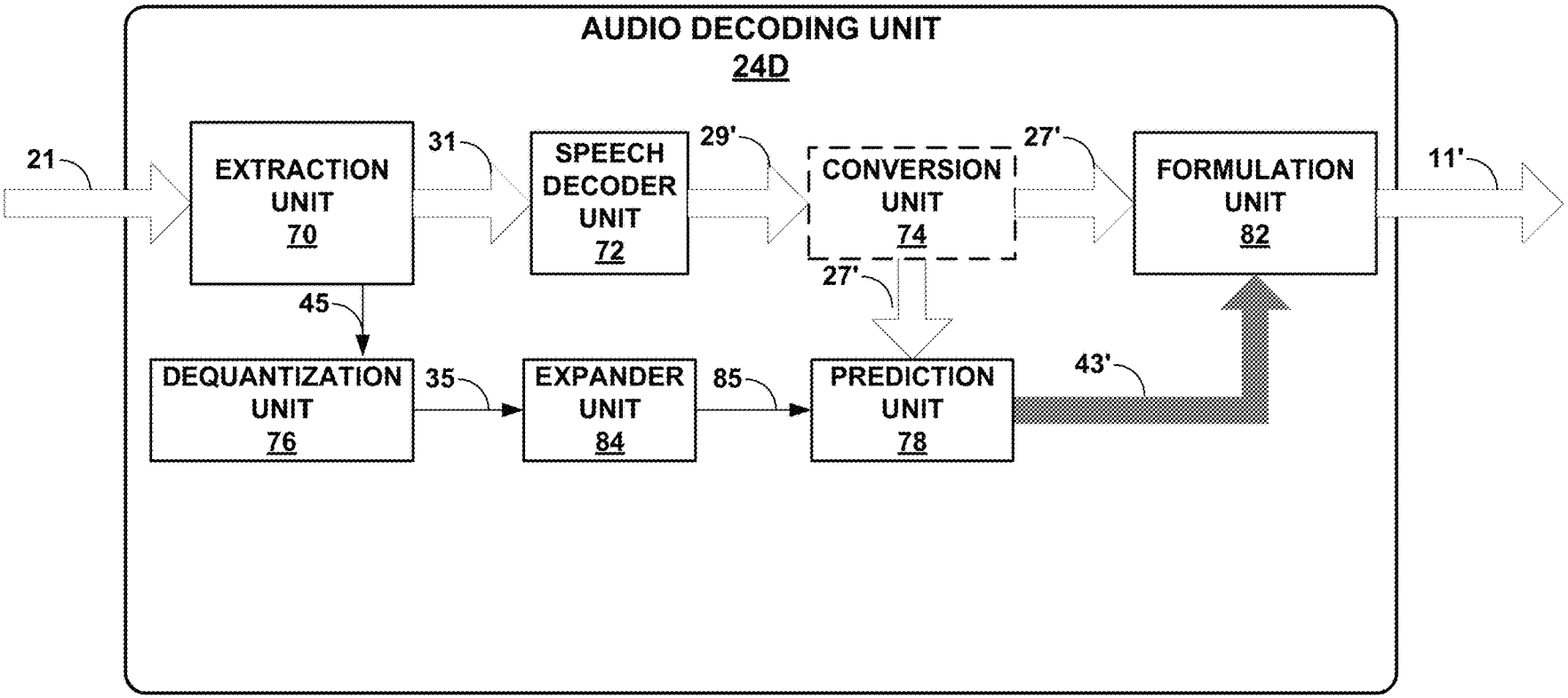

FIG. 4D is a block diagram illustrating, in more detail, another example of the audio decoding unit 24 shown in the example of FIG. 2 that may perform various aspects of the techniques described in this disclosure. The audio decoding unit 24D of FIG. 4D may represent another example of the audio decoding unit 24 shown in the example of FIG. 2. Further, the audio decoding unit 24D may be similar to the audio decoding unit 24B in that the audio decoding unit 24C includes many components similar to that of audio decoding unit 24B of FIG. 4B.

The audio decoding unit 24B performed the closed-loop decoding of the bitstream 21 to obtain the HOA coefficients 11', which involves addition of the prediction error 37 to the synthesized HOA coefficients 43' to obtain the HOA coefficients 43. However, the audio decoding unit 24D may represent an example of an audio decoding unit 24 configured to perform the open loop process in which the audio decoding unit 24D directly obtains, based on the parameters 35 and the converted HOA coefficients 27', the synthesized HOA coefficients 43' and proceeds with the synthesized HOA coefficients 43' in place of the HOA coefficients 43 without any reference to the prediction error 37.

Figure 6:
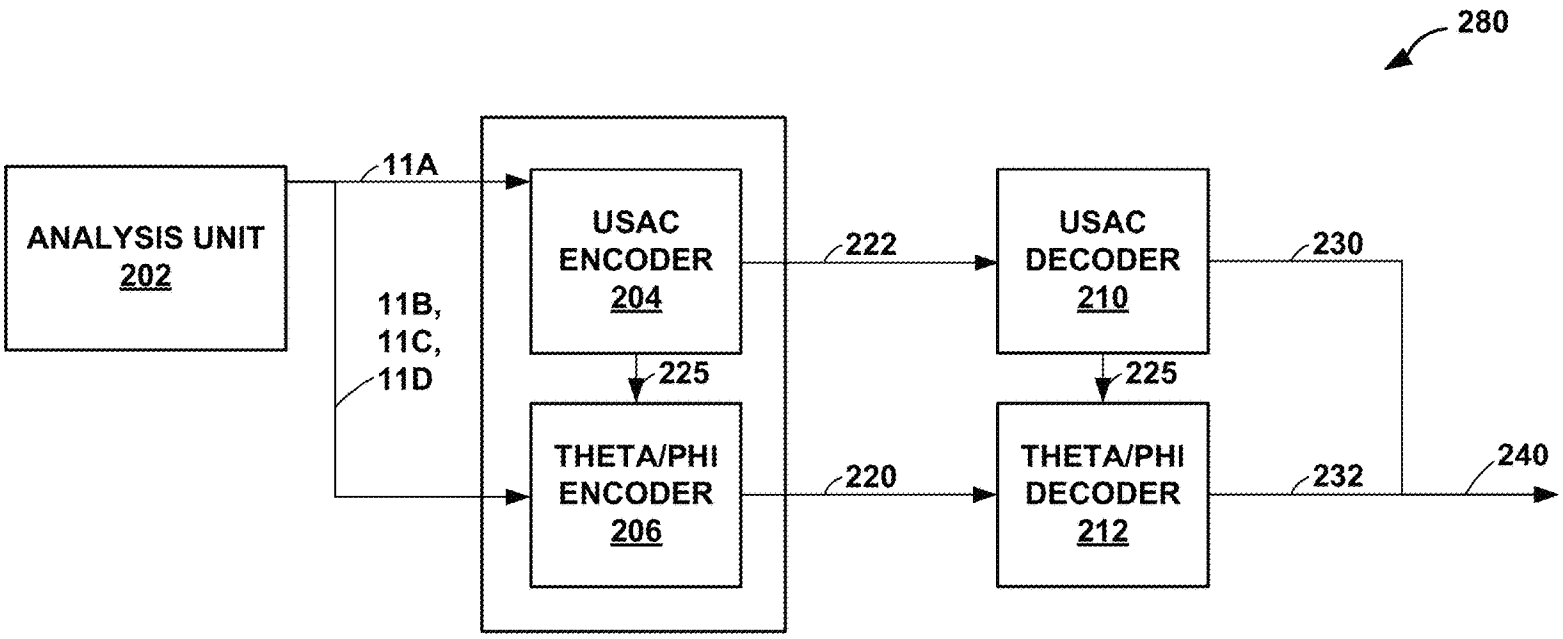
FIG. 6 is a block diagram illustrating example components for performing techniques according to this disclosure.

FIG. 6 is a block diagram illustrating example components for performing techniques according to this disclosure. Block diagram 280 illustrates example modules and signals for determining, encoding, transmitting, and decoding spatial information for directional components of SHC coefficients according to techniques described herein. The analysis unit 206 may determine HOA coefficients 11A-11D (the W, X, Y, Z channels). In examples, HOA coefficients 11A-11D include a 4-ch signal.

The Unified Speech and Audio Coding (USAC) encoder 204 determines the W' signal 225 and provides W' signal 225 to theta/phi encoder 206 for determining and encoding spatial relation information 220. USAC encoder 204 sends the W' signal 22 to USAC decoder 210 as encoded W' signal 222. USAC encoder and the spatial relation encoder 206 ("Theta/phi encoder 206") may be example components of theta/phi coder unit 294 of FIG. 3B.

The USAC decoder 210 and theta/phi decoder 212 may determine quantized HOA coefficients 47A'-47D' (the W, X, Y, Z channels), based on the received encoded spatial relation information 222 and encoded W' signal 222. Quantized W' signal (HOA coefficients 11A) 230, quantized HOA coefficients 11B-11D, and multichannel HOA coefficients 234 together make up quantized HOA coefficients 240 for rendering.

Figure 7:
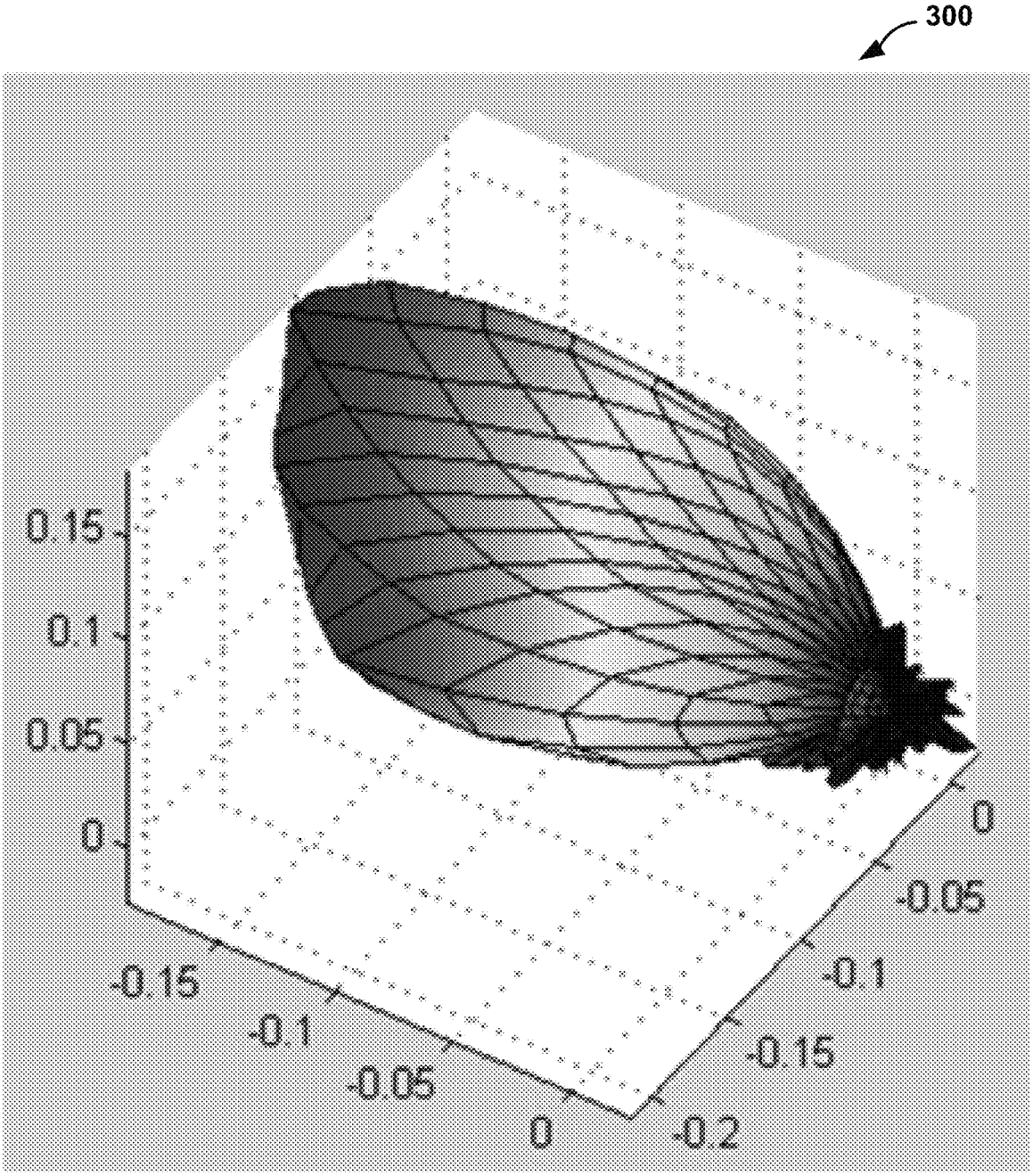
FIGS. 7 and 8 depict visualizations for example W, X, Y, and Z signal input spectrograms and spatial information generated according to techniques described in this disclosure.
Figure 8:
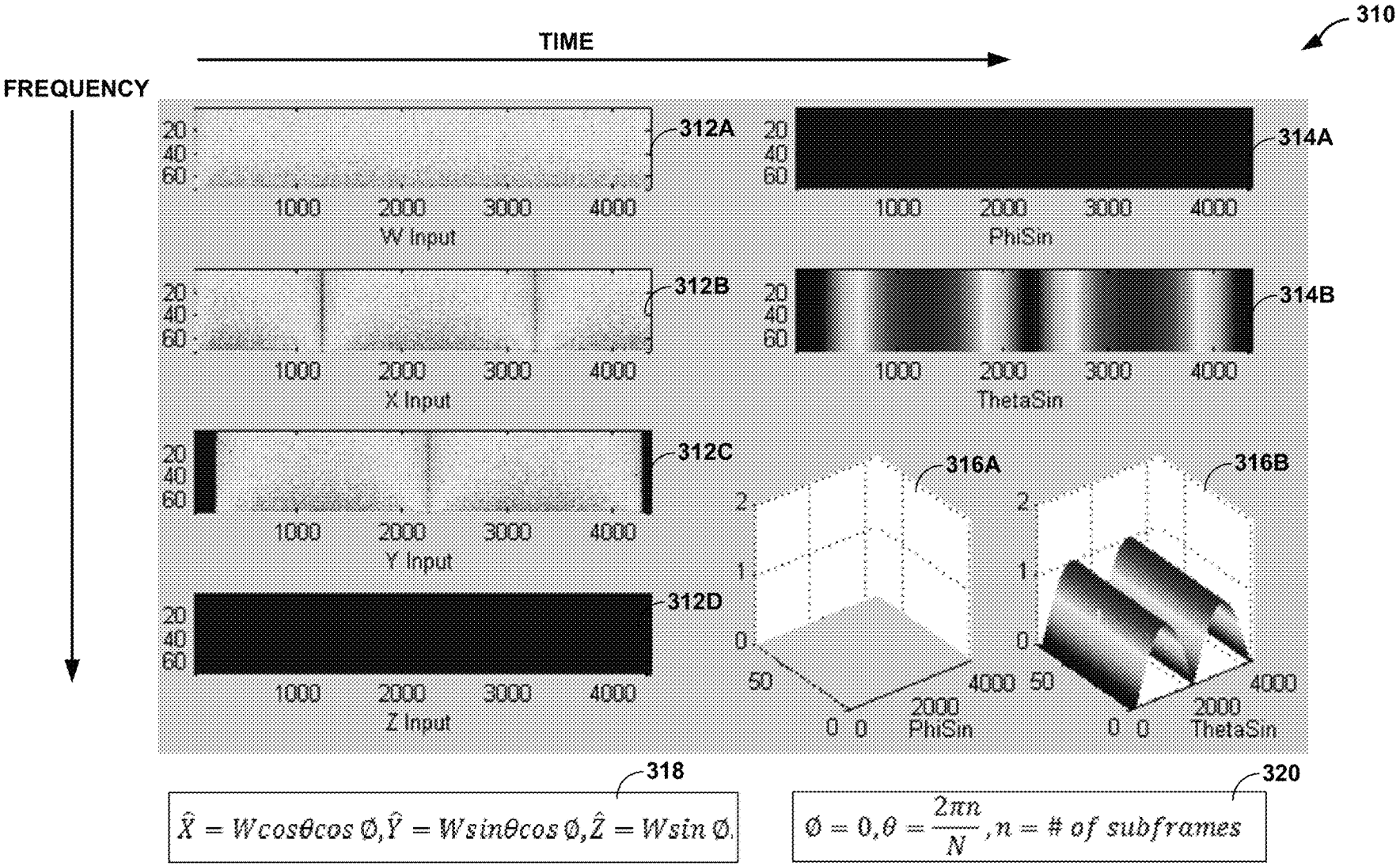

FIGS. 7 and 8 depict visualizations for example W, X, Y, and Z signal input spectrograms and spatial information generated according to techniques described in this disclosure. Example signals 312A-312D are generated according spatial information generated by equations 320 for multiple time and frequency bins, with signals 312A-312D generated using equations set forth in the above referenced U.S. patent application Ser. No. 14/712,733. Maps 314A, 316A depict sin φ for equations 320 in 2 and 3 dimensions, respectively; while maps 314B, 316B depict sin θ for equations 320 in 2 and 3 dimensions, respectively.

Figure 9:
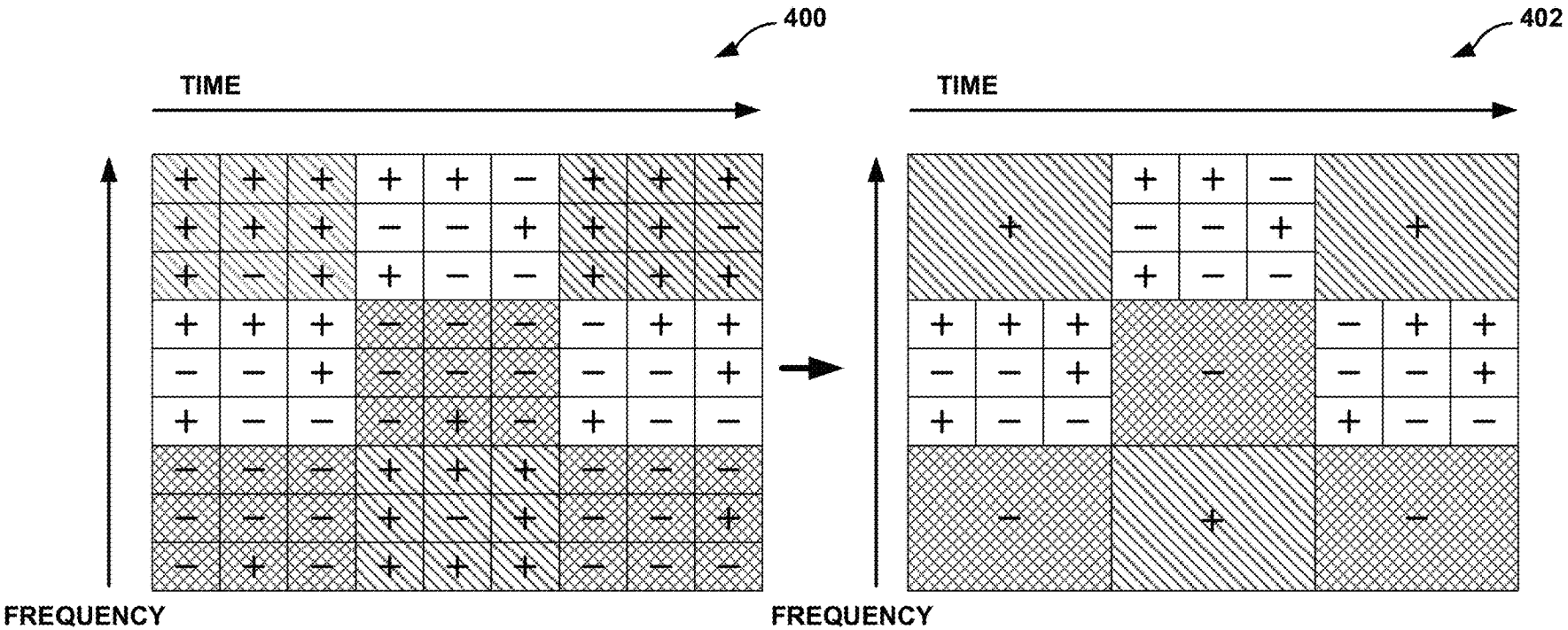
FIG. 9 is a conceptual diagram illustrating theta/phi encoding and decoding with the sign information aspects of the techniques described in this disclosure.

FIG. 9 is a conceptual diagram illustrating theta/phi encoding and decoding with the sign information aspects of the techniques described in this disclosure. In the example of FIG. 9, the theta/phi encoding unit 294 of the audio encoding unit 20 shown in the example of FIG. 3B, e.g., may estimate the theta and phi in accordance with equations (A-1)-(A-6) set forth in the above referenced U.S. patent application Ser. No. 14/712,733 and synthesize the signals according to the following equations:

$$\sin\theta_i = \frac{\sum_{k=B(i)}^{B(i+1)} W_k Y_k}{\sqrt{\left(\sum_{k=B(i)}^{B(i+1)} W_k X_k\right)^2 + \left(\sum_{k=B(i)}^{B(i+1)} W_k Y_k\right)^2}} \quad \text{(B – 1)}$$

$$\sin\phi_i = \frac{\sum_{k=B(i)}^{B(i+1)} W_k Z_k}{\sqrt{\left(\sum_{k=B(i)}^{B(i+1)} W_k X_k\right)^2 + \left(\sum_{k=B(i)}^{B(i+1)} W_k Y_k\right)^2 + \left(\sum_{k=B(i)}^{B(i+1)} W_k Z_k\right)^2}} \quad \text{(B – 1)}$$

-continued $$\hat{X} = \hat{W}\cos\theta\cos\varphi\,\mathrm{sign}X,\ \hat{Y} = \hat{W}\sin\theta\cos\varphi\,\mathrm{sign}Y,\ \hat{Z} = \hat{W}\sin\varphi\,\mathrm{sign}Z \quad \text{(B – 3)}$$

$$\mathrm{sign}A = \mathrm{sign}(\cos(\mathrm{angle}(W) - \mathrm{angle}(A))) \quad \text{(B – 4)}$$

where $\hat{W}$ denotes a quantized version of the W signal (shown as energy compensated ambient HOA coefficients 47A'), signX denotes the sign information for the quantized version of the X signal, signY denotes the sign information for the quantized version of the Y signal and the signZ denotes the sign information for the quantized version of the Z signal.

The theta/phi encoding unit 294 may perform operations similar to those shown in the following pseudo-code to derive the sign information 298, although the pseudo-code may be modified to account for an integer SignThreshold (e.g., 6 or 4) rather than the ratio (e.g., 0.8 in the example pseudo-code) and the various operators may be understood to compute the sign count (which is the SignStacked variable) on a time-frequency band basis:

1. SignThreshold=0.8;
2. SignStacked(i)=sum(SignX(i));
3. tmpIdx=abs(SignStacked(i))<SignThreshold;
4. SignStacked(i, tmpIdx)=SignStacked(i−1, tmpIdx)
5. SignStacked(i, :)=sign(SignStacked(i, :)+eps)

The conceptual diagram of FIG. 9 further shows two sign maps 400 and 402, where, in both sign maps 400 and 402, the X-axis (left to right) denotes time and the Y-axis (down to up) denotes frequency. Both sign maps 400 and 402 include 9 frequency bands, denoted by the different patterns of blank, diagonal lines, and hash lines. The diagonal line bands of sign map 400 each include 9 predominantly positive signed bins. The blank bands of sign map 400 each include 9 mixed signed bins having approximately a +1 or −1 difference between positive signed bins and negative signed bins. The hash line bands of sign map 400 each include 9 predominantly negative signed bins.

Sign map 402 illustrates how the sign information is associated with each of the bands based on the example pseudo-code above. The theta/phi encoding unit 294 may determine that the predominantly positive signed diagonal line bands in the sign map 400 should be associated with sign information indicating that the bins for these diagonal line bands should be uniformly positive, which is shown in sign map 402. The blank bands in sign map 400 are neither predominantly positive nor negative and are associated with sign information for a corresponding band of a previous frame (which is unchanged in the example sign map 402). The theta/phi encoding unit 294 may determine that the predominantly negative signed hashed lines bands in the sign map 400 should be associated with sign information indicating that the bins for these hashed lines bands should be uniformly negative, which is shown in sign map 402, and encode such sign information accordingly for transmission with the bins.

Figure 10:
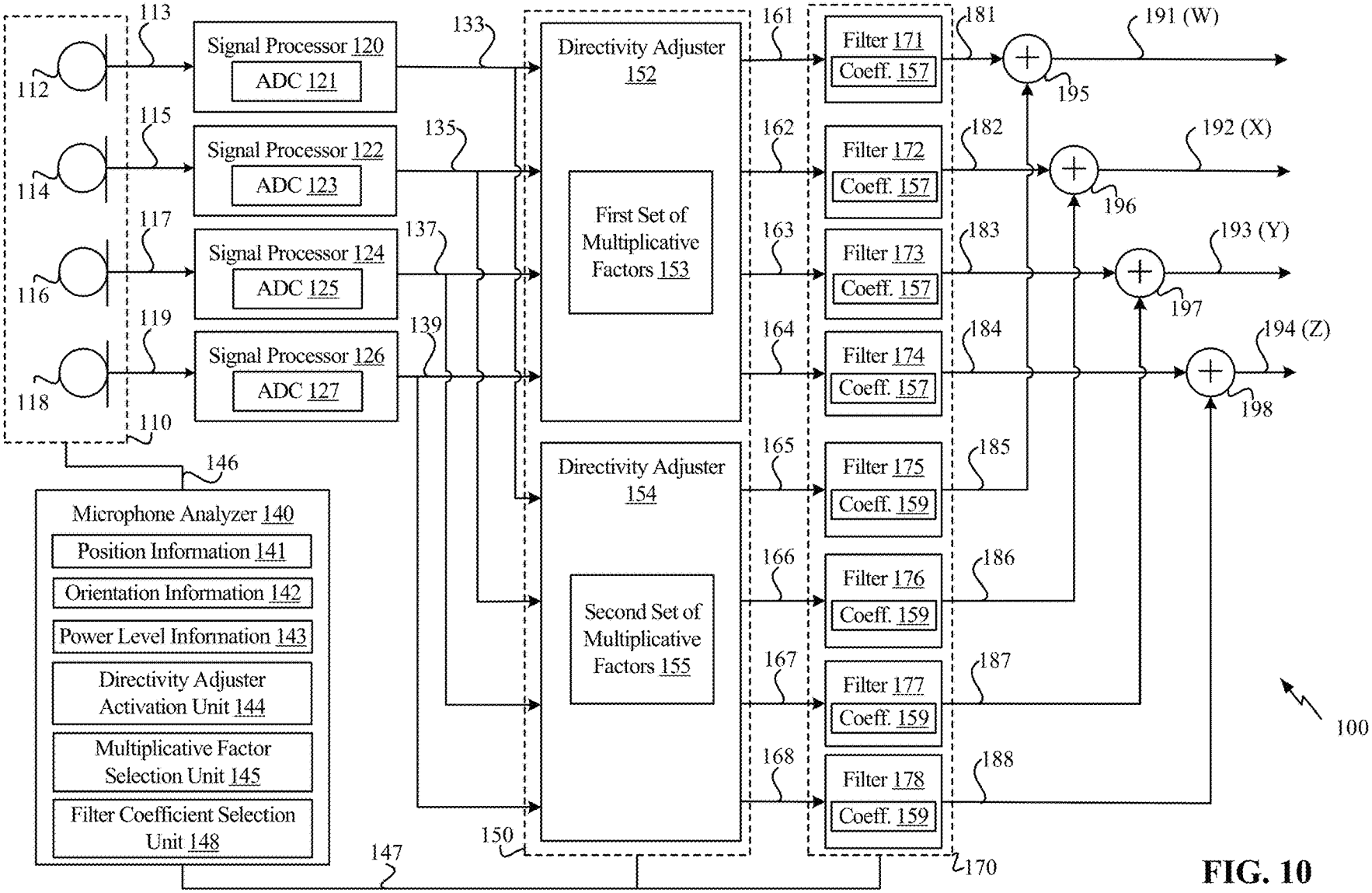
FIG. 10 is a block diagram illustrating, in more detail, an example of the device shown in the example of FIG. 2.

FIG. 10 is a block diagram illustrating, in more detail, an example of the device 12 shown in the example of FIG. 2. The system 100 of FIG. 10 may represent one example of the device 12 shown in the example of FIG. 2. The system 100 may represent a system for generating first-order ambisonic signals using a microphone array. The system 100 may be integrated into multiple devices. As non-limiting examples, the system 100 may be integrated into a robot, a mobile phone, a head-mounted display, a virtual reality headset, or an optical wearable (e.g., glasses).

The system 100 includes a microphone array 110 that includes a microphone 112, a microphone 114, a microphone 116, and a microphone 118. At least two microphones associated with the microphone array 110 are located on different two-dimensional planes. For example, the microphones 112, 114 may be located on a first two-dimensional plane, and the microphones 116, 118 may be located on a second two-dimensional plane. As another example, the microphone 112 may be located on the first two-dimensional plane, and the microphones 114, 116, 118 may be located on the second two-dimensional plane. According to one implementation, at least one microphone 112, 114, 116, 118 is an omnidirectional microphone. For example, at least one microphone 112, 114, 116, 118 is configured to capture sound with approximately equal gain for all sides and directions. According to one implementation, at least one of the microphones 112, 114, 116, 118 is a microelectromechanical system (MEMS) microphone.

In some implementations, each microphone 112, 114, 116, 118 is positioned within a cubic space having particular dimensions. For example, the particular dimensions may be defined by a two centimeter length, a two centimeter width, and a two centimeter height. As described below, a number of active directivity adjusters 150 in the system 100 and a number of active filters 170 (e.g., finite impulse response filters) in the system 100 may be based on whether each microphone 112, 114, 116, 118 is positioned within a cubic space having the particular dimensions. For example, the number of active directivity adjusters 150 and filters 170 is reduced if the microphones 112, 114, 116, 118 are located within a close proximity to each other (e.g., within the particular dimensions). However, it should be understood that the microphones 112, 114, 116, 118 may be arranged in different configurations (e.g., a spherical configuration, a triangular configuration, a random configuration, etc.) while positioned within the cubic space having the particular dimensions.

The system 100 includes signal processing circuitry that is coupled to the microphone array 110. The signal processing circuitry includes a signal processor 120, a signal processor 112, a signal processor 124, and a signal processor 126. The signal processing circuitry is configured to perform signal processing operations on analog signals captured by each microphone 112, 114, 116, 118 to generate digital signals.

To illustrate, the microphone 112 is configured to capture an analog signal 113, the microphone 114 is configured to capture an analog signal 115, the microphone 116 is configured to capture an analog signal 117, and the microphone 118 is configured to capture an analog signal 119. The signal processor 120 is configured to perform first signal processing operations (e.g., filtering operations, gain adjustment operations, analog-to-digital conversion operations) on the analog signal 113 to generate a digital signal 133. In a similar manner, the signal processor 122 is configured to perform second signal processing operations on the analog signal 115 to generate a digital signal 135, the signal processor 124 is configured to perform third signal processing operations on the analog signal 117 to generate a digital signal 137, and the signal processor 126 is configured to perform fourth signal processing operations on the analog signal 119 to generate a digital signal 139. Each signal processor 120, 122, 124, 126 includes an analog-to-digital converter (ADC) 121, 123, 125, 127, respectively, to perform the analog-to-digital conversion operations.

Each digital signal 133, 135, 137, 139 is provided to the directivity adjusters 150. In the example of FIG. 10, two directivity adjusters 152, 154 are shown. However, it should be understood that additional directivity adjusters may be included in the system 100. As a non-limiting example, the system 100 may include four directivity adjusters 150, eight directivity adjusters 150, etc. Although the number of directivity adjusters 150 included in the system 100 may vary, the number of active directivity adjusters 150 is based on information generated at a microphone analyzer 140, as described below.

The microphone analyzer 140 is coupled to the microphone array 110 via a control bus 146, and the microphone analyzer 140 is coupled to the directivity adjusters 150 and the filters 170 via a control bus 147. The microphone analyzer 140 is configured to determine position information 141 for each microphone of the microphone array 110. The position information 141 may indicate the position of each microphone relative to other microphones in the microphone array 110. Additionally, the position information 141 may indicate whether each microphone 112, 114, 116, 118 is positioned within the cubic space having the particular dimensions (e.g., the two centimeter length, the two centimeter width, and the two centimeter height). The microphone analyzer 140 is further configured to determine orientation information 142 for each microphone of the microphone array 110. The orientation information 142 indicates a direction that each microphone 112, 114, 116, 118 is pointing. According to some implementations, the microphone analyzer 140 is configured to determine power level information 143 for each microphone of the microphone array 110. The power level information 143 indicates a power level for each microphone 112, 114, 116, 118.

The microphone analyzer 140 includes a directivity adjuster activation unit 144 that is configured to determine how many sets of multiplicative factors are to be applied to the digital signals 133, 135, 137, 139. For example, the directivity adjuster activation unit 144 may determine how many directivity adjusters 150 are activated. According to one implementation, there is a one-to-one relationship between the number of sets of multiplicative factors applied and the number of directivity adjusters 150 activated. The number of sets of multiplicative factors to be applied to the digital signals 133, 135, 137, 139 is based on whether each microphone 112, 114, 116, 118 is positioned within the cubic space having the particular dimensions. For example, the directivity adjuster activation unit 144 may determine to apply two sets of multiplicative factors (e.g., a first set of multiplicative factors 153 and a second set of multiplicative factors 155) to the digital signals 133, 135, 137, 139 if the position information 141 indicates that each microphone 112, 114, 116, 118 is positioned within the cubic space. Alternatively, the directivity adjuster activation unit 144 may determine to apply more than two sets of multiplicative factors (e.g., four sets, eights sets, etc.) to the digital signals 133, 135, 137, 139 if the position information 141 indicates that each microphone 112, 114, 116, 118 is not positioned within the particular dimensions. Although described above with respect to the position information, the directivity adjuster activation unit 114 may also determine how many sets of multiplicative factors are to be applied to the digital signals 133, 135, 137, 139 based on the orientation information, the power level information 143, other information associated with the microphones 112, 114, 116, 118, or a combination thereof.

The directivity adjuster activation unit 144 is configured to generate an activation signal (not shown) and send the activation signal to the directivity adjusters 150 and to the filters 170 via the control bus 147. The activation signal indicates how many directivity adjusters 150 and how many filters 170 are activated. According to one implementation, there is a direct relationship between the number of activated directivity adjusters 150 and the number of activated filters 170. To illustrate, there are four filters coupled to each directivity adjuster. For example, filters 171-174 are coupled to the directivity adjuster 152, and filters 175-178 are coupled to the directivity adjuster 154. Thus, if the directivity adjuster 152 is activated, the filters 171-174 are also activated. Similarly, if the directivity adjuster 154 is activated, the filters 175-178 are activated.

The microphone analyzer 140 also includes a multiplicative factor selection unit 145 configured to determine multiplicative factors used by each activated directivity adjuster 150. For example, the multiplicative factor selection unit 145 may select (or generate) the first set of multiplicative factors 153 to be used by the directivity adjuster 152 and may select (or generate) the second set of multiplicative factors 155 to be used by the directivity adjuster 154. Each set of multiplicative factors 153, 155 may be selected based on the position information 141, the orientation information 142, the power level information 143, other information associated with the microphones 112, 114, 116, 118, or a combination thereof. The multiplicative factor selection unit 145 sends each set of multiplicative factors 153, 155 to the respective directivity adjusters 152, 154 via the control bus 147.

The microphone analyzer 140 also includes a filter coefficient selection unit 148 configured to determine first filter coefficients 157 to be used by the filters 171-174 and second filter coefficients 159 to be used by the filter 175-178. The filter coefficients 157, 159 may be determined based on the position information 141, the orientation information 142, the power level information 143, other information associated with the microphones 112, 114, 116, 118, or a combination thereof. The filter coefficient selection unit 148 sends the filter coefficients to the respective filters 171-178 via the control bus 147.

It should be noted that operations of the microphone analyzer 140 may be performed after the microphones 112, 114, 116, 118 are positioned on a device (e.g., a robot, a mobile phone, a head-mounted display, a virtual reality headset, an optical wearable, etc.) and prior to introduction of the device in the market place. For example, the number of active directivity adjusters 150, the number of active filters 170, the multiplicative factors 153, 155, and the filter coefficients 157, 157 may be fixed based on the position, orientation, and power levels of the microphones 112, 114, 116, 118 during assembly. As a result, the multiplicative factors 153, 155 and the filter coefficients 157, 159 may be hardcoded into the system 100. According to other implementations, the number of active directivity adjusters 150, the number of active filters 170, the multiplicative factors 153, 155, and the filter coefficients 157, 157 may be determined "on the fly" by the microphone analyzer 140. For example, the microphone analyzer 140 may determine the position, orientation, and power levels of the microphones 112, 114, 116, 118 in "real-time" to adjust for changes in the microphone configuration. Based on the changes, the microphone analyzer 140 may determine the number of active directivity adjusters 150, the number of active filters 170, the multiplicative factors 153, 155, and the filter coefficients 157, 157, as described above.

The microphone analyzer 140 enables compensation for flexible microphone positions (e.g., a "non-ideal" tetrahedral microphone arrangement) by adjusting the number of active directivity adjusters 150, filters 170, multiplicative factors 153, 159, and filter coefficients 157, 159 based on the position of the microphones, the orientation of the microphones, etc. As described below, the directivity adjusters 150 and the filters 170 apply different transfer functions to the digital signals 133, 135, 137, 139 based on the placement and directivity of the microphones 112, 114, 116, 118.

The directivity adjuster 152 may be configured to apply the first set of multiplicative factors 153 to the digital signals 133, 135, 137, 139 to generate a first set of ambisonic signals 161-164. For example, the directivity adjuster 152 may apply the first set of multiplicative factors 153 to the digital signals 133, 135, 137, 139 using a first matrix multiplication. The first set of ambisonic signals includes a W signal 161, an X signal 162, a Y signal 163, and a Z signal 164.

The directivity adjuster 154 may be configured to apply the second set of multiplicative factors 155 to the digital signals 133, 135, 137, 139 to generate a second set of ambisonic signals 165-168. For example, the directivity adjuster 154 may apply the second set of multiplicative factors 155 to the digital signals 133, 135, 137, 139 using a second matrix multiplication. The second set of ambisonic signals includes a W signal 165, an X signal 166, a Y signal 167, and a Z signal 168.

The first set of filters 171-174 are configured to filter the first set of ambisonic signals 161-164 to generate a filtered first set of ambisonic signals 181-184. To illustrate, the filter 171 (having the first filter coefficients 157) may filter the W signal 161 to generate a filtered W signal 181, the filter 172 (having the first filter coefficients 157) may filter the X signal 162 to generate a filtered X signal 182, the filter 173 (having the first filter coefficients 157) may filter the Y signal 163 to generate a filtered Y signal 183, and the filter 174 (having the first filter coefficients 157) may filter the Z signal 164 to generate a filtered Z signal 184.

In a similar manner, the second set of filters 175-178 are configured to filter the second set of ambisonic signals 165-168 to generate a filtered second set of ambisonic signals 185-188. To illustrate, the filter 175 (having the second filter coefficients 159) may filter the W signal 165 to generate a filtered W signal 185, the filter 176 (having the second filter coefficients 159) may filter the X signal 166 to generate a filtered X signal 186, the filter 177 (having the second filter coefficients 159) may filter the Y signal 167 to generate a filtered Y signal 187, and the filter 178 (having the second filter coefficients 159) may filter the Z signal 168 to generate a filtered Z signal 188.

The system 100 also includes combination circuitry 195-198 coupled to the first set of filters 171-174 and to the second set of filters 175-178. The combination circuitry 195-198 is configured to combine the filtered first set of ambisonic signals 181-184 and the filtered second set of ambisonic signals 185-188 to generate a processed set of ambisonic signals 191-194. For example, a combination circuit 195 combines the filtered W signal 181 and the filtered W signal 185 to generate a W signal 191, a combination circuit 196 combines the filtered X signal 182 and the filtered X signal 186 to generate an X signal 192, a combination circuit 197 combines the filtered the filtered X signal 182 and the filtered X signal 186 to generate an X signal 192, a combination circuit 197 combines the filtered Y signal 183 and the filtered Y signal 187 to generate a Y signal 193, and a combination circuit 198 combines the filtered Z signal 184 and the filtered Z signal 188 to generate a Z signal 194. Thus, the processed set of ambisonic signals 191-194 may corresponds to a set of first order ambisonic signals that includes the W signal 191, the X signal 192, the Y signal 193, and the Z signal 194.

Thus, the system 100 shown in the example of FIG. 10 coverts recordings from the microphones 112, 114, 116, 118 to first order ambisonics. Additionally, the system 100 enables compensates for flexible microphone positions (e.g., a "non-ideal" tetrahedral microphone arrangement) by adjusting the number of active directivity adjusters 150, filters 170, multiplicative factors 153, 159, and filter coefficients 157, 159 based on the position of the microphones, the orientation of the microphones, etc. For example, the system 100 applies different transfer functions to the digital signals 133, 135, 137, 139 based on the placement and directivity of the microphones 112, 114, 116, 118. Thus, the system 100 determines the four-by-four matrices (e.g., the directivity adjusters 150) and filters 170 that substantially preserve directions of audio sources when rendered onto loudspeakers. The four-by-four matrices and the filters may be determined using a model.

Because the system 100 converts the captured sounds to first order ambisonics, the captured sounds may be played back over a plurality of loudspeaker configurations and may the captured sounds may be rotated to adapt to a consumer head position. Although the techniques of FIG. 10 are described with respect to first order ambisonics, it should be appreciated that the techniques may also be performed using higher order ambisonics.

Figure 11:
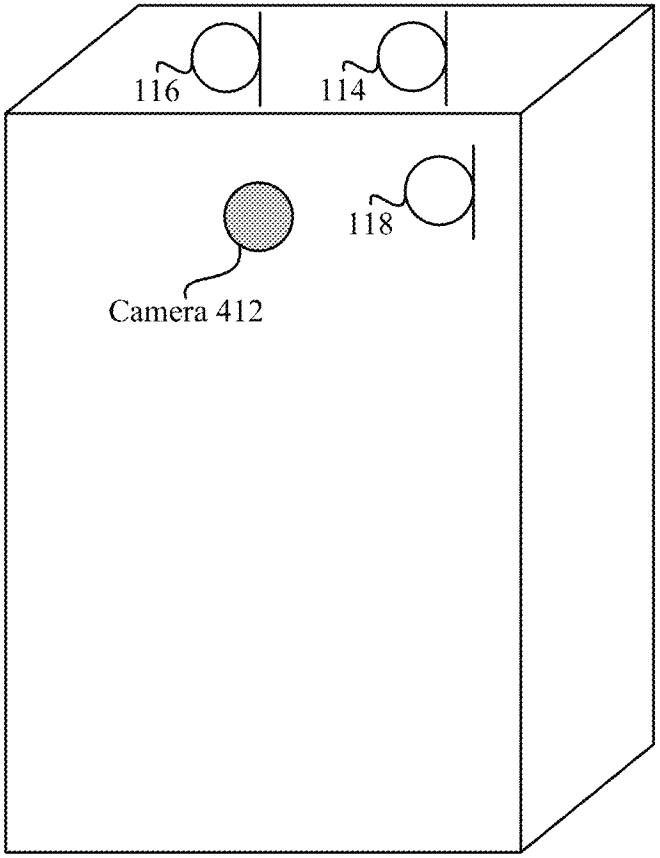
FIG. 11 is a block diagram illustrating an example of the system of FIG. 10 in more detail.
Figure 11:
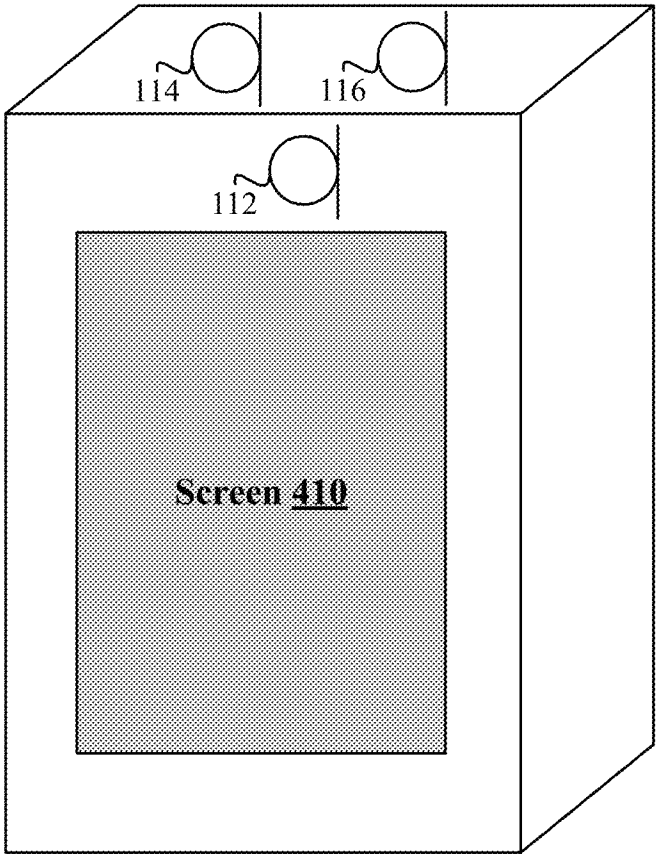

FIG. 11 is a block diagram illustrating an example of the system 100 of FIG. 10 in more detail. Referring to FIG. 11, a mobile device (e.g. a mobile phone) that includes the components of the microphone array 110 of FIG. 10 is shown. According to FIG. 11, the microphone 112 is located on a front side of the mobile device. For example, the microphone 112 is located near a screen 410 of the mobile device. The microphone 118 is located on a back side of the mobile device. For example, the microphone 118 is located near a camera 412 of the mobile device. The microphones 114, 116 are located on top of the mobile device.

If the microphones are located within a cubic space of the mobile device having dimensions of, e.g., two centimeters× two centimeters×two centimeters, the directivity adjuster activation unit 144 may determine to use two directivity adjusters (e.g., the directivity adjusters 152, 154) to process the digital signals 133, 135, 137, 139 associated with the microphones 112, 114, 116, 118. However, if at least one microphone is not located within the cubic space, the directivity adjuster activation unit 144 may determine to use more than two directivity adjusters (e.g., four directivity adjusters, eight directivity adjusters, etc.) to process the digital signals 133, 135, 137, 139 associated with the microphones 112, 114, 116, 118.

Thus, the microphones 112, 114, 116, 118 may be located at flexible positions (e.g., a "non-ideal" tetrahedral microphone arrangement) on the mobile device of FIG. 11 and ambisonic signals may be generated using the techniques described above.

Figure 12:
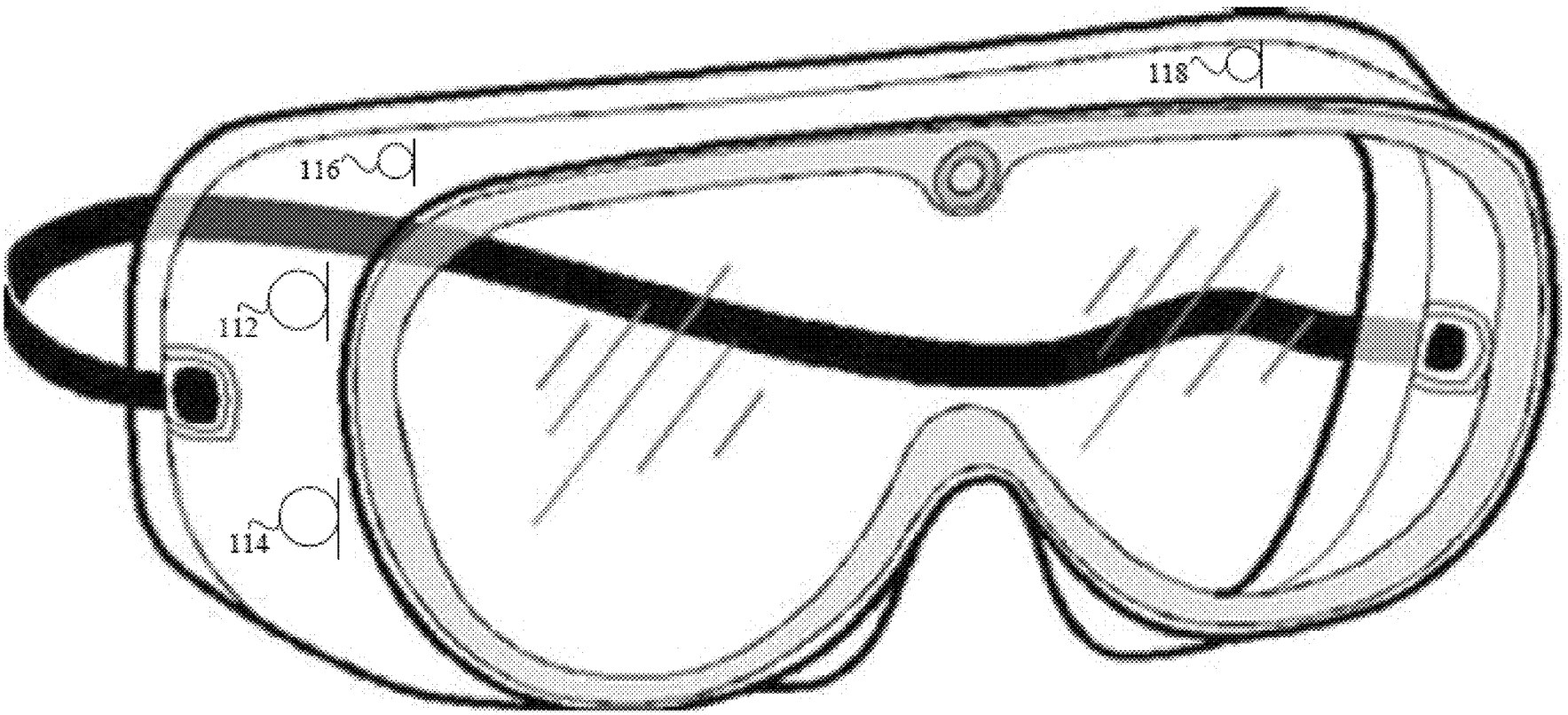
FIG. 12 is a block diagram illustrating another example of the system of FIG. 10 in more detail.

FIG. 12 is a block diagram illustrating another example of the system 100 of FIG. 10 in more detail. Referring to FIG. 12, an optical wearable that includes the components of the microphone array 110 of FIG. 10 is shown. According to FIG. 12, the microphones 112, 114, 116 are located on a right side of the optical wearable, and the microphone 118 is located on a top-left corner of the optical wearable. Because the microphone 118 is not located within the cubic space of the other microphones 112, 114, 116, the directivity adjuster activation unit 144 determines to use more than two directivity adjusters (e.g., four directivity adjusters, eight directivity adjusters, etc.) to process the digital signals 133, 135, 137, 139 associated with the microphones 112, 114, 116, 118. Thus, the microphones 112, 114, 116, 118 may be located at flexible positions (e.g., a "non-ideal" tetrahedral microphone arrangement) on the optical wearable of FIG. 12 and ambisonic signals may be generated using the techniques described above.

Figure 13:
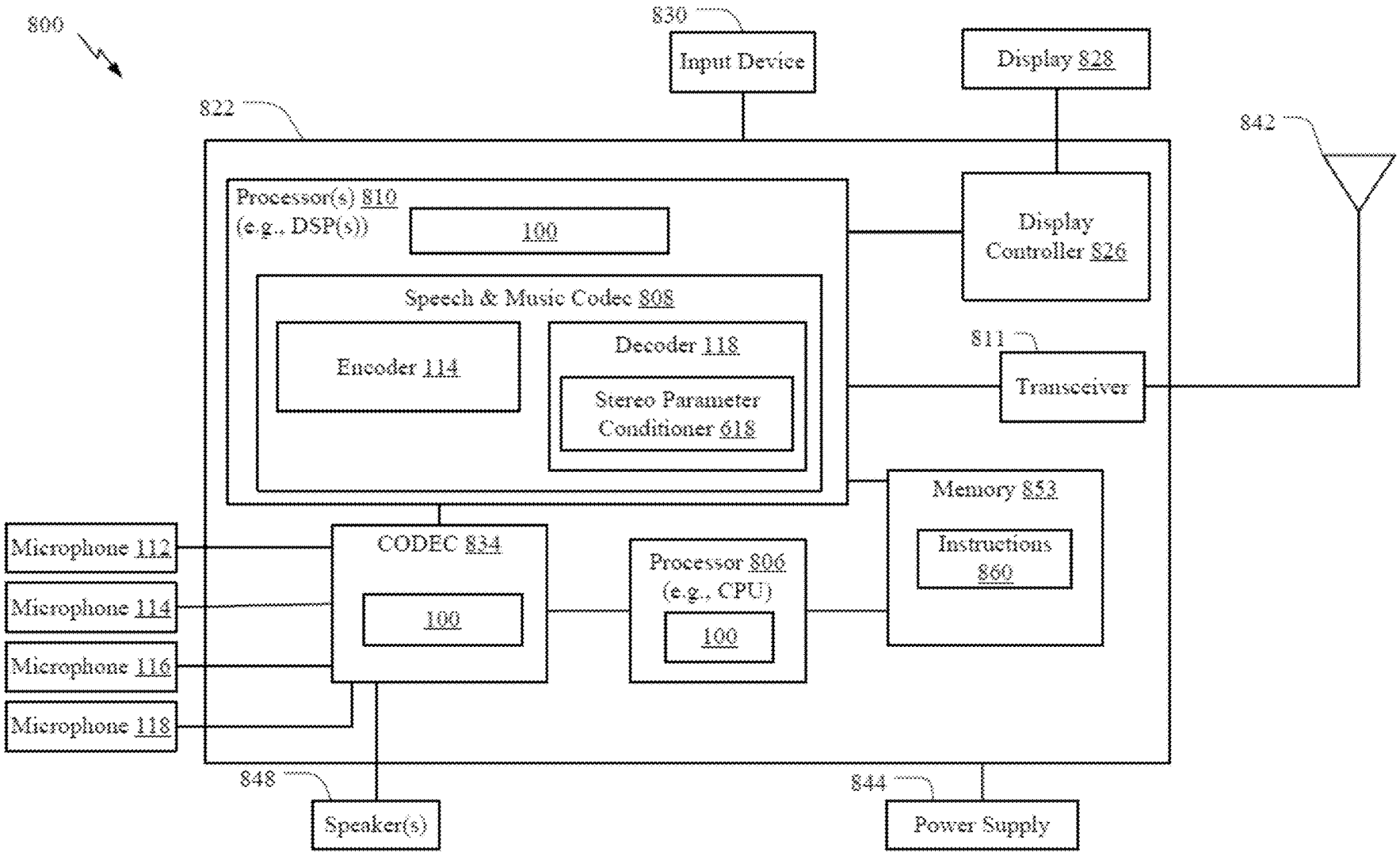
FIG. 13 is a block diagram illustrating an example implementation of the system of FIG. 10 in more detail.

FIG. 13 is a block diagram illustrating an example implementation of the system 100 of FIG. 10 in more detail. Referring to FIG. 13, a block diagram of a particular illustrative implementation of a device (e.g., a wireless communication device) is depicted and generally designated 800. In various implementations, the device 800 may have more components or fewer components than illustrated in FIG. 13.

In a particular implementation, the device 800 includes a processor 806, such as a central processing unit (CPU) or a digital signal processor (DSP), coupled to a memory 853. The memory 853 includes instructions 860 (e.g., executable instructions) such as computer-readable instructions or processor-readable instructions. The instructions 860 may include one or more instructions that are executable by a computer, such as the processor 806 or a processor 810.

FIG. 13 also illustrates a display controller 826 that is coupled to the processor 810 and to a display 828. A coder/decoder (CODEC) 834 may also be coupled to the processor 806. A speaker 836 and the microphones 112, 114, 116, 118 may be coupled to the CODEC 834. The CODEC 834 other components of the system 100 (e.g., the signal processors 120, 122, 124, 126, the microphone analyzer 140, the directivity adjusters 150, the filters 170, the combination circuits 195-198, etc.). In other implementations, the processors 806, 810 may include the components of the system 100.

A transceiver 811 may be coupled to the processor 810 and to an antenna 842, such that wireless data received via the antenna 842 and the transceiver 811 may be provided to the processor 810. In some implementations, the processor 810, the display controller 826, the memory 853, the CODEC 834, and the transceiver 811*b* are included in a system-in-package or system-on-chip device 822. In some implementations, an input device 830 and a power supply 844 are coupled to the system-on-chip device 822. Moreover, in a particular implementation, as illustrated in FIG. 13, the display 828, the input device 830, the speaker 836, the microphones 112, 114, 116, 118, the antenna 842, and the power supply 844 are external to the system-on-chip device 822. In a particular implementation, each of the display 828, the input device 830, the speaker 836, the microphones 112, 114, 116, 118, the antenna 842, and the power supply 844 may be coupled to a component of the system-on-chip device 822, such as an interface or a controller.

The device 800 may include a headset, a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, a vehicle, a component of a vehicle, or any combination thereof, as illustrative, non-limiting examples.

In an illustrative implementation, the memory 853 may include or correspond to a non-transitory computer readable medium storing the instructions 860. The instructions 860 may include one or more instructions that are executable by a computer, such as the processors 810, 806 or the CODEC 834. The instructions 860 may cause the processor 810 to perform one or more operations described herein.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, a first apparatus includes means for performing signal processing operations on analog signals captured by each microphone of a microphone array to generate digital signals. The microphone array includes a first microphone, a second microphone, a third microphone, and a fourth microphone. At least two microphones associated with the microphone array are located on different two-dimensional planes. For example, the means for performing may include the signal processors 120, 122, 124, 126 of FIG. 1B, the analog-to-digital converters 121, 123, 125, 127 of FIG. 1B, the processors 806, 808 of FIG. 13, the CODEC 834 of FIG. 13, the instructions 860 executable by a processor, one or more other devices, circuits, modules, or any combination thereof.

The first apparatus also includes means for applying a first set of multiplicative factors to the digital signals to generate a first set of ambisonic signals. The first set of multiplicative factors is determined based on a position of each microphone in the microphone array, an orientation of each microphone in the microphone array, or both. For example, the means for applying the first set of multiplicative factors may include the directivity adjuster 154 of FIG. 10, the processors 806, 808 of FIG. 13, the CODEC 834 of FIG. 13, the instructions 860 executable by a processor, one or more other devices, circuits, modules, or any combination thereof.

The first apparatus also includes means for applying a second set of multiplicative factors to the digital signals to generate a second set of ambisonic signals. The second set of multiplicative factors is determined based on the position of each microphone in the microphone array, the orientation of each microphone in the microphone array, or both. For example, the means for applying the second set of multiplicative factors may include the directivity adjuster 152 of FIG. 10, the processors 806, 808 of FIG. 13, the CODEC 834 of FIG. 13, the instructions 860 executable by a processor, one or more other devices, circuits, modules, or any combination thereof.

In conjunction with the described techniques, a second apparatus includes means for determining position information for each microphone of a microphone array. The microphone array includes a first microphone, a second microphone, a third microphone, and a fourth microphone. At least two microphones associated with the microphone array are located on different two-dimensional planes. For example, the means for determining the position information may include the microphone analyzer 140 of FIG. 10, the processors 806, 808 of FIG. 13, the CODEC 834 of FIG. 13, the instructions 860 executable by a processor, one or more other devices, circuits, modules, or any combination thereof.

The second apparatus also includes means for determining orientation information for each microphone of the microphone array. For example, the means for determining the orientation information may include the microphone analyzer 140 of FIG. 10, the processors 806, 808 of FIG. 13, the CODEC 834 of FIG. 13, the instructions 860 executable by a processor, one or more other devices, circuits, modules, or any combination thereof.

The second apparatus also includes means for determining how many sets of multiplicative factors are to be applied to digital signals associated with microphones of the microphone array based on the position information and the orientation information. Each set of multiplicative factors is used to determine a processed set of ambisonic signals. For example, the means for determining how many sets of multiplicative factors are to be applied may include the microphone analyzer 140 of FIG. 10, the directivity adjuster activation unit 144 of FIG. 10, the processors 806, 808 of FIG. 13, the CODEC 834 of FIG. 13, the instructions 860 executable by a processor, one or more other devices, circuits, modules, or any combination thereof.

Figure 16:
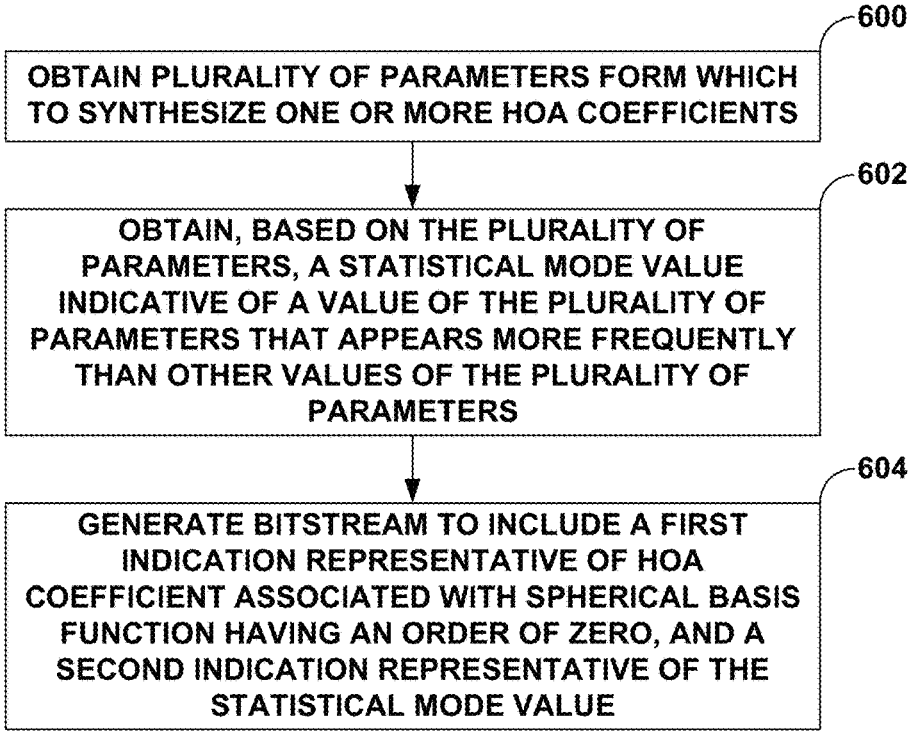
FIG. 16 is a flowchart illustrating example operation of the audio encoding unit shown in the examples of FIGS. 2 and 3A-3D in performing various aspects of the techniques described in this disclosure.

FIG. 16 is a flowchart illustrating example operation of the audio encoding unit shown in the examples of FIGS. 2 and 3A-3D in performing various aspects of the techniques described in this disclosure. The audio encoding unit 20 may first obtain a plurality of parameters 35 from which to synthesize one or more HOA coefficients 29' (which represent HOA coefficients associated with one or more spherical basis functions having an order greater than zero) (600).

The audio encoding unit 20 may next obtain, based on the plurality of parameters 35, a statistical mode value indicative of a value of the plurality of parameters 35 that appears more frequently than other values of the plurality of parameters 35 (602). The audio encoding unit 20 may generate a bitstream 21 to include a first indication 31 representative of an HOA coefficient 27 associated with the spherical basis function having an order of zero, and a second indication 35 representative of the statistical mode value 35 (604).

Figure 17:
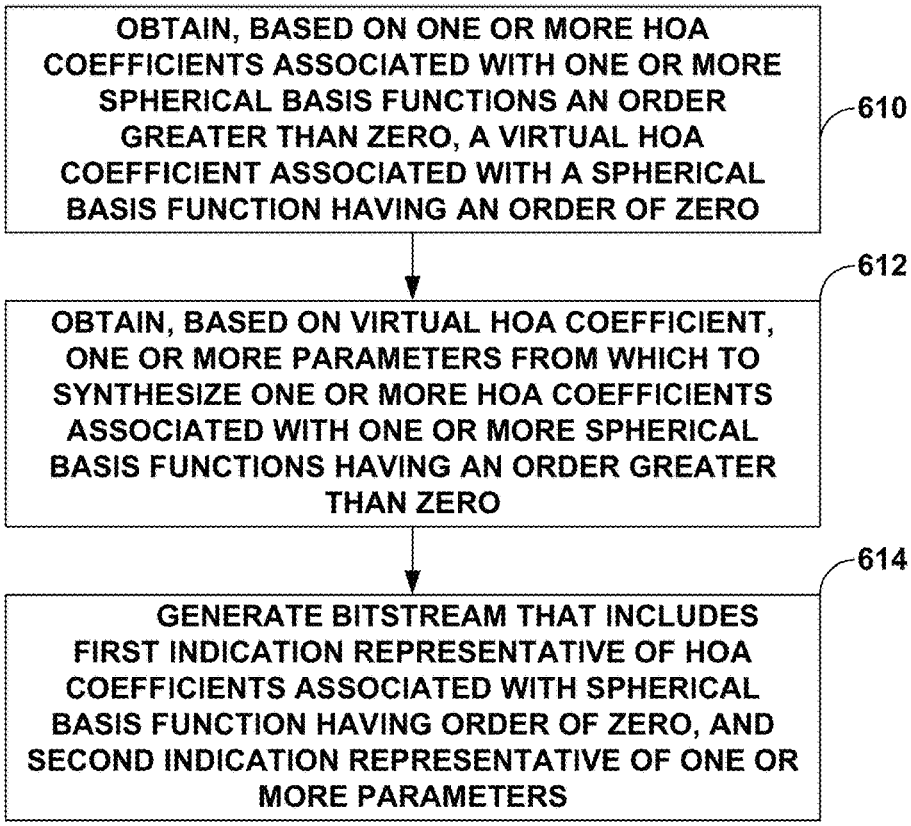
FIG. 17 is a flowchart illustrating example operation of the audio encoding unit shown in the examples of FIGS. 2 and 3A-3D in performing various aspects of the techniques described in this disclosure.

FIG. 17 is a flowchart illustrating example operation of the audio encoding unit shown in the examples of FIGS. 2 and 3A-3D in performing various aspects of the techniques described in this disclosure. The audio encoding unit 20 may first obtain, based on one or more HOA coefficients 43 associated with one or more spherical basis functions having an order greater than zero (which may be referred to as "greater-than-zero-ordered HOA coefficients"), a virtual HOA coefficient associated with a spherical basis function having an order of zero (610).

The audio encoding unit 20 may next obtain, based on the virtual HOA coefficient, one or more parameters 35 from which to synthesize one or more HOA coefficients 29' associated with one or more spherical basis functions having an order greater than zero (612). The audio encoding unit 20 may generate a bitstream 21 to include a first indication 31 representative of an HOA coefficient 27 associated with the spherical basis function having an order of zero (which may be referred to as "zero-ordered HOA coefficients"), and a second indication 35 representative of the one or more parameters 35 (614).

Figure 18:
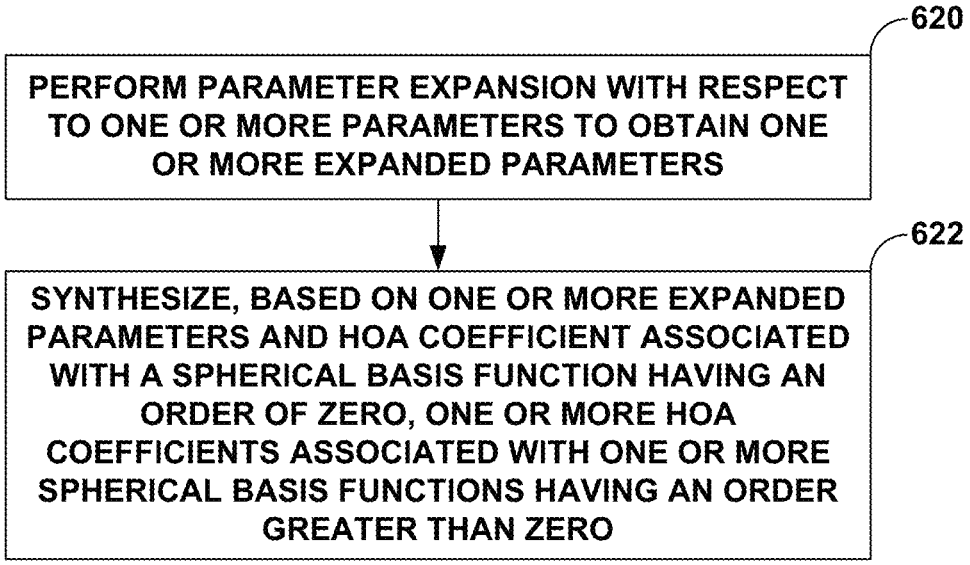
FIG. 18 is a flowchart illustrating example operation of the audio decoding unit shown in the examples of FIGS. 2 and 4A-4D in performing various aspects of the techniques described in this disclosure.

FIG. 18 is a flowchart illustrating example operation of the audio decoding unit shown in the examples of FIGS. 2 and 4A-4D in performing various aspects of the techniques described in this disclosure. The audio decoding unit 24 may first perform parameter expansion with respect to one or more parameters 35 to obtain one or more expanded parameters 85 (620). The audio decoding device 24 may next synthesize, based on the one or more expanded parameters 85 and an HOA coefficient 27' associated with a spherical basis function having an order of zero, one or more HOA coefficients 43 associated with one or more spherical basis functions having an order greater than zero (622).

Various aspects of the above described techniques may refer to one or more of the examples listed below:

Example 1A

A device for encoding audio data, the device comprising: a memory configured to store the audio data, the audio data representative of a higher order ambisonic (HOA) coefficient associated with a spherical basis function having an order of zero, and one or more HOA coefficients associated with one or more spherical basis functions having an order greater than zero; and one or more processors coupled to the memory, and configured to: obtain, based on the one or more HOA coefficients associated with the one or more spherical basis functions having the order greater than zero, a virtual HOA coefficient associated with the spherical basis function having the order of zero; obtain, based on the virtual HOA coefficient, one or more parameters from which to synthesize the one or more HOA coefficients associated with the one or more spherical basis functions having the order greater than zero; and generate a bitstream that includes a first indication representative of the HOA coefficients associated with the spherical basis function having the order of zero, and a second indication representative of the one or more parameters.

Example 2A

The device of example 1A, wherein the one or more processors are configured to generate the bitstream such that the bitstream does not include the one or more HOA coefficients associated with the one or more spherical basis functions having the order greater than zero.

Example 3A

The device of any combination of examples 1A and 2A, wherein the bitstream includes the one or more parameters in place of the one or more HOA coefficients associated with the one or more spherical basis functions having the order greater than zero.

Example 4A

The device of any combination of examples 1A-3A, wherein the bitstream includes the one or more parameters in place of the one or more HOA coefficients associated with the one or more spherical basis functions having the order greater than zero, and such that the one or more parameters are used to synthesize the one or more HOA coefficients associated with the one or more spherical basis functions having the order greater than zero.

Example 5A

The device of any combination of examples 1A-4A, wherein the one or more processors are further configured to perform speech encoding with respect to the HOA coefficient associated with the spherical basis function having the order of zero to obtain the first indication.

Example 6A

The device of example 5A, wherein the one or more processors are configured to perform enhanced voice services (EVS) speech encoding with respect to the HOA coefficient associated with the spherical basis function having the order of zero to obtain the first indication.

Example 7A

The device of claim 5A, wherein the one or more processors are configured to perform adaptive multi-rate wideband (AMR-WB) speech encoding with respect to the HOA coefficient associated with the spherical basis function having the order of zero to obtain the first indication.

Example 8A

The device of any combination of examples 1A-7A, wherein the one or more processors are configured to obtain the virtual HOA coefficients in accordance with the following equation: $W\hat{}+=\text{sign}(W\hat{}')\sqrt{(X\hat{}2+Y\hat{}2+Z\hat{}2)}$, wherein $W\hat{}+$ denotes the virtual HOA coefficient, sign(*) denotes a function that outputs a sign (positive or negative) of an input, $W\hat{}'$ denotes speech coded HOA coefficients associated with the spherical basis function having the order of zero, X denotes an HOA coefficient associated with a spherical basis function having an order of one and a sub-order of one, Y denotes an HOA coefficient associated with a spherical basis function having an order of one and a sub-order of negative one, and Z denotes an HOA coefficient associated with a spherical basis function having an order of one and a sub-order of zero.

Example 9A

The device of example 8A, wherein the one or more parameters include an azimuth angle denoted by theta ($\theta$) and an elevation angle denoted by phi ($\phi$), and wherein the azimuth angle and the elevation indicate an energy position on a surface of a sphere having a radius equal to $\sqrt{(W\hat{}+)}$.

Example 10A

The device of any combination of examples 1A-9A, wherein the one or more parameters include an angle.

Example 11A

The device of any combination of examples 1A-10A, wherein the one or more parameters include an azimuth angle Example 12A The device of any combination of examples 1A-11A, wherein the one or more parameters include an elevation angle.

Example 13A

The device of any combination of claim 1A-12A, wherein the one or more parameters include an azimuth angle and an elevation angle.

Example 14A

The device of any combination of examples 1A-13A, wherein the one or more parameters indicate an energy position within a frame of the HOA coefficient associated with the spherical basis function having the order of zero.

Example 15A

The device of any combination of examples 1A-14A, wherein the one or more parameters indicate an energy position within a portion of a frame of the HOA coefficient associated with the spherical basis function having the order of zero.

Example 16A

The device of example 15A, wherein the portion of a frame includes a sub-frame.

Example 17A

The device of example 15A, wherein the one or more parameters indicate an energy position within each of four sub-frames of a frame of the HOA coefficient associated with the spherical basis function having the order of zero.

Example 18A

The device of any combination of examples 1A-17A, further comprising a microphone coupled to the one or more processors, and configured to capture the audio data.

Example 19A

The device of any combination of examples 1A-18A, further comprising a transmitter coupled to the one or more processors, and configured to transmit the bitstream.

Example 20A

The device of example 19A, wherein the transmitter is configured to transmit the bitstream in accordance with an enhanced voice services (EVS) standard.

Example 21A

The device of any combination of examples 1A-20A, wherein the one or more processors obtain the one or more parameters directly using an open loop process in which determination of a prediction error is not performed.

Example 22A

The device of any combination of examples 1A-21A, wherein the one or more processors obtain the one or more parameters using a closed loop process in which determination of a prediction error is performed.

Example 23A

The device of any combination of examples 1A-22A, wherein the one or more processors obtain the one or more parameters using a closed loop process, the closed loop process including: synthesizing, based on the one or more parameters, the one or more HOA coefficients associated with the one or more spherical basis functions having the order greater than zero; obtaining, based on the synthesized HOA coefficients and the one or more HOA coefficients associated with the one or more spherical basis functions having the order greater than zero, a prediction error; obtaining, based on the prediction error, one or more updated parameters from which to synthesize the one or more HOA coefficients associated with the one or more spherical basis functions having the order greater than zero.

Example 24A

The device of example 23A, wherein the one or more processors generate the bitstream to include a third indication representative of the prediction error.

Example 25A

A method of encoding audio data, the method comprising: obtaining, based on one or more HOA coefficients associated with one or more spherical basis functions having the order greater than zero, a virtual HOA coefficient associated with a spherical basis function having an order of zero; obtaining, based on the virtual HOA coefficient, one or more parameters from which to synthesize one or more HOA coefficients associated with one or more spherical basis functions having an order greater than zero; and generating a bitstream that includes a first indication representative of an HOA coefficients associated with the spherical basis function having the order of zero, and a second indication representative of the one or more parameters.

Example 26A

The method of example 25A, wherein generating the bitstream comprises generating the bitstream such that the bitstream does not include the one or more HOA coefficients associated with the one or more spherical basis functions having the order greater than zero.

Example 27A

The method of any combination of examples 25A and 26A, wherein the bitstream includes the one or more parameters in place of the one or more HOA coefficients associated with the one or more spherical basis functions having the order greater than zero.

Example 28A

The method of any combination of examples 25A-27A, wherein the bitstream includes the one or more parameters in place of the one or more HOA coefficients associated with the one or more spherical basis functions having the order greater than zero, and such that the one or more parameters are used to synthesize the one or more HOA coefficients associated with the one or more spherical basis functions having the order greater than zero.

Example 29A

The method of any combination of examples 25A-28A, further comprising performing speech encoding with respect to the HOA coefficient associated with the spherical basis function having the order of zero to obtain the first indication.

Example 30A

The method of example 29A, wherein performing speech encoding comprises performing enhanced voice services (EVS) speech encoding with respect to the HOA coefficient associated with the spherical basis function having the order of zero to obtain the first indication.

Example 31A

The method of example 29A, wherein performing speech encoding comprises performing perform adaptive multi-rate wideband (AMR-WB) speech encoding with respect to the HOA coefficient associated with the spherical basis function having the order of zero to obtain the first indication.

Example 32A

The method of any combination of examples 25A-31A, wherein obtaining the virtual HOA coefficients comprises obtaining the virtual HOA coefficients in accordance with the following equation: $W\hat{}+=\text{sign}(W\hat{}')\sqrt{(X\hat{}2+Y\hat{}2+Z\hat{}2)}$, wherein W^+ denotes the virtual HOA coefficient, sign(*) denotes a function that outputs a sign (positive or negative) of an input, W^' denotes speech coded HOA coefficients associated with the spherical basis function having the order of zero, X denotes an HOA coefficient associated with a spherical basis function having an order of one and a sub-order of one, Y denotes an HOA coefficient associated with a spherical basis function having an order of one and a sub-order of negative one, and Z denotes an HOA coefficient associated with a spherical basis function having an order of one and a sub-order of zero.

Example 33A

The method of example 32A, wherein the one or more parameters include an azimuth angle denoted by theta (θ) and an elevation angle denoted by phi (ϕ), and wherein the azimuth angle and the elevation indicate an energy position on a surface of a sphere having a radius equal to $\sqrt{(W\hat{}+)}$.

Example 34A

The method of any combination of examples 25A-33A, wherein the one or more parameters include an angle.

Example 35A

The method of any combination of examples 25A-34A, wherein the one or more parameters include an azimuth angle.

Example 36A

The method of any combination of examples 25A-35A, wherein the one or more parameters include an elevation angle.

Example 37A

The method of any combination of examples 25A-36A, wherein the one or more parameters include an azimuth angle and an elevation angle.

Example 38A

The method of any combination of examples 25A-37A, wherein the one or more parameters indicate an energy position within a frame of the HOA coefficient associated with the spherical basis function having the order of zero.

Example 39A

The method of any combination of examples 25A-38A, wherein the one or more parameters indicate an energy position within a portion of a frame of the HOA coefficient associated with the spherical basis function having the order of zero.

Example 40A

The method of example 39A, wherein the portion of a frame includes a sub-frame.

Example 41A

The method of example 39A, wherein the one or more parameters indicate an energy position within each of four sub-frames of a frame of the HOA coefficient associated with the spherical basis function having the order of zero.

Example 42A

The method of any combination of examples 25A-41A, further comprising capturing, by a microphone, the audio data.

Example 43A

The method of any combination of examples 25A-42A, further comprising transmitting, by a transmitter, the bitstream.

Example 44A

The method of example 43A, wherein the transmitter is configured to transmit the bitstream in accordance with an enhanced voice services (EVS) standard.

Example 45A

The method of example 25A, wherein obtaining the one or more parameters comprises obtaining the one or more parameters directly using an open loop process in which determination of a prediction error is not performed.

Example 46A

The method of any combination of examples 25A-45A, wherein obtaining the one or more parameters comprises obtaining the one or more parameters using a closed loop process in which determination of a prediction error is performed.

Example 47A

The method of example 25A-46A, wherein obtaining the one or more parameters comprises obtaining the one or more parameters using a closed loop process, the closed loop process including: synthesizing, based on the one or more parameters, the one or more HOA coefficients associated with the one or more spherical basis functions having the order greater than zero; obtaining, based on the synthesized HOA coefficients and the one or more HOA coefficients associated with the one or more spherical basis functions having the order greater than zero, a prediction error; obtaining, based on the prediction error, one or more updated parameters from which to synthesize the one or more HOA coefficients associated with the one or more spherical basis functions having the order greater than zero.

Example 48A

The method of example 47A, wherein generating the bitstream comprises generating the bitstream to include a third indication representative of the prediction error.

Example 49A

A device configured to encode audio data, the method comprising: means for obtaining, based on one or more HOA coefficients associated with one or more spherical basis functions having the order greater than zero, a virtual HOA coefficient associated with a spherical basis function having an order of zero; means for obtaining, based on the virtual HOA coefficient, one or more parameters from which to synthesize one or more HOA coefficients associated with one or more spherical basis functions having an order greater than zero; and means for generating a bitstream that includes a first indication representative of an HOA coefficients associated with the spherical basis function having the order of zero, and a second indication representative of the one or more parameters.

Example 50A

The device of example 49A, wherein the means for generating the bitstream comprises means for generating the bitstream such that the bitstream does not include the one or more HOA coefficients associated with the one or more spherical basis functions having the order greater than zero.

Example 51A

The device of any combination of examples 49A and 50A, wherein the bitstream includes the one or more parameters in place of the one or more HOA coefficients associated with the one or more spherical basis functions having the order greater than zero.

Example 52A

The device of any combination of examples 49A-51A, wherein the bitstream includes the one or more parameters in place of the one or more HOA coefficients associated with the one or more spherical basis functions having the order greater than zero, and such that the one or more parameters are used to synthesize the one or more HOA coefficients associated with the one or more spherical basis functions having the order greater than zero.

Example 53A

The device of any combination of examples 49A-52A, further comprising means for performing speech encoding with respect to the HOA coefficient associated with the spherical basis function having the order of zero to obtain the first indication.

Example 54A

The device of example 53A, wherein the means for performing speech encoding comprises means for performing enhanced voice services (EVS) speech encoding with respect to the HOA coefficient associated with the spherical basis function having the order of zero to obtain the first indication.

Example 55A

The device of example 53A, wherein the means for performing speech encoding comprises means for performing perform adaptive multi-rate wideband (AMR-WB) speech encoding with respect to the HOA coefficient associated with the spherical basis function having the order of zero to obtain the first indication.

Example 56A

The device of any combination of examples 49A-55A, wherein the means for obtaining the virtual HOA coefficients comprises means for obtaining the virtual HOA coefficients in accordance with the following equation: $W\hat{}+=\text{sign}(W\hat{}')\sqrt{(X\hat{}2+Y\hat{}2+Z\hat{}2)}$, wherein W^+ denotes the virtual HOA coefficient, sign(*) denotes a function that outputs a sign (positive or negative) of an input, W^' denotes speech coded HOA coefficients associated with the spherical basis function having the order of zero, X denotes an HOA coefficient associated with a spherical basis function having an order of one and a sub-order of one, Y denotes an HOA coefficient associated with a spherical basis function having an order of one and a sub-order of negative one, and Z denotes an HOA coefficient associated with a spherical basis function having an order of one and a sub-order of zero.

Example 57A

The device of example 56A, wherein the one or more parameters include an azimuth angle denoted by theta (θ) and an elevation angle denoted by phi (ϕ), and wherein the azimuth angle and the elevation indicate an energy position on a surface of a sphere having a radius equal to $\sqrt{(W\hat{}+)}$.

Example 58A

The device of any combination of examples 49A-57A, wherein the one or more parameters include an angle.

Example 59A

The device of any combination of examples 49A-58A, wherein the one or more parameters include an azimuth angle Example 60A The device of any combination of examples 49A-59A, wherein the one or more parameters include an elevation angle.

Example 61A

The device of any combination of examples 49A-60A, wherein the one or more parameters include an azimuth angle and an elevation angle.

Example 62A

The device of any combination of examples 49A-61A, wherein the one or more parameters indicate an energy position within a frame of the HOA coefficient associated with the spherical basis function having the order of zero.

Example 63A

The device of any combination of examples 49A-62A, wherein the one or more parameters indicate an energy position within a portion of a frame of the HOA coefficient associated with the spherical basis function having the order of zero.

Example 64A

The device of example 63A, wherein the portion of a frame includes a sub-frame.

Example 65A

The device of example 63A, wherein the one or more parameters indicate an energy position within each of four sub-frames of a frame of the HOA coefficient associated with the spherical basis function having the order of zero.

Example 66A

The device of any combination of examples 49A-65A, further comprising means for capturing the audio data.

Example 67A

The device of any combination of examples 49A-66A, further comprising means for transmitting the bitstream.

Example 68A

The device of example 67A, wherein the transmitter is configured to transmit the bitstream in accordance with an enhanced voice services (EVS) standard.

Example 69A

The device of any combination of examples 49A-68A, wherein the means for obtaining the one or more parameters comprises means for obtaining the one or more parameters directly using an open loop process in which determination of a prediction error is not performed.

Example 70A

The device of any combination of examples 49A-69A, wherein the means for obtaining the one or more parameters means for comprises obtaining the one or more parameters using a closed loop process in which determination of a prediction error is performed.

Example 71A

The device of any combination of examples 49A-70A, wherein the means for obtaining the one or more parameters comprises means for obtaining the one or more parameters using a closed loop process, the closed loop process including: synthesizing, based on the one or more parameters, the one or more HOA coefficients associated with the one or more spherical basis functions having the order greater than zero; obtaining, based on the synthesized HOA coefficients and the one or more HOA coefficients associated with the one or more spherical basis functions having the order greater than zero, a prediction error; obtaining, based on the prediction error, one or more updated parameters from which to synthesize the one or more HOA coefficients associated with the one or more spherical basis functions having the order greater than zero.

Example 72A

The device of example 71A, wherein the means for generating the bitstream comprises means for generating the bitstream to include a third indication representative of the prediction error.

Example 73A

A non-transitory computer-readable storage medium having stored thereon instructions that, when executed, cause one or more processors to: obtain, based on one or more HOA coefficients associated with one or more spherical basis functions having the order greater than zero, a virtual HOA coefficient associated with a spherical basis function having an order of zero; obtain, based on the virtual HOA coefficient, one or more parameters from which to synthesize one or more HOA coefficients associated with one or more spherical basis functions having an order greater than zero; and generate a bitstream that includes a first indication representative of an HOA coefficients associated with the spherical basis function having the order of zero, and a second indication representative of the one or more parameters.

Example 1B

A device configured to encode audio data, the device comprising: a memory configured to store the audio data, the audio data representative of a higher order ambisonic (HOA) coefficient associated with a spherical basis function having an order of zero, and one or more HOA coefficients associated with one or more spherical basis functions having an order greater than zero; and one or more processors coupled to the memory, and configured to: obtain a plurality of parameters from which to synthesize the one or more HOA coefficients associated with the one or more spherical basis functions having the order greater than zero; obtain, based on the plurality of parameters, a statistical mode value indicative of a value of the plurality of parameters that appears more frequently than other values of the plurality of parameters; and generate a bitstream to include first indication representative of an HOA coefficient associated with the spherical basis function having an order of zero, and a second indication representative of the statistical mode value.

Example 2B

The device of example 1B, wherein the one or more processors are configured to generate the bitstream such that the bitstream does not include the one or more HOA coefficients associated with the one or more spherical basis functions having the order greater than zero.

Example 3B

The device of any combination of examples 1B and 2B, wherein the bitstream includes the statistical mode value in place of the plurality of parameters and the one or more HOA coefficients associated with the one or more spherical basis functions having the order greater than zero.

Example 4B

The device of any combination of examples 1B-3B, wherein the bitstream includes the statistical mode value in place of the plurality of parameters and the one or more HOA coefficients associated with the one or more spherical basis functions having the order greater than zero, and such that the statistical mode value is used to synthesize the one or more HOA coefficients associated with the one or more spherical basis functions having the order greater than zero.

Example 5B

The device of any combination of examples 1B-4B, wherein the one or more processors are further configured to perform speech encoding with respect to the HOA coefficient associated with the spherical basis function having the order of zero to obtain the first indication.

Example 6B

The device of example 5B, wherein the one or more processors are configured to perform enhanced voice services (EVS) speech encoding with respect to the HOA coefficient associated with the spherical basis function having the order of zero to obtain the first indication.

Example 7B

The device of example 5B, wherein the one or more processors are configured to perform adaptive multi-rate wideband (AMR-WB) speech encoding with respect to the HOA coefficient associated with the spherical basis function having the order of zero to obtain the first indication.

Example 8B

The device of any combination of examples 1B-7B, wherein the one or more processors are further configured to obtain, based on the one or more HOA coefficients associated with the one or more spherical basis functions having the order greater than zero, a virtual HOA coefficient associated with the spherical basis function having the order of zero.

Example 9B

The device of example 8A, wherein the one or more processors are configured to obtain the virtual HOA coefficients in accordance with the following equation: $W\hat{}+=\text{sign}(W\hat{}')\sqrt{(X\hat{}2+Y\hat{}2+Z\hat{}2)}$, wherein W^+ denotes the virtual HOA coefficient, sign(*) denotes a function that outputs a sign (positive or negative) of an input, W^' denotes the speech encoded HOA coefficients associated with the spherical basis function having the order of zero, X denotes an HOA coefficient associated with a spherical basis function having an order of one and a sub-order of one, Y denotes an HOA coefficient associated with a spherical basis function having an order of one and a sub-order of negative one, and Z denotes an HOA coefficient associated with a spherical basis function having an order of one and a sub-order of zero.

Example 10B

The device of example 9B, wherein the plurality of parameters includes an azimuth angle denoted by theta (θ) and an elevation angle denoted by phi (ϕ), and wherein the azimuth angle and the elevation indicate an energy position on a surface of a sphere having a radius equal to $\sqrt{(W\hat{}+)}$.

Example 11B

The device of any combination of examples 1B-10B, wherein the plurality of parameters includes an angle.

Example 12B

The device of any combination of examples 1B-11B, wherein the plurality of parameters includes an azimuth angle Example 13B The device of any combination of examples 1B-12B, wherein the plurality of parameters includes an elevation angle.

Example 14B

The device of any combination of examples 1B-13B, wherein the plurality of parameters includes an azimuth angle and an elevation angle.

Example 15B

The device of any combination of examples 1B-14B, wherein one or more of the plurality of parameters indicates an energy position within a frame of the HOA coefficient associated with the spherical basis function having the order of zero.

Example 16B

The device of any combination of examples 1B-15B, wherein one or more of the plurality of parameters indicates an energy position within a portion of a frame of the HOA coefficient associated with the spherical basis function having the order of zero.

Example 17B

The device of example 16B, wherein the portion of a frame includes a sub-frame.

Example 18B

The device of example 16B, wherein each of the plurality of parameters indicate an energy position within each of four sub-frames of a frame of the HOA coefficient associated with the spherical basis function having the order of zero.

Example 19B

The device of any combination of examples 1B-18B, further comprising a microphone coupled to the one or more processors, and configured to capture the audio data.

Example 20B

The device of any combination of examples 1B-19B, further comprising a transmitter coupled to the one or more processors, and configured to transmit the bitstream.

Example 21B

The device of example 20B, wherein the transmitter is configured to transmit the bitstream in accordance with an enhanced voice services (EVS) standard.

Example 22B

The device of any combination of examples 1B-21B, wherein the one or more processors obtain the plurality of parameters directly using an open loop process in which determination of a prediction error is not performed.

Example 23B

The device of any combination of examples 1B-22B, wherein the one or more processors obtain the plurality of parameters using a closed loop process in which determination of a prediction error is performed.

Example 24B

The device of any combination of examples 1B-23B, wherein the one or more processors obtain the one or more parameters using a closed loop process, the closed loop process including: perform parameter expansion with respect to the statistical mode value to obtain one or more expanded parameters; synthesizing, based on the one or more expanded parameters, the one or more HOA coefficients associated with the one or more spherical basis functions having the order greater than zero; obtaining, based on the synthesized HOA coefficients and the one or more HOA coefficients associated with the one or more spherical basis functions having the order greater than zero, a prediction error; obtaining, based on the prediction error, one or more updated parameters from which to synthesize the one or more HOA coefficients associated with the one or more spherical basis functions having the order greater than zero.

Example 25B

The device of example 24B, wherein the one or more processors generate the bitstream to include a third indication representative of the prediction error.

Example 26B

A method of encoding audio data, the method comprising: obtaining a plurality of parameters from which to synthesize one or more HOA coefficients associated with one or more spherical basis functions having an order greater than zero; obtaining, based on the plurality of parameters, a statistical mode value indicative of a value of the plurality of parameters that appears more frequently than other values of the plurality of parameters; and generating a bitstream to include a first indication representative of an HOA coefficient associated with the spherical basis function having an order of zero, and a second indication representative of the statistical mode value.

Example 27B

The method of example 26B, wherein generating the bitstream comprises generating the bitstream such that the bitstream does not include the one or more HOA coefficients associated with the one or more spherical basis functions having the order greater than zero.

Example 28B

The method of any combination of examples 26B and 27B, wherein the bitstream includes the statistical mode value in place of the plurality of parameters and the one or more HOA coefficients associated with the one or more spherical basis functions having the order greater than zero.

Example 29B

The method of any combination of examples 26B-28B, wherein the bitstream includes the statistical mode value in place of the plurality of parameters and the one or more HOA coefficients associated with the one or more spherical basis functions having the order greater than zero, and such that the statistical mode value is used to synthesize the one or more HOA coefficients associated with the one or more spherical basis functions having the order greater than zero.

Example 30B

The method of any combination of examples 26B-29B, further comprising performing speech encoding with respect to the HOA coefficient associated with the spherical basis function having the order of zero to obtain the first indication.

Example 31B

The method of example 30B, wherein performing the speech encoding comprises performing enhanced voice services (EVS) speech encoding with respect to the HOA coefficient associated with the spherical basis function having the order of zero to obtain the first indication.

Example 32B

The method of example 30B, wherein performing the speech encoding comprises performing adaptive multi-rate wideband (AMR-WB) speech encoding with respect to the HOA coefficient associated with the spherical basis function having the order of zero to obtain the first indication.

Example 33B

The method of any combination of examples 26B-32B, further comprising obtaining, based on the one or more HOA coefficients associated with the one or more spherical basis functions having the order greater than zero, a virtual HOA coefficient associated with the spherical basis function having the order of zero.

Example 34B

The method of example 33A, wherein obtaining the virtual HOA coefficients comprise obtaining the virtual HOA coefficients in accordance with the following equation: $W\hat{}+=\text{sign}(W\hat{}')\sqrt{(X\hat{}2+Y\hat{}2+Z\hat{}2)}$, wherein $W\hat{}+$ denotes the virtual HOA coefficient, sign(*) denotes a function that outputs a sign (positive or negative) of an input, $W\hat{}'$ denotes the speech encoded HOA coefficients associated with the spherical basis function having the order of zero, X denotes an HOA coefficient associated with a spherical basis function having an order of one and a sub-order of one, Y denotes an HOA coefficient associated with a spherical basis function having an order of one and a sub-order of negative one, and Z denotes an HOA coefficient associated with a spherical basis function having an order of one and a sub-order of zero.

Example 35B

The method of example 34B, wherein the plurality of parameters includes an azimuth angle denoted by theta (θ) and an elevation angle denoted by phi (ϕ), and wherein the azimuth angle and the elevation indicate an energy position on a surface of a sphere having a radius equal to √(W^+).

Example 36B

The method of any combination of examples 26B-35B, wherein the plurality of parameters includes an angle.

Example 37B

The method of any combination of examples 26B-36B, wherein the plurality of parameters includes an azimuth angle Example 38B The method of any combination of examples 26B-37B, wherein the plurality of parameters includes an elevation angle.

Example 39B

The method of any combination of examples 26B-38B, wherein the plurality of parameters includes an azimuth angle and an elevation angle.

Example 40B

The method of any combination of examples 26B-39B, wherein one or more of the plurality of parameters indicates an energy position within a frame of the HOA coefficient associated with the spherical basis function having the order of zero.

Example 41B

The method of any combination of examples 26B-40B, wherein one or more of the plurality of parameters indicates an energy position within a portion of a frame of the HOA coefficient associated with the spherical basis function having the order of zero.

Example 42B

The method of example 41B, wherein the portion of a frame includes a sub-frame.

Example 43B

The method of example 41B, wherein each of the plurality of parameters indicate an energy position within each of four sub-frames of a frame of the HOA coefficient associated with the spherical basis function having the order of zero.

Example 44B

The method of any combination of examples 26B-43B, further comprising capturing, by a microphone, the audio data.

Example 45B

The method of any combination of examples 26B-44B, further comprising transmitting, by a transmitter, the bitstream.

Example 46B

The method of example 45B, wherein the transmitter is configured to transmit the bitstream in accordance with an enhanced voice services (EVS) standard.

Example 47B

The method of any combination of examples 26B-46B, wherein obtaining the one or more parameters comprises obtaining the plurality of parameters directly using an open loop process in which determination of a prediction error is not performed.

Example 48B

The method of any combination of examples 26B-47B, wherein obtaining the one or more parameters comprises obtaining the plurality of parameters using a closed loop process in which determination of a prediction error is performed.

Example 49B

The method of any combination of examples 26A-48B, wherein obtaining the one or more parameters comprises obtaining the one or more parameters using a closed loop process, the closed loop process including: perform parameter expansion with respect to the statistical mode value to obtain one or more expanded parameters; synthesizing, based on the one or more expanded parameters, the one or more HOA coefficients associated with the one or more spherical basis functions having the order greater than zero; obtaining, based on the synthesized HOA coefficients and the one or more HOA coefficients associated with the one or more spherical basis functions having the order greater than zero, a prediction error; obtaining, based on the prediction error, one or more updated parameters from which to synthesize the one or more HOA coefficients associated with the one or more spherical basis functions having the order greater than zero.

Example 50B

The method of example 49B, wherein generating the bitstream comprises generating the bitstream to include a third indication representative of the prediction error.

Example 51B

A device configured to encode audio data, the device comprising: means for obtaining a plurality of parameters from which to synthesize one or more HOA coefficients associated with one or more spherical basis functions having an order greater than zero; means for obtaining, based on the plurality of parameters, a statistical mode value indicative of a value of the plurality of parameters that appears more frequently than other values of the plurality of parameters; and means for generating a bitstream to include a first indication representative of an HOA coefficient associated with the spherical basis function having an order of zero, and a second indication representative of the statistical mode value.

Example 52B

The device of example 51B, wherein the means for generating the bitstream comprises means for generating the bitstream such that the bitstream does not include the one or more HOA coefficients associated with the one or more spherical basis functions having the order greater than zero.

Example 53B

The device of any combination of examples 51B and 52B, wherein the bitstream includes the statistical mode value in place of the plurality of parameters and the one or more HOA coefficients associated with the one or more spherical basis functions having the order greater than zero.

Example 54B

The device of any combination of examples 51B-53B, wherein the bitstream includes the statistical mode value in place of the plurality of parameters and the one or more HOA coefficients associated with the one or more spherical basis functions having the order greater than zero, and such that the statistical mode value is used to synthesize the one or more HOA coefficients associated with the one or more spherical basis functions having the order greater than zero.

Example 55B

The device of any combination of examples 51B-54B, further comprising means for performing speech encoding with respect to the HOA coefficient associated with the spherical basis function having the order of zero to obtain the first indication.

Example 56B

The device of example 55B, wherein the means for performing the speech encoding comprises means for performing enhanced voice services (EVS) speech encoding with respect to the HOA coefficient associated with the spherical basis function having the order of zero to obtain the first indication.

Example 57B

The device of example 55B, wherein the means for performing the speech encoding comprises means for performing adaptive multi-rate wideband (AMR-WB) speech encoding with respect to the HOA coefficient associated with the spherical basis function having the order of zero to obtain the first indication.

Example 58B

The device of any combination of examples 51B-57B, further comprising means for obtaining, based on the one or more HOA coefficients associated with the one or more spherical basis functions having the order greater than zero, a virtual HOA coefficient associated with the spherical basis function having the order of zero.

Example 59B

The device of example 58A, wherein the means for obtaining the virtual HOA coefficients comprise means for obtaining the virtual HOA coefficients in accordance with the following equation: $W\hat{}+=\text{sign}(W\hat{}')\sqrt{(X\hat{}2+Y\hat{}2+Z\hat{}2)}$, wherein $W\hat{}+$ denotes the virtual HOA coefficient, sign(*) denotes a function that outputs a sign (positive or negative) of an input, $W\hat{}'$ denotes the speech encoded HOA coefficients associated with the spherical basis function having the order of zero, X denotes an HOA coefficient associated with a spherical basis function having an order of one and a sub-order of one, Y denotes an HOA coefficient associated with a spherical basis function having an order of one and a sub-order of negative one, and Z denotes an HOA coefficient associated with a spherical basis function having an order of one and a sub-order of zero.

Example 60B

The device of example 59B, wherein the plurality of parameters includes an azimuth angle denoted by theta ($\theta$) and an elevation angle denoted by phi ($\phi$), and wherein the azimuth angle and the elevation indicate an energy position on a surface of a sphere having a radius equal to $\sqrt{(W\hat{}+)}$.

Example 61B

The device of any combination of examples 51B-60B, wherein the plurality of parameters includes an angle.

Example 62B

The device of any combination of examples 51B-61B, wherein the plurality of parameters includes an azimuth angle.

Example 63B

The device of any combination of examples 51B-62B, wherein the plurality of parameters includes an elevation angle.

Example 64B

The device of any combination of examples 51B-63B, wherein the plurality of parameters includes an azimuth angle and an elevation angle.

Example 65B

The device of any combination of examples 51B-64B, wherein one or more of the plurality of parameters indicates an energy position within a frame of the HOA coefficient associated with the spherical basis function having the order of zero.

Example 66B

The device of any combination of examples 51B-65B, wherein one or more of the plurality of parameters indicates an energy position within a portion of a frame of the HOA coefficient associated with the spherical basis function having the order of zero.

Example 67B

The device of example 66B, wherein the portion of a frame includes a sub-frame.

Example 68B

The device of example 66B, wherein each of the plurality of parameters indicate an energy position within each of four sub-frames of a frame of the HOA coefficient associated with the spherical basis function having the order of zero.

Example 69B

The device of any combination of examples 51B-68B, further comprising means for capturing the audio data.

Example 70B

The device of any combination of examples 51B-69B, further comprising means for transmitting the bitstream.

Example 71B

The device of example 70B, wherein the means for transmitting is configured to transmit the bitstream in accordance with an enhanced voice services (EVS) standard.

Example 72B

The device of any combination of examples 51B-71B, wherein the means for obtaining the one or more parameters comprises means for obtaining the plurality of parameters directly using an open loop process in which determination of a prediction error is not performed.

Example 73B

The device of any combination of examples 51B-72B, wherein the means for obtaining the one or more parameters means for comprises obtaining the plurality of parameters using a closed loop process in which determination of a prediction error is performed.

Example 74B

The device of claim 51B-73B, wherein the means for obtaining the one or more parameters comprises means for obtaining the one or more parameters using a closed loop process, the closed loop process including: perform parameter expansion with respect to the statistical mode value to obtain one or more expanded parameters; synthesizing, based on the one or more expanded parameters, the one or more HOA coefficients associated with the one or more spherical basis functions having the order greater than zero; obtaining, based on the synthesized HOA coefficients and the one or more HOA coefficients associated with the one or more spherical basis functions having the order greater than zero, a prediction error; and obtaining, based on the prediction error, one or more updated parameters from which to synthesize the one or more HOA coefficients associated with the one or more spherical basis functions having the order greater than zero.

Example 75B

The device of example 74B, wherein the means for generating the bitstream comprises means for generating the bitstream to include a third indication representative of the prediction error.

Example 76B

A non-transitory computer-readable storage medium having stored thereon instructions that, when executed, cause one or more processors to: obtain a plurality of parameters from which to synthesize one or more HOA coefficients associated with one or more spherical basis functions having an order greater than zero; obtain, based on the plurality of parameters, a statistical mode value indicative of a value of the plurality of parameters that appears more frequently than other values of the plurality of parameters; and generate a bitstream to include a first indication representative of an HOA coefficient associated with the spherical basis function having an order of zero, and a second indication representative of the statistical mode value.

Example 1C

A device configured to decode audio data, the device comprising: a memory configured to store at least a portion of a bitstream, the bitstream including a first indication representative of an HOA coefficient associated with the spherical basis function having an order of zero, and a second indication representative of one or more parameters; and one or more processors coupled to the memory, and configured to: perform parameter expansion with respect to the one or more parameters to obtain one or more expanded parameters; and synthesize, based on the one or more expanded parameters and the HOA coefficient associated with the spherical basis function having the order of zero, one or more HOA coefficients associated with one or more spherical basis functions having an order greater than zero.

Example 2C

The device of example 1C, wherein the one or more processors are configured to perform an interpolation with respect to the one or more parameters to obtain the one or more expanded parameters.

Example 3C

The device of any combination of examples 1C and 2C, wherein the one or more processors are configured to perform a linear interpolation with respect to the one or more parameters to obtain the one or more expanded parameters.

Example 4C

The device of any combination of examples 1C-3C, wherein the one or more parameters include a first parameter from a first frame of the bitstream and a second parameter from a second frame of the bitstream, and wherein the one or more processors are configured to perform a linear interpolation with respect to the first parameter and the second parameter to obtain the one or more expanded parameters.

Example 5C

The device of any combination of examples 1C-4C, wherein the one or more parameters include a first parameter from a first frame of the bitstream and a second parameter from a second frame of the bitstream, the first frame occurring temporally directly before the second frame, and wherein the one or more processors are configured to perform a linear interpolation with respect to the first parameter and the second parameter to obtain the one or more expanded parameters.

Example 6C

The device of any combination of examples 1C-5C, wherein the one or more parameters include a first parameter from a first frame of the bitstream and a second parameter from a second frame of the bitstream, the first frame occurring temporally directly before the second frame, and wherein the one or more processors are configured to perform a linear interpolation with respect to the first parameter and the second parameter to obtain an expanded parameter of the one or more expanded parameters for each sample in the second frame.

Example 7C

The device of any combination of examples 1C-6C, wherein the bitstream does not include the one or more HOA coefficients associated with the one or more spherical basis functions having the order greater than zero.

Example 8C

The device of any combination of examples 1C-7C, wherein the one or more parameters include a statistical mode value indicative of a value of the one or more parameters that occurs most often.

Example 9C

The device of example 8C, wherein the one or more parameters comprises a plurality of parameters, and wherein the bitstream includes the statistical mode value in place of the plurality of parameters and the one or more HOA coefficients associated with the one or more spherical basis functions having the order greater than zero.

Example 10C

The device of any combination of examples 1C-9C, wherein the one or more processors are further configured to perform speech decoding with respect to the first indication to obtain the HOA coefficient associated with the spherical basis function having the order of zero.

Example 11C

The device of example 10C, wherein the one or more processors are configured to perform enhanced voice services (EVS) speech decoding with respect to the first indication to obtain the HOA coefficient associated with the spherical basis function having the order of zero.

Example 12C

The device of example 10C, wherein the one or more processors are configured to perform adaptive multi-rate wideband (AMR-WB) speech decoding with respect to the first indication to obtain the HOA coefficient associated with the spherical basis function having the order of zero.

Example 13C

The device of any combination of examples 1C-12C, wherein the one or more parameters include a first angle, and wherein the one or more expanded parameters include a second angle.

Example 14C

The device of any combination of examples 1C-13C, wherein the one or more parameters include a first azimuth angle, and wherein the one or more expanded parameters include a second azimuth angle.

Example 15C

The device of any combination of examples 1C-14C, wherein the one or more parameters include a first elevation angle, and wherein the one or more expanded parameters include a second elevation angle.

Example 16C

The device of any combination of examples 1C-15C, wherein the one or more parameters include a first azimuth angle and a first elevation angle, and wherein the one or more expanded parameters include a second azimuth angle and a second elevation angle.

Example 17C

The device of any combination of examples 1C-16C, wherein the one or more parameters indicate an energy position within a frame of the HOA coefficient associated with the spherical basis function having the order of zero.

Example 18C

The device of any combination of examples 1C-17C, wherein the one or more parameters indicate an energy position within a portion of a frame of the HOA coefficient associated with the spherical basis function having the order of zero.

Example 19C

The device of example 18C, wherein the portion of a frame includes a sub-frame.

Example 20C

The device of example 18C, wherein the one or more parameters indicate an energy position within each of four sub-frames of a frame of the HOA coefficient associated with the spherical basis function having the order of zero.

Example 21C

The device of any combination of examples 1C-20C, wherein the one or more processors are further configured to: render, based on the HOA coefficient associated with the spherical basis function having the order of zero and the one or more HOA coefficients associated with the one or more spherical basis functions having the order greater than zero, a speaker feed; and output the speaker feed to a speaker.

Example 22C

The device of any combination of examples 1C-21C, further comprising a receiver coupled to the one or more processors, and configured to receive at least the portion of the bitstream.

Example 23C

The device of example 22C, wherein the receiver is configured to receive the bitstream in accordance with an enhanced voice services (EVS) standard.

Example 24C

The device of any combination of examples 1C-23C, wherein the one or more parameters comprises a statistical mode value indicative of a value of the one or more parameters that appears more frequently than other values of the one or more parameters.

Example 25C

The device of any combination of examples 1C-24C, wherein the bitstream further includes a third indication representative of a prediction error, the prediction error representative of a difference between the one or more synthesized HOA coefficients and the one or more HOA coefficients associated with one or more spherical basis functions having an order greater than zero, and wherein the one or more processors are further configured to update, based on the prediction error, the one or more synthesized HOA coefficients.

Example 26C

A method of decoding audio data, the method comprising: performing parameter expansion with respect to one or more parameters to obtain one or more expanded parameters; and synthesizing, based on the one or more expanded parameters and an HOA coefficient associated with a spherical basis function having an order of zero, one or more HOA coefficients associated with one or more spherical basis functions having an order greater than zero.

Example 27C

The method of example 26C, wherein performing the parameter expansion comprises performing an interpolation with respect to the one or more parameters to obtain the one or more expanded parameters.

Example 28C

The method of any combination of examples 26C and 27C, wherein performing the parameter expansion comprises performing a linear interpolation with respect to the one or more parameters to obtain the one or more expanded parameters.

Example 29C

The method of any combination of examples 26C-28C, wherein the one or more parameters include a first parameter from a first frame of the bitstream and a second parameter from a second frame of the bitstream, and wherein performing the parameter expansion comprises performing a linear interpolation with respect to the first parameter and the second parameter to obtain the one or more expanded parameters.

Example 30C

The method of any combination of examples 26C-29C, wherein the one or more parameters include a first parameter from a first frame of the bitstream and a second parameter from a second frame of the bitstream, the first frame occurring temporally directly before the second frame, and wherein performing the parameter expansion comprises performing a linear interpolation with respect to the first parameter and the second parameter to obtain the one or more expanded parameters.

Example 31C

The method of any combination of examples 26C-30C, wherein the one or more parameters include a first parameter from a first frame of the bitstream and a second parameter from a second frame of the bitstream, the first frame occurring temporally directly before the second frame, and wherein performing the parameter expansion comprises performing a linear interpolation with respect to the first parameter and the second parameter to obtain an expanded parameter of the one or more expanded parameters for each sample in the second frame.

Example 32C

The method of any combination of examples 26C-31C, wherein the bitstream does not include the one or more HOA coefficients associated with the one or more spherical basis functions having the order greater than zero.

Example 33C

The method of any combination of examples 26C-32C, wherein the one or more parameters include a statistical mode value indicative of a value of the one or more parameters that occurs most often.

Example 34C

The method of example 33C, wherein the one or more parameters comprises a plurality of parameters, and wherein the bitstream includes the statistical mode value in place of the plurality of parameters and the one or more HOA coefficients associated with the one or more spherical basis functions having the order greater than zero.

Example 35C

The method of any combination of examples 26C-34C, further comprising performing speech decoding with respect to the first indication to obtain the HOA coefficient associated with the spherical basis function having the order of zero.

Example 36C

The method of example 35C, wherein performing the speech decoding comprises performing enhanced voice services (EVS) speech decoding with respect to the first indication to obtain the HOA coefficient associated with the spherical basis function having the order of zero.

Example 37C

The method of example 35C, wherein performing the speech decoding comprises performing adaptive multi-rate wideband (AMR-WB) speech decoding with respect to the first indication to obtain the HOA coefficient associated with the spherical basis function having the order of zero.

Example 38C

The method of any combination of examples 26C-37C, wherein the one or more parameters include a first angle, and wherein the one or more expanded parameters include a second angle.

Example 39C

The method of any combination of examples 26C-38C, wherein the one or more parameters include a first azimuth angle, and wherein the one or more expanded parameters include a second azimuth angle.

Example 40C

The method of any combination of examples 26C-39C, wherein the one or more parameters include a first elevation angle, and wherein the one or more expanded parameters include a second elevation angle.

Example 41C

The method of any combination of examples 26C-40C, wherein the one or more parameters include a first azimuth angle and a first elevation angle, and wherein the one or more expanded parameters include a second azimuth angle and a second elevation angle.

Example 42C

The method of any combination of examples 26C-41C, wherein the one or more parameters indicate an energy position within a frame of the HOA coefficient associated with the spherical basis function having the order of zero.

Example 43C

The method of any combination of examples 26C-42C, wherein the one or more parameters indicate an energy position within a portion of a frame of the HOA coefficient associated with the spherical basis function having the order of zero.

Example 44C

The method of example 43C, wherein the portion of a frame includes a sub-frame.

Example 45C

The method of example 43C, wherein the one or more parameters indicate an energy position within each of four sub-frames of a frame of the HOA coefficient associated with the spherical basis function having the order of zero.

Example 46C

The method of any combination of examples 26C-45C, further comprising: rendering, based on the HOA coefficient associated with the spherical basis function having the order of zero and the one or more HOA coefficients associated with the one or more spherical basis functions having the order greater than zero, a speaker feed; and outputting the speaker feed to a speaker.

Example 47C

The method of any combination of examples 26C-46C, further comprising receiving, by a receiver, at least the portion of the bitstream.

Example 48C

The method of example 47C, wherein the receiver is configured to receive the bitstream in accordance with an enhanced voice services (EVS) standard.

Example 49C

The method of example 26C, wherein the one or more parameters comprises a statistical mode value indicative of a value of the one or more parameters that appears more frequently than other values of the one or more parameters.

Example 50C

The method of any combination of examples 26C-49C, wherein the bitstream further includes a third indication representative of a prediction error, the prediction error representative of a difference between the one or more synthesized HOA coefficients and the one or more HOA coefficients associated with one or more spherical basis functions having an order greater than zero, and wherein the method further comprises updating, based on the prediction error, the one or more synthesized HOA coefficients.

Example 51C

A device configured to decode audio data, the device comprising: means for performing parameter expansion with respect to one or more parameters to obtain one or more expanded parameters; and means for synthesizing, based on the one or more expanded parameters and an HOA coefficient associated with a spherical basis function having an order of zero, one or more HOA coefficients associated with one or more spherical basis functions having an order greater than zero.

Example 52C

The device of example 51C, wherein the means for performing the parameter expansion comprises means for means for performing an interpolation with respect to the one or more parameters to obtain the one or more expanded parameters.

Example 53C

The device of any combination of examples 51C and 52C, wherein the means for performing the parameter expansion comprises means for performing a linear interpolation with respect to the one or more parameters to obtain the one or more expanded parameters.

Example 54C

The device of any combination of examples 51C-53C, wherein the one or more parameters include a first parameter from a first frame of the bitstream and a second parameter from a second frame of the bitstream, and wherein the means for performing the parameter expansion comprises means for performing a linear interpolation with respect to the first parameter and the second parameter to obtain the one or more expanded parameters.

Example 55C

The device of any combination of examples 51C-54C, wherein the one or more parameters include a first parameter from a first frame of the bitstream and a second parameter from a second frame of the bitstream, the first frame occurring temporally directly before the second frame, and wherein the means for performing the parameter expansion comprises means for performing a linear interpolation with respect to the first parameter and the second parameter to obtain the one or more expanded parameters.

Example 56C

The device of any combination of examples 51C-55C, wherein the one or more parameters include a first parameter from a first frame of the bitstream and a second parameter from a second frame of the bitstream, the first frame occurring temporally directly before the second frame, and wherein the means for performing the parameter expansion comprises means for performing a linear interpolation with respect to the first parameter and the second parameter to obtain an expanded parameter of the one or more expanded parameters for each sample in the second frame.

Example 57C

The device of any combination of examples 51C-56C, wherein the bitstream does not include the one or more HOA coefficients associated with the one or more spherical basis functions having the order greater than zero.

Example 58C

The device of any combination of examples 51C-57C, wherein the one or more parameters include a statistical mode value indicative of a value of the one or more parameters that occurs most often.

Example 59C

The device of example 58C, wherein the one or more parameters comprises a plurality of parameters, and wherein the bitstream includes the statistical mode value in place of the plurality of parameters and the one or more HOA coefficients associated with the one or more spherical basis functions having the order greater than zero.

Example 60C

The device of any combination of examples 51C-59C, further comprising means for performing speech decoding with respect to the first indication to obtain the HOA coefficient associated with the spherical basis function having the order of zero.

Example 61C

The device of example 60C, wherein the means for performing the speech decoding comprises means for performing enhanced voice services (EVS) speech decoding with respect to the first indication to obtain the HOA coefficient associated with the spherical basis function having the order of zero.

Example 62C

The device of example 60C, wherein the means for performing the speech decoding comprises means for performing adaptive multi-rate wideband (AMR-WB) speech decoding with respect to the first indication to obtain the HOA coefficient associated with the spherical basis function having the order of zero.

Example 63C

The device of any combination of examples 51C-62C, wherein the one or more parameters include a first angle, and wherein the one or more expanded parameters include a second angle.

Example 64C

The device of any combination of examples 51C-63C, wherein the one or more parameters include a first azimuth angle, and wherein the one or more expanded parameters include a second azimuth angle.

Example 65C

The device of any combination of examples 51C-64C, wherein the one or more parameters include a first elevation angle, and wherein the one or more expanded parameters include a second elevation angle.

Example 66C

The device of any combination of examples 51C-65C, wherein the one or more parameters include a first azimuth angle and a first elevation angle, and wherein the one or more expanded parameters include a second azimuth angle and a second elevation angle.

Example 67C

The device of any combination of examples 51C-66C, wherein the one or more parameters indicate an energy position within a frame of the HOA coefficient associated with the spherical basis function having the order of zero.

Example 68C

The device of any combination of examples 51C-67C, wherein the one or more parameters indicate an energy position within a portion of a frame of the HOA coefficient associated with the spherical basis function having the order of zero.

Example 69C

The device of example 68C, wherein the portion of a frame includes a sub-frame.

Example 70C

The device of example 68C, wherein the one or more parameters indicate an energy position within each of four sub-frames of a frame of the HOA coefficient associated with the spherical basis function having the order of zero.

Example 71C

The device of any combination of examples 51C-70C, further comprising: means for rendering, based on the HOA coefficient associated with the spherical basis function having the order of zero and the one or more HOA coefficients associated with the one or more spherical basis functions having the order greater than zero, a speaker feed; and means for outputting the speaker feed to a speaker.

Example 72C

The device of any combination of examples 51C-71C, further comprising means for receiving at least the portion of the bitstream.

Example 73C

The device of example 72C, wherein the means for receiving is configured to receive the bitstream in accordance with an enhanced voice services (EVS) standard.

Example 74C

The device of any combination of examples 51C-73C, wherein the one or more parameters comprises a statistical mode value indicative of a value of the one or more parameters that appears more frequently than other values of the one or more parameters.

Example 75C

The device of any combination of examples 51C-74C, wherein the bitstream further includes a third indication representative of a prediction error, the prediction error representative of a difference between the one or more synthesized HOA coefficients and the one or more HOA coefficients associated with one or more spherical basis functions having an order greater than zero, and wherein the device further comprises means for updating, based on the prediction error, the one or more synthesized HOA coefficients.

Example 76C

A non-transitory computer-readable storage medium having stored thereon instructions that, when executed, cause one or more processors to: perform parameter expansion with respect to one or more parameters to obtain one or more expanded parameters; and synthesize, based on the one or more expanded parameters and an HOA coefficient associated with a spherical basis function having an order of zero, one or more HOA coefficients associated with one or more spherical basis functions having an order greater than zero.

In addition, the foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yyet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding unit 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIGS. 3A-3B.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIGS. 3A-3B.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding unit 20 may perform a method or otherwise comprise means to perform each step of the method for which the audio encoding unit 20 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding unit 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding unit 24 may perform a method or otherwise comprise means to perform each step of the method for which the audio decoding unit 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding unit 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

In addition to or as an alternative to the above, the following examples are described. The features described in any of the following examples may be utilized with any of the other examples described herein.

Moreover, any of the specific features set forth in any of the examples described above may be combined into beneficial examples of the described techniques. That is, any of the specific features are generally applicable to all examples of the techniques.

Various examples of the techniques have been described. These and other aspects of the techniques are within the scope of the following claims.

What is claimed is:

1. A device configured to decode audio data, the device comprising:

a memory configured to store at least a portion of a bitstream, the bitstream including a first indication representative of an HOA coefficient associated with the spherical basis function having an order of zero, and a second indication representative of one or more angles; and one or more processors coupled to the memory, and configured to:

perform angle expansion with respect to the one or more angles to obtain one or more expanded angles; and synthesize, based on the one or more expanded angles and the HOA coefficient associated with the spherical basis function having the order of zero, one or more HOA coefficients associated with one or more spherical basis functions having an order greater than zero.

2. The device of claim 1, wherein the one or more processors are configured to perform an interpolation with respect to the one or more angles to obtain the one or more expanded angles.

3. The device of claim 1, wherein the one or more processors are configured to perform a linear interpolation with respect to the one or more angles to obtain the one or more expanded angles.

4. The device of claim 1, wherein the one or more angles include a first angle from a first frame of the bitstream and a second angle from a second frame of the bitstream, and wherein the one or more processors are configured to perform a linear interpolation with respect to the first angle and the second angle to obtain the one or more expanded angles.

5. The device of claim 1, wherein the one or more angles include a first angle from a first frame of the bitstream and a second angle from a second frame of the bitstream, the first frame occurring temporally directly before the second frame, and wherein the one or more processors are configured to perform a linear interpolation with respect to the first angle and the second angle to obtain the one or more expanded angles.

6. The device of claim 1, wherein the one or more angles include a first angle from a first frame of the bitstream and a second angle from a second frame of the bitstream, the first frame occurring temporally directly before the second frame, and wherein the one or more processors are configured to perform a linear interpolation with respect to the first angle and the second angle to obtain an expanded angle of the one or more expanded parameters angle for each sample in the second frame.

7. The device of claim 1, wherein the bitstream does not include the one or more HOA coefficients associated with the one or more spherical basis functions having the order greater than zero.

8. The device of claim 1, wherein the one or more angles include a statistical mode value indicative of a value of the one or more angles that occurs most often.

9. The device of claim 8, wherein the one or more angles comprises a plurality of angles, and wherein the bitstream includes the statistical mode value in place of the plurality of angles and the one or more HOA coefficients associated with the one or more spherical basis functions having the order greater than zero.

10. The device of claim 1, wherein the one or more processors are further configured to perform speech decoding with respect to the first indication to obtain the HOA coefficient associated with the spherical basis function having the order of zero.

11. The device of claim 10, wherein the one or more processors are configured to perform enhanced voice services (EVS) speech decoding with respect to the first indication to obtain the HOA coefficient associated with the spherical basis function having the order of zero.

12. The device of claim 10, wherein the one or more processors are configured to perform adaptive multi-rate wideband (AMR-WB) speech decoding with respect to the first indication to obtain the HOA coefficient associated with the spherical basis function having the order of zero.

13. The device of claim 1, wherein the one or more processors are further configured to:

render, based on the HOA coefficient associated with the spherical basis function having the order of zero and the one or more HOA coefficients associated with the one or more spherical basis functions having the order greater than zero, a speaker feed; and output the speaker feed to a speaker.

14. The device of claim 1, further comprising a receiver coupled to the one or more processors, and configured to receive at least the portion of the bitstream.

15. The device of claim 14, wherein the receiver is configured to receive the bitstream in accordance with an enhanced voice services (EVS) standard.

16. A method of decoding audio data, the method comprising:

performing an angle expansion with respect to one or more angles to obtain one or more expanded angles; and synthesizing, based on the one or more expanded angles and an HOA coefficient associated with a spherical basis function having an order of zero, one or more HOA coefficients associated with one or more spherical basis functions having an order greater than zero.

17. The method of claim 16, wherein the one or more angles include a first angle, and wherein the one or more expanded angles include a second angle.

18. The method of claim 16, wherein the one or more angles include a first azimuth angle, and wherein the one or more expanded angles include a second azimuth angle.

19. The method of claim 16, wherein the one or more angles include a first elevation angle, and wherein the one or more expanded angles include a second elevation angle.

20. The method of claim 16, wherein the one or more angles include a first azimuth angle and a first elevation angle, and wherein the one or more expanded angles include a second azimuth angle and a second elevation angle.

21. The method of claim 16, wherein the one or more angles indicate an energy position within a frame of the HOA coefficient associated with the spherical basis function having the order of zero.

22. The method of claim 16, wherein the one or more angles indicate an energy position within a portion of a frame of the HOA coefficient associated with the spherical basis function having the order of zero.

23. The method of claim 22, wherein the portion of a frame includes a sub-frame.

24. The method of claim 22, wherein the one or more angles indicate an energy position within each of four sub-frames of a frame of the HOA coefficient associated with the spherical basis function having the order of zero.

25. The method of claim 16, wherein the one or more angles comprises a statistical mode value indicative of a value of the one or more angles that appears more frequently than other values of the one or more angles.

26. The method of claim 16, wherein the bitstream further includes an indication representative of a prediction error, the prediction error representative of a difference between the one or more synthesized HOA coefficients and the one or more HOA coefficients associated with one or more spherical basis functions having an order greater than zero, wherein the method further comprises updating, based on the prediction error, the one or more synthesized HOA coefficients.

27. A device configured to encode audio data, the device comprising:

a memory configured to store the audio data, the audio data representative of a higher order ambisonic (HOA) coefficient associated with a spherical basis function having an order of zero, and one or more HOA coefficients associated with one or more spherical basis functions having an order greater than zero; and one or more processors coupled to the memory, and configured to:

obtain a plurality of angles from which to synthesize the one or more HOA coefficients associated with the one or more spherical basis functions having the order greater than zero;

obtain, based on the plurality of angles, a statistical mode value indicative of a value of the plurality of angles that appears more frequently than other values of the plurality of angles; and generate a bitstream to include first indication representative of an HOA coefficient associated with the spherical basis function having an order of zero, and a second indication representative of the statistical mode value.

28. The device of claim 27, wherein the one or more processors obtain the plurality of angles using a closed loop process in which determination of a prediction error is performed.

29. The device of claim 27, further comprising:

a microphone coupled to the one or more processors, and configured to capture the audio data; and a transmitter coupled to the one or more processors, and configured to transmit the bitstream, wherein the transmitter is configured to transmit the bitstream in accordance with an enhanced voice services (EVS) standard.

30. A method of encoding audio data, the method comprising:

obtaining a plurality of angles from which to synthesize one or more HOA coefficients associated with one or more spherical basis functions having an order greater than zero;

obtaining, based on the plurality of angles, a statistical mode value indicative of a value of the plurality of angles that appears more frequently than other values of the plurality of angles; and generating a bitstream to include a first indication representative of an HOA coefficient associated with the spherical basis function having an order of zero, and a second indication representative of the statistical mode value.

* * * * *